US006825864B2

(12) United States Patent
Botten et al.

(10) Patent No.: US 6,825,864 B2
(45) Date of Patent: Nov. 30, 2004

(54) MULTI-MEDIA PRINTER

(75) Inventors: Peter Botten, Lakewood, OH (US); Michael Kolberg, Hinckley, OH (US); Lawrence Srnka, Northfield Center, OH (US); Christopher Tainer, Springsville, OH (US); Donald Rahe, Brookpark, OH (US); Joseph Miller, Rittman, OH (US); Peter Adam, Kirkland, WA (US); Robert Colbrunn, Hinckley, OH (US); Vladimir Dzodzo, Akron, OH (US); Kevin Roach, Parma Height, OH (US); Owen Patton, Parma, OH (US); Eric Lab, Akron, OH (US); Neal Somos, Brecksville, OH (US); James Bias, North Royalton, OH (US)

(73) Assignee: Codonics, Inc., Middleburg Heights, OH (US)

( * ) Notice: Subject to any disclaimer, the term of this patent is extended or adjusted under 35 U.S.C. 154(b) by 183 days.

(21) Appl. No.: 09/995,385

(22) Filed: Nov. 26, 2001

(65) Prior Publication Data

US 2003/0098984 A1 May 29, 2003

(51) Int. Cl.[7] ..... B41J 17/22

(52) U.S. Cl. ..... 347/215

(58) Field of Search ..... 347/217, 215, 347/172, 176, 174

(56) References Cited

U.S. PATENT DOCUMENTS 5,253,941 A * 10/1993 Kamoda ..... 400/692
5,266,969 A * 11/1993 Mochizuki ..... 347/172

* cited by examiner

*Primary Examiner*—Huan Tran
(74) *Attorney, Agent, or Firm*—Pillsbury Winthrop LLP

(57) ABSTRACT

A printer capable of transferring images to different types of media is disclosed. Media sheets of different sizes and types may be dispensed through a single input path to a print station including a printhead and a platen. The printhead is adapted for transferring images to media using either a direct thermal or dye diffusion process. A capstan roller, platen roller, picker assemblies and kicker assemblies are driven by a single motor, allowing for substantial cost and space savings. Other features are directed to improving the quality of images using the direct thermal and dye diffusion processes.

24 Claims, 41 Drawing Sheets

MULTI-MEDIA PRINTER

BACKGROUND

1. Field of the Invention

Embodiments of the present invention are directed to printing systems. In particular, embodiments of the present are directed to printing systems capable of transferring images to different types of media.

2. Related Art

High quality imaging for precision applications such as medical diagnostics typically require the use of large and expensive photographic equipment. This equipment is typically large, bulky and expensive. Additionally, such photographic equipment is difficult and costly to maintain.

Advancements in printer technology have enabled the use of stand-alone printers to provide high quality printing. Such printer technology has eliminated the need for costly and inconvenient photographic laboratories. Printing systems can perform precision imaging using processes such as direct thermal imaging or dye diffusion imaging on opaque media or transparent film. Unfortunately, typical systems for performing dye diffusion or direct thermal printing to provide image quality suitable for medical diagnostics are very costly. Additionally, these printers are typically bulky and occupy valuable space in a work environment. Furthermore, an operation which relies on precision requiring direct thermal and dye diffusion printer capabilities, such as a medical diagnostic center, typically needs to purchase and maintain two separate printers, one for direct thermal imaging and one for dye diffusion printing. The purchase and maintenance of multiple printers further contributes to high costs and inconvenience associated with typical printing systems used in environments requiring precision imaging.

There is, therefore, a need for simpler and more cost effective alternative for providing precision imaging capabilities to enterprises.

SUMMARY

An object of an embodiment of the present invention is a system and method of providing precision image quality suitable for medical diagnostics in a cost effective manner.

Another object of an embodiment of the present invention is to provide a system and method of transferring images to media sheets of varying sizes.

Another object of an embodiment of the present invention is to provide images on media with image quality suitable medical diagnostics or other high precision application from a system which does not occupy a large amount of space.

It is yet another object of an embodiment of the present invention to eliminate the need for multiple printers for performing different types of image transfer processes.

Briefly, an embodiment of the present invention is directed to a printer which is capable of performing either direct thermal imaging or dye diffusion imaging from a single printhead and through a single media path. Other features and advantages of the invention will become apparent from the following detailed description, taken in conjunction with the accompanying drawings, which illustrate, by way of example various features of embodiments of the invention.

DETAILED DESCRIPTION

Embodiments of the present invention are directed to a multi-media printer capable of transferring images to media using either direct thermal or dye diffusion imaging process. Multiple media trays are adapted to dispense media sheets to a single input path. The media trays may dispense different sizes and types of media for direct thermal or dye diffusion printing. A print station including a printhead receives media sheets from the input path fed by multiple media input trays. The print station may be configurable in real-time to transfer images to media using either the direct thermal or dye diffusion imaging process. In embodiments of the invention, a single motor may drive a capstan roller, a platen roller and kicker assemblies for output trays. This allows for a reduced size and cost while providing superior image quality suitable for medical imaging. Other embodiments described herein are directed to providing additional cost and size advantages, as well as improvements in media selection and identification capabilities and image quality using the direct thermal and dye diffusion imaging processes.

Embodiments of the multi-media printer described herein are capable of dispensing media sheets from anyone of a plurality of media input trays. The media trays may hold stacks of media sheets of different sizes (e.g., 8.0×10 inches, 8.5×11 inches, 14×17 inches, etc.) and/or different media types (e.g., opaque media for direct thermal imaging, opaque media for dye diffusion imaging, transparent film for direct thermal imaging and transparent media for dye diffusion printing). Thus, each media input tray may hold a stack of media sheets of an associated media size and media type. The media printer may include a separate picker assembly associated with each of the input trays for individually dispensing media sheets to a common input path.

The print station includes a platen roller and a printhead which is capable of transferring an image to media sheets dispensed from the input trays using either a dye diffusion or direct thermal printing process. When employing the dye diffusion process, a donor carriage may provide a multi-colored dye diffusion donor ribbon between the printhead 151 (in FIG. 11C) and a sheet of receiving media. The donor ribbon may provide any one of several color combinations such as cyan, magenta and yellow (CMY); CMY and black; and CMY and laminate. When the printer performs direct thermal imaging onto a subsequent media sheet, the donor ribbon may be removed so that the printing is applied directly to the subsequent media sheet. Accordingly, the multi-media printer of the illustrated embodiment can perform either dye diffusion or direct thermal imaging from a single print station that receives media sheets from a single input path. A capstan and pinch roller combination may translate the imaged media through a common discharge path. The media may then be diverted to anyone of a plurality of output trays.

Figure 1:
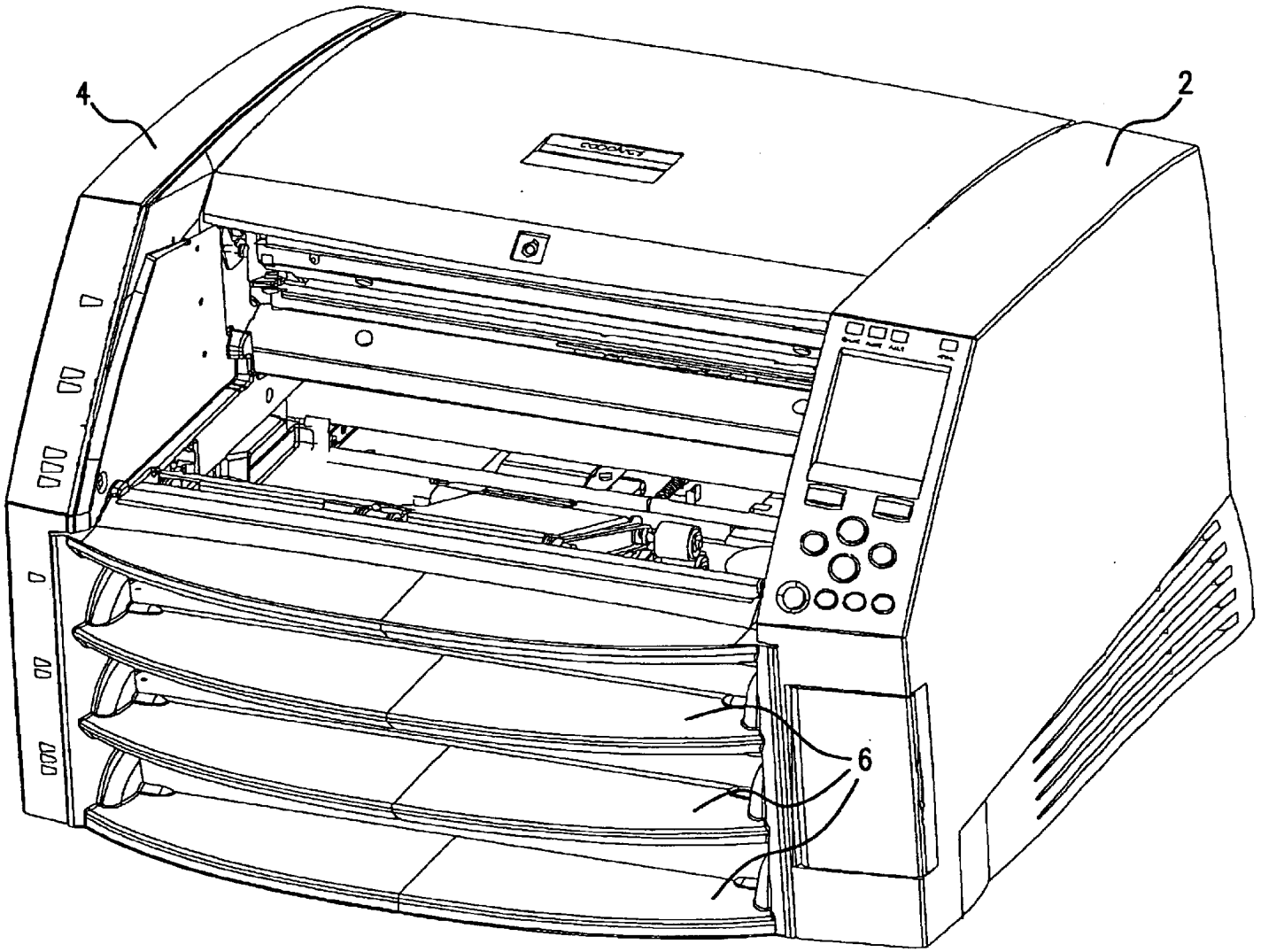
FIG. 1 shows a perspective view of a multi-media printer according to an embodiment of the present invention with a top panel of the printer removed to expose a picker assembly.

FIG. 1 shows a perspective view of an embodiment of the multi-media printer. Input media cavities 6 may be adapted to receive input media trays (not shown) as described in U.S. patent application Ser. No. 08/979,683, filed on Nov. 26, 1997, entitled "System and Method for Dispensing Media for Capturing Images," assigned to Codonics Inc., and incorporated herein by reference. The multi-media printer may include compartments for housing various electromechanical systems for controlling the printer. For example, compartment 2 may include a central printer controller such as a 600 megahertz Pentium printer controller (not shown), which may be used as a printer controller among other functions, and which may be combined with a motor control board (not shown). Alternatively, the printer controller and motor control board may be separated in a motherboard/daughterboard combination.

Figure 2:
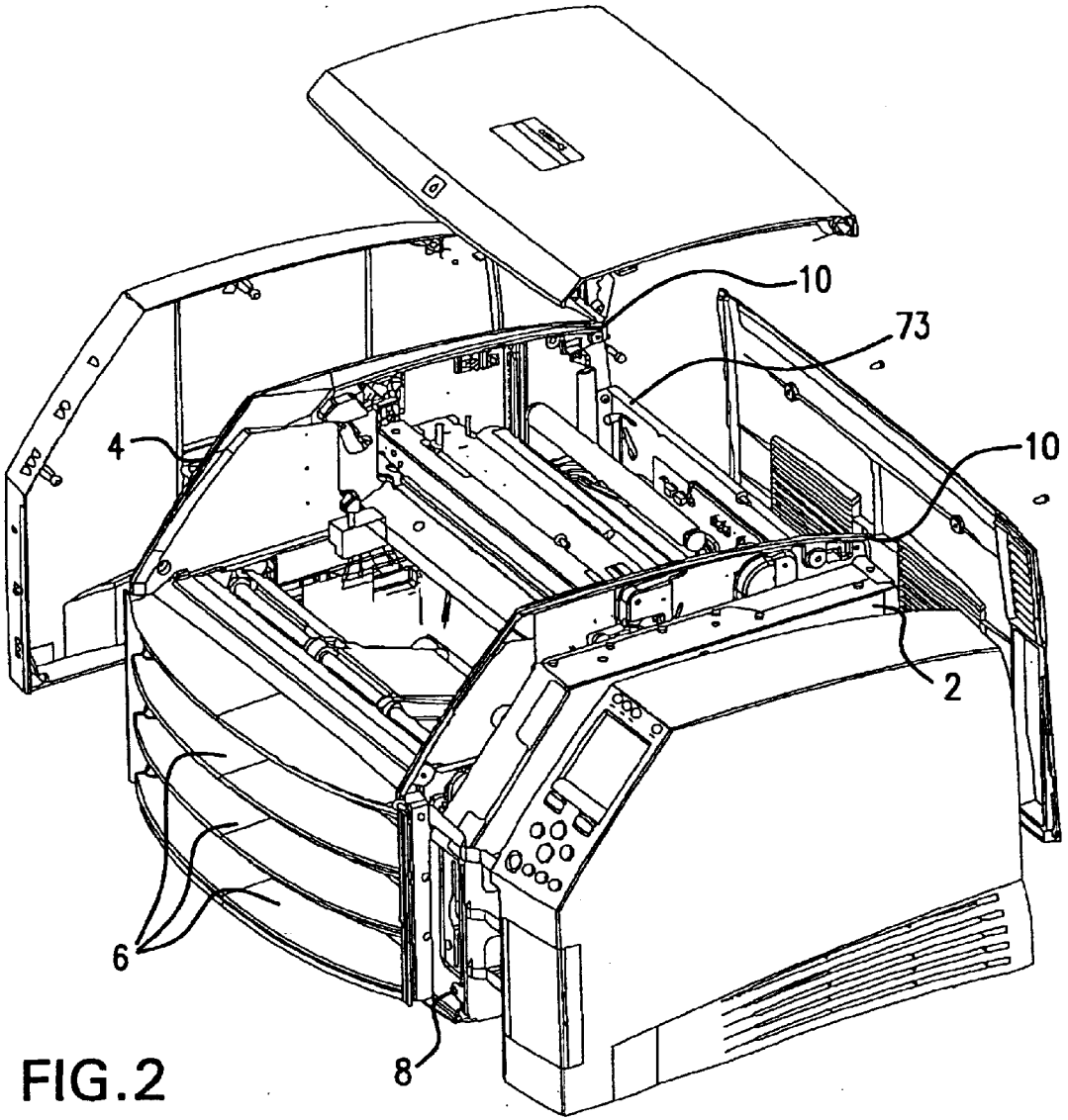
FIG. 2 shows an exploded view of the multi-media printer exposing a chassis behind housing panels.
Figure 9A:
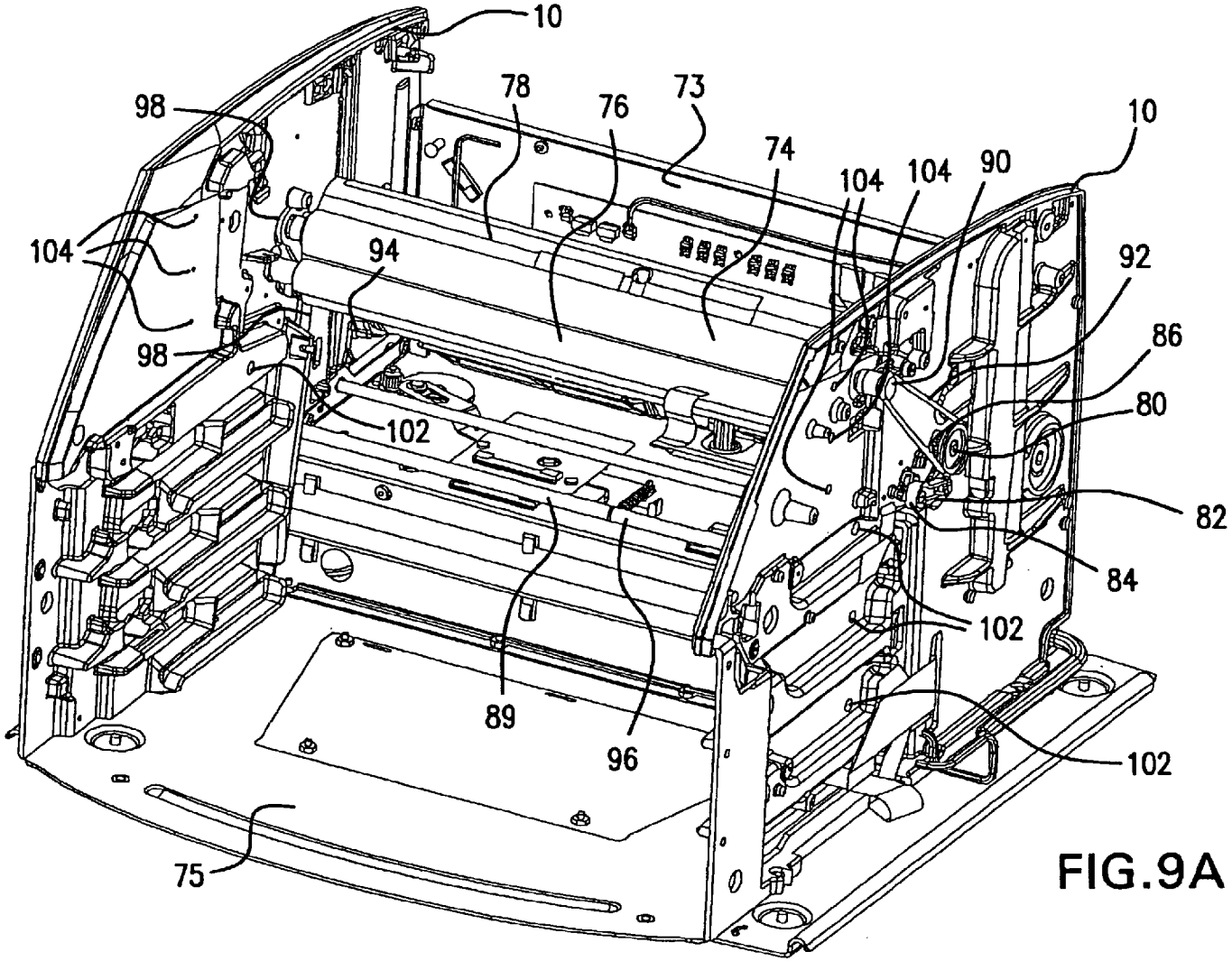
FIG. 9A shows a view of the multi-media printer with a side panel of the enclosure removed to expose a mechanism for applying torque to a platen roller from a stepper motor.

FIG. 2 shows a perspective view of the multi-media printer with enclosure components removed exposing a chassis thereof The chassis includes side walls 10. As shown in FIG. 9A, the chassis may further include a base 75 and a cross chassis 73 forming a back portion, a bottom portion coupled to the base 75 and side portions coupled to each of the sides 10. The compartment 2 may include a bay for securing a removable memory device 8 (e.g., a high density disk drive, such as a Zip drive sold by Iomega).

Figure 3A:
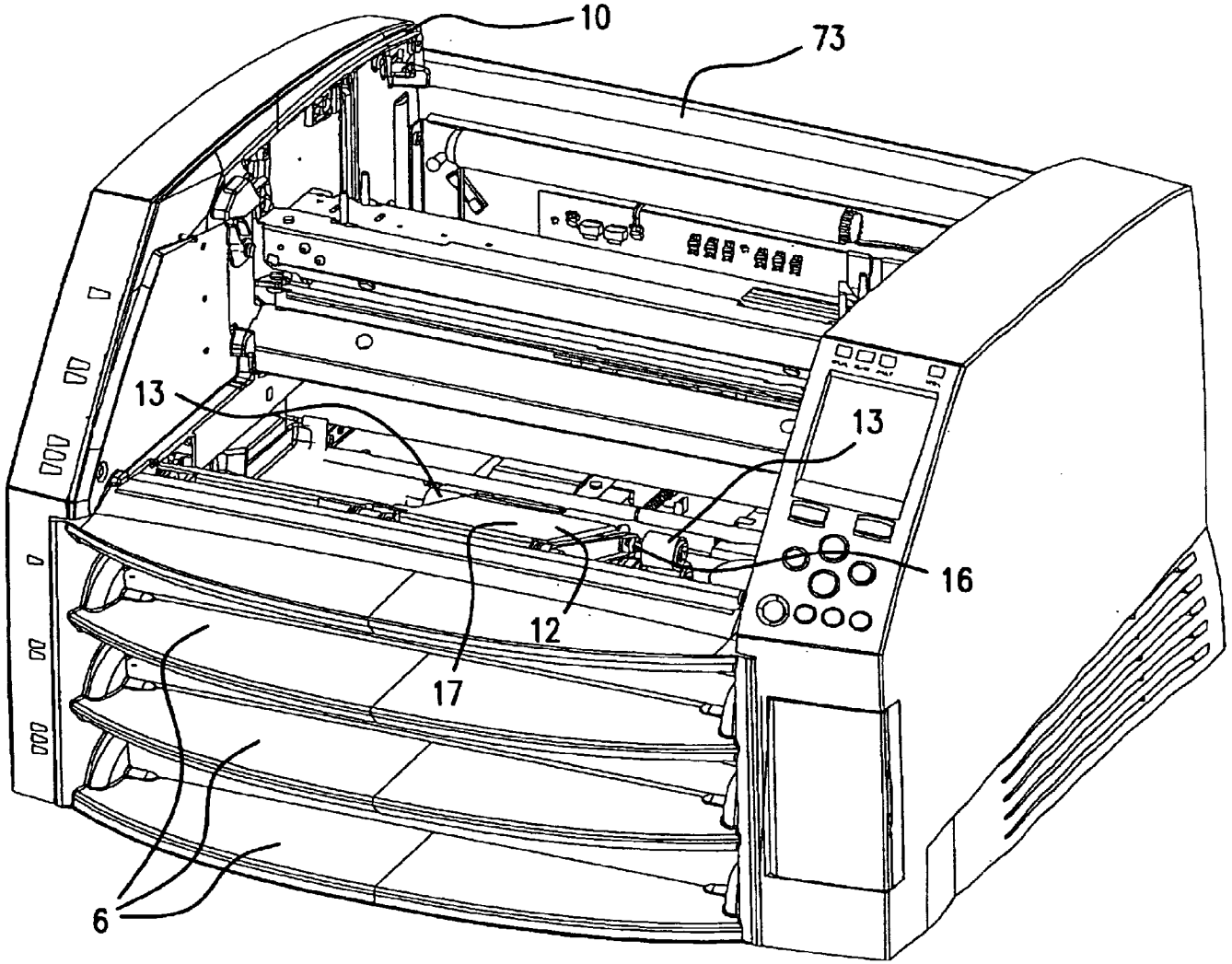
FIG. 3A shows a view of the multi-media printer with a top panel of the enclosure removed and exposing a picker assembly.

FIG. 3A shows an embodiment of the multi-media printer with a top panel of the enclosure removed while exposing a picker assembly 12. In the illustrated embodiment, each of the media input cavities 6 is associated with a separate picker assembly 12. Each of the picker assemblies 12 includes two picker tires 13 to provide a lateral force to the top sheet in a stack of media disposed within the respective media tray when the tires are rotated. In response to the lateral force, the top sheet is translated, causing the top sheet to be dispensed from the media tray through a media input path to a print station. As discussed below, each of the picker assemblies 12 receives a source of torque from a single source of torque at DC servo motor 30 (shown in FIG. 4). The DC servo motor 30 may receive signals from the printer controller to control the speed and rotational displacement of the DC servo motor. The DC servo motor 30 may include an encoder to directly or indirectly measure its rotational displacement, speed, etc. The DC servo motor 30 may also include one or more optically detectable flags and a sensor for detecting the flag to provide a feedback signal to the printer controller for controlling the speed and displacement.

This structure eliminates the need for having a separate picker motor for each of the picker assemblies 12, permitting a reduced size and cost for the printer. The single source of torque causes the picker tires 13 of each of the picker assemblies 12 to rotate simultaneously. When a particular media tray is selected to dispense its top media sheet, the picker tires 13 of the corresponding picker assembly may be lowered to the top sheet of the selected media tray to provide the aforementioned lateral force until the leading edge of the dispensed media sheet reaches the print station. After such time the picker tires 13 may be lifted from the stack of media sheets. In the embodiment shown in FIG. 3A, the picker tires 13 are rotated using a side belt drive 16.

Figure 3B:
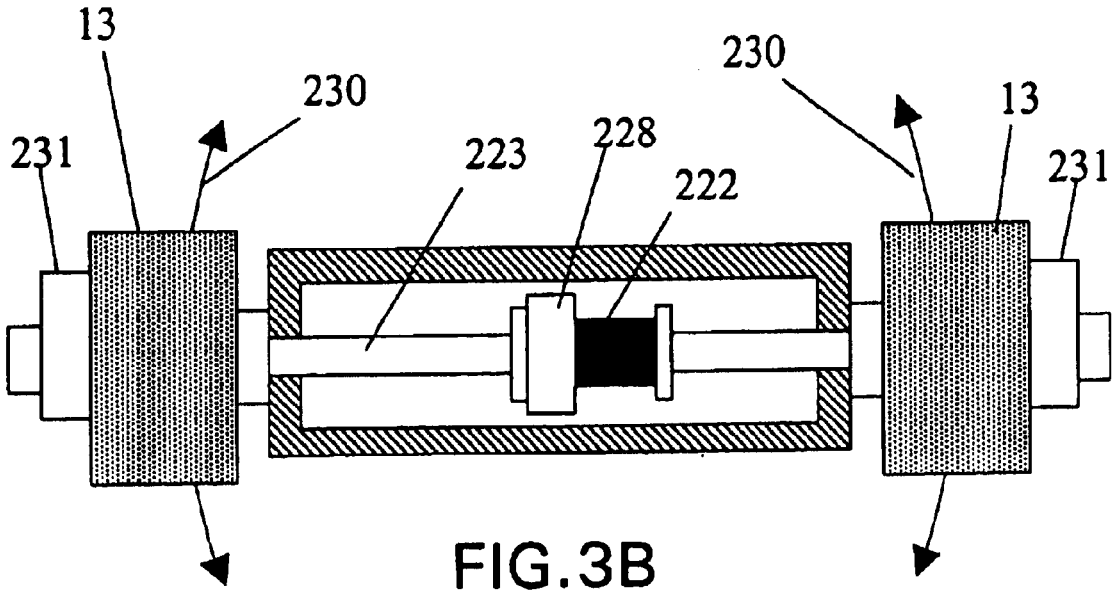
FIGS. 3B and 3C show an alternative embodiment for a picker assembly.
Figure 3C:
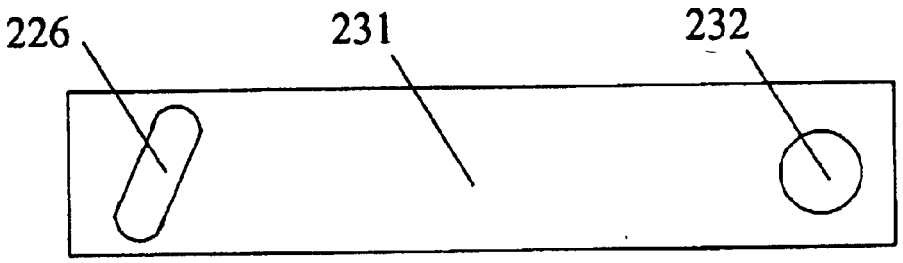
Figure 3D:
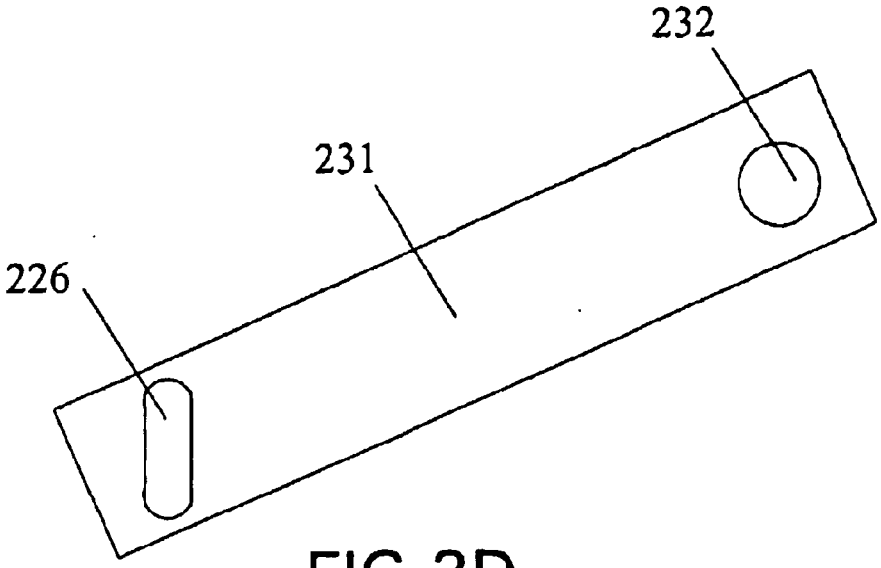

FIGS. 3B, 3C and 3D illustrate an alternative embodiment of the picker assembly 12 in which the picker tires 13 are rotated in response to a torque applied by a center belt 222 located between the picker tire 13. A picker drive shaft 223 receives a torque from the center belt 222 for rotating the picker tire 13. The picker drive shaft 223 is fixed at a pivot point 228 such that the picker drive shaft 223 can rotate in directions (illustrated by arrows 230) in a plane substantially normal to the top sheet and the media stack. As illustrated, the pivot point 228 may be a pivot bushing joining two separate shafts to form the picker drive shaft 223. By having a center belt 222 and allowing the picker tires to move in the direction 230 along with the drive shafts 223, the force applied by the picker tires 13 to the top sheet of media is substantially evenly distributed between the picker tires 13. This prevents skewing of the media sheets while being dispensed from the media trays when a greater lateral force is being applied to the media sheet by one of the picker tires 13.

FIGS. 3C and 3D show a side view of a picker arm 231 in a raised and lowered position, respectively, according to an embodiment of the invention. In the embodiment of the invention shown in FIG. 3B, a picker assembly 12 may have a picker arm 231 on each side of the center belt drive 222. The picker arm 231 may include a diagonal slot 226 which receives the drive shaft 223. When the picker arm 231 is in the lowered position to apply a lateral force to the top media sheet from the picker tire 13, the diagonal slot 226 may be aligned so as to be substantially vertical to the bottom media sheet. The length of the diagonal slot may thus serve to limit the range of movement of the picker arm 13 in the direction normal to the top sheet (shown by arrows 230). When the picker arm 231 is in a position such that the picker tires 13 are not touching the bottom sheet of a stack of media or the bottom of the media tray, the diagonal slot creates a lifting force vector. This creates a negative feedback so one tire does not grab more than the other, by allowing the shaft 223 to move in the vertical direction (i.e., direction 230) to balance the forces on the media sheet applied by the two picker tires 13. In the illustrated embodiment, picker tires 13 may be made of a spongy rubber composition having a width of up to 1½" and a diameter of about ⅝" to provide optimal traction to many different types of media to be dispensed from the media trays.

Figure 4:
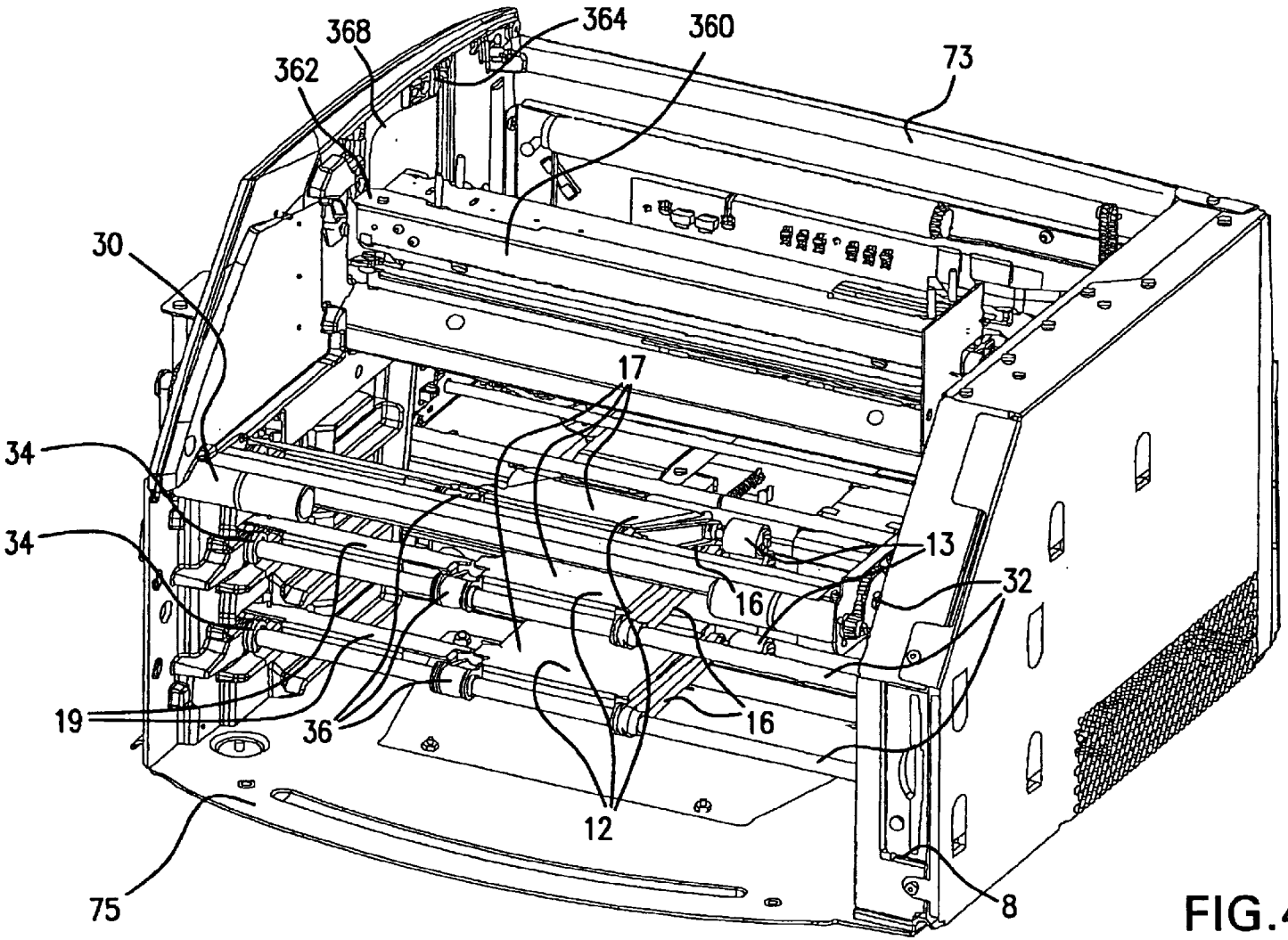
FIG. 4 shows a view of the multi-media printer exposing picker assemblies associated with media tray cavities.
Figure 5:
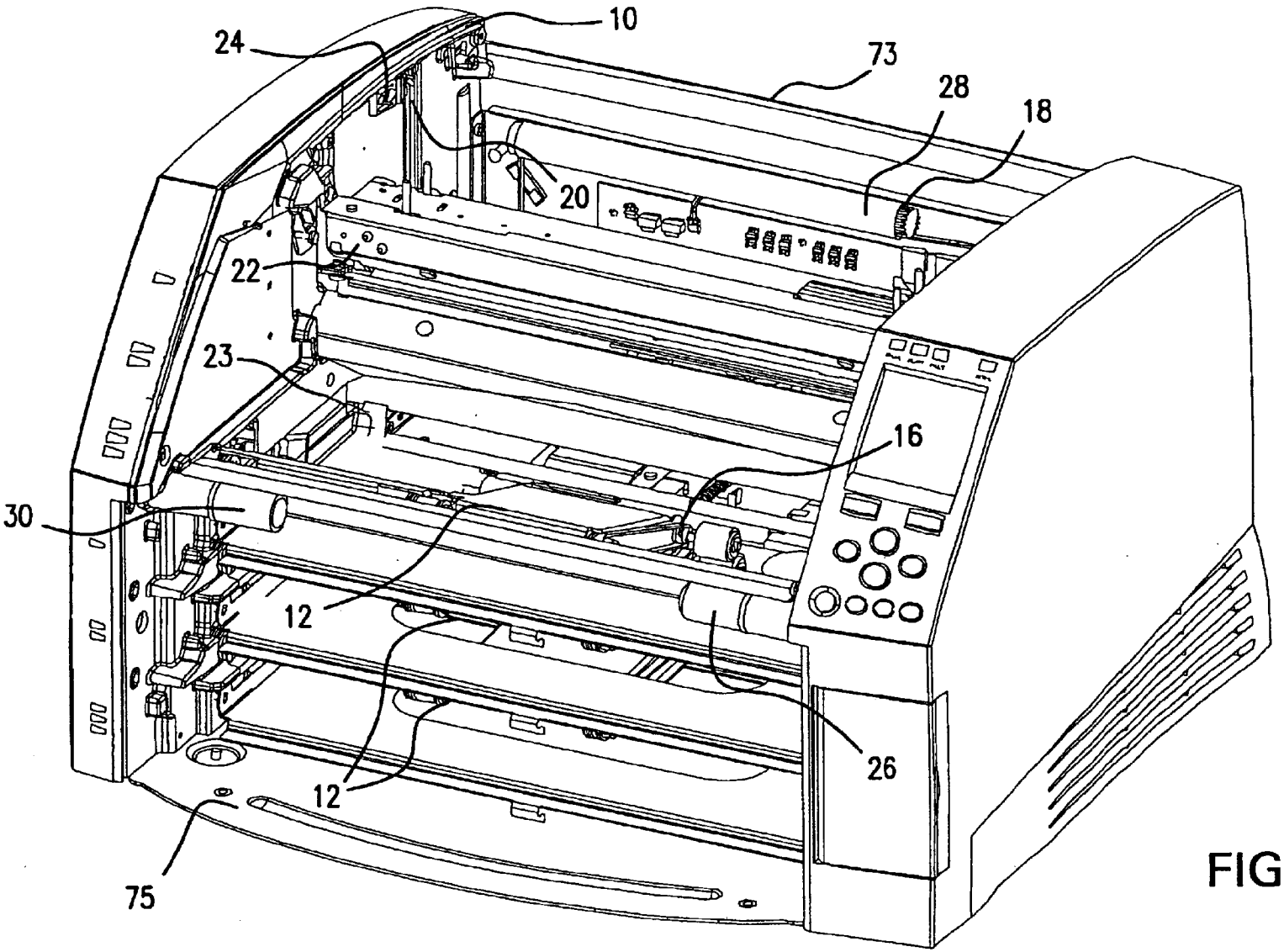
FIG. 5 shows a view of the multi-media printer exposing a mechanism for driving the picker assemblies illustrated in FIG. 4.

Returning to an embodiment in which side drive belts 16 are used, FIG. 4 illustrates a mechanism for raising and lowering the picker assemblies 12. Each of the picker assemblies 12 is coupled to a torque shaft 32 for driving the side drive belts 16 to rotate the picker tires 13 in response to the DC servo motor 30. Each of the picker assemblies 12 includes a sheet metal arm 17 that may be rotated to raise and lower the picker tires 13. Torsion springs 34 apply torque through members 19 to each of the sheet metal arms 17 in a direction that raises the picker assembly 12. Torque springs 36 apply a torque to the sheet metal arms 17 in the opposite direction of the torque of torsion springs 34. If the torque applied by torsion springs 34 is greater than the torque applied by torsion springs 36, the picker assemblies 12 are maintained in a position such that the picker tires 13 are raised above the top sheet in the media tray.

As discussed below, a motor 30 raises and lowers a bar code scanner for reading a bar code on the side of media trays as illustrated on the aforementioned U.S. patent application Ser. No. 08/979,683. As the bar code scanner moves to a media tray position, the corresponding torsion spring 34 is pulled back, reducing its torque on the sheet metal arm 17 of the selected picker assembly 12, to allow the corresponding torsion spring 36 on the same sheet metal arm 17 to lower the picker tires 13. The torque translates to the lateral force of the picker tires 13 of the lowered picker assembly 12 against the top media sheet in the selected tray to translate the top sheet through the input path.

Figure 6:
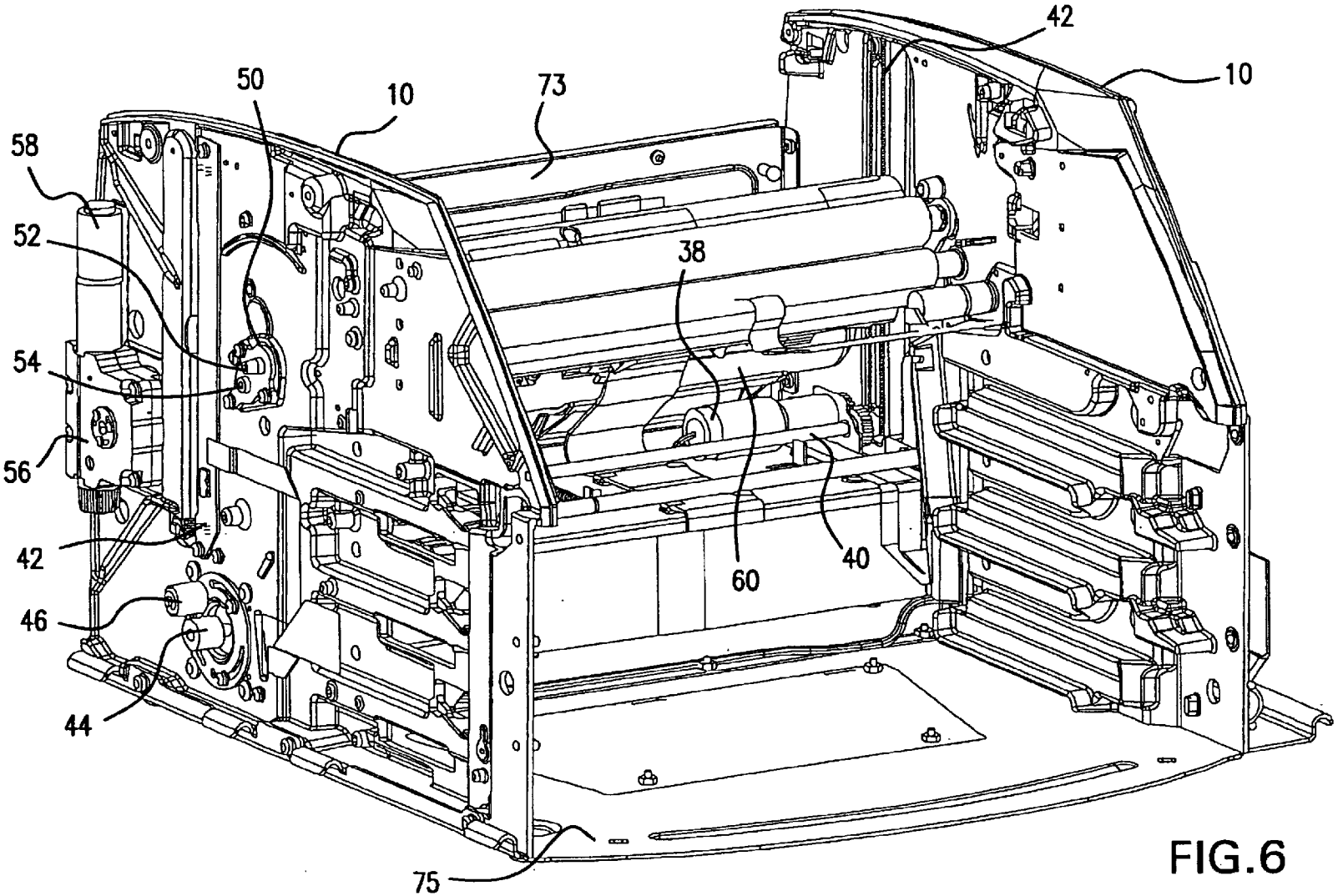
FIG. 6 shows a view of the multi-media printer behind a side panel of the enclosure exposing a drive mechanism.

FIG. 6 shows a perspective view of the multi-media printer with all enclosures removed. A donor lift motor 38 may provide torque to a jack shaft 40 to move timing belts 42 to raise or lower a donor donor spool (not shown) attached to the timing belts 42 at each end. The timing belts 42 may raise or lower the donor spool depending upon whether the multi-media printer is to imprint an image on the media using a direct thermal or dye diffusion process. If the printer is to use a direct thermal process, the timing belts 42 may raise the donor spool to remove the donor ribbon from between the printhead 151 (in FIG. 11C) and the media receiving the image. If the printer is using a dye diffusion process, the timing belts 42 may conversely lower the donor spool to extend the donor ribbon between the printhead 151 (in FIG. 11C) and the receiving media. A five-phase stepper motor 44 may provide a belt-driven torque to a capstan shaft 52 using a belt tension idler 46. A platen shaft 54 may be selectively clutched with the capstan shaft 52 to drive a platen as discussed below with reference to FIG. 9. The five-phase stepper motor enables the printer controller to accurately control the rotations of the capstan roller and platen using pulse encoded signals.

A worm gear (not shown) enclosed within worm gear housing 56 is driven by worm gear motor 58 to control the torque applied by a torque arm to the printhead 151 (in FIG. 11C) as discussed below with reference to FIGS. 15 and 20 in response to control signals from the printer controller.

Figure 7:
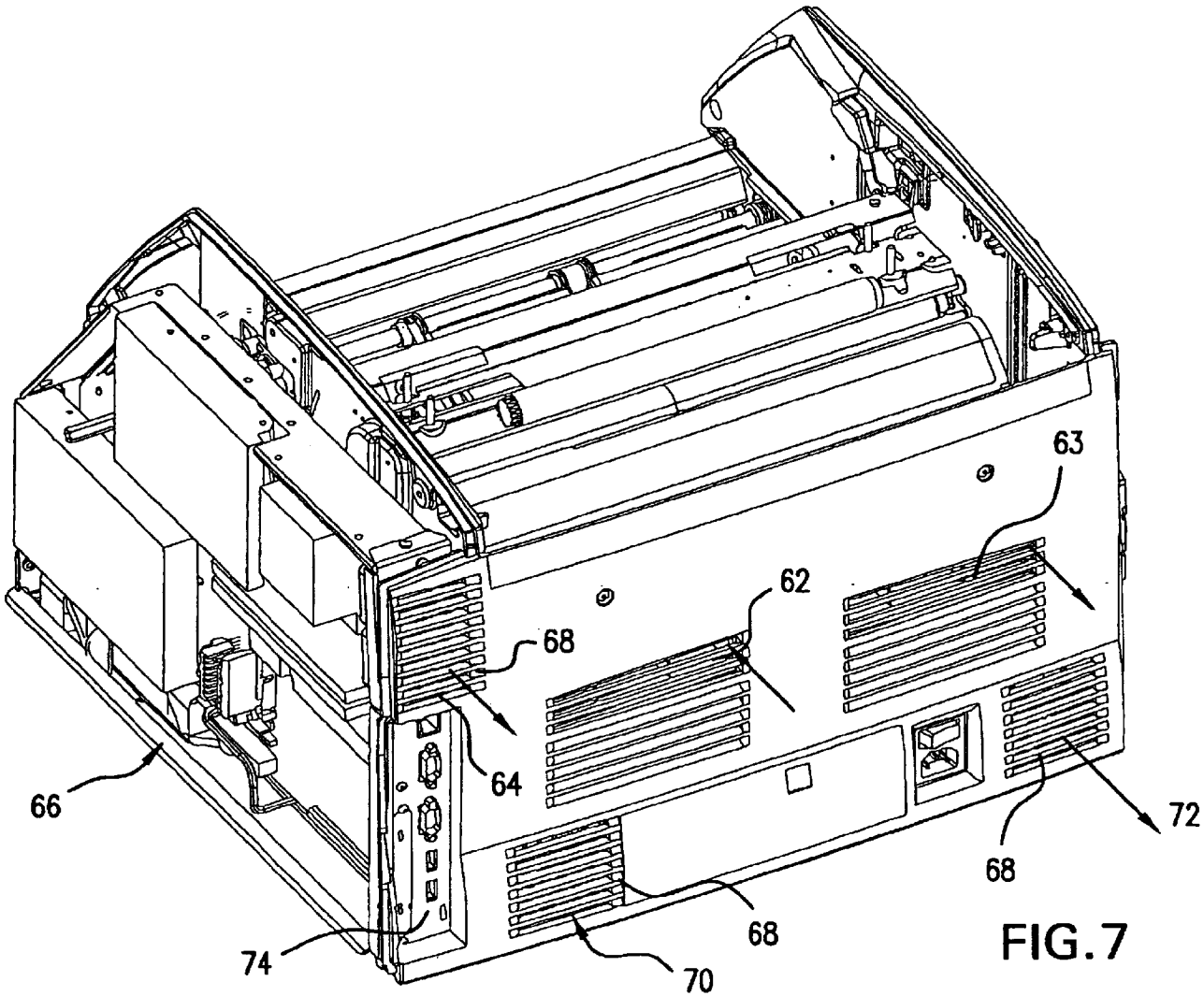
FIG. 7 shows a rear view of the multi-media printer illustrating external vents in the enclosure thereof

FIG. 7 shows a rear view of the multi-media printer which may include vents for cooling a power supply 138 (FIG. 13), a printhead 151 (in FIG. 11C), and a printer controller and other electronics disposed within the compartment 2 (FIG. 1). In the illustrated embodiment, these vents allow air to circulate about the heat sink, power supply and electronics disposed within the compartment 2 while remaining insulated from the print station. This reduces the amount of dust and particulates that may interfere with the direct thermal or dye diffusion processes occurring at the printhead 151 (in FIG. 11C) resulting in artifacts. Intake vent 70 and exhaust vent 72 allow external air to circulate through to the power supply 138 under the power of a fan (not shown). Similarly, printhead vents 62 and 63 allow air to circulate to a heat sink of the printhead 151 (in FIG. 11C) under the power of one or more fans (not shown). Printhead vents 62 and 63 each have eight vertically arranged horizontal slits. The lower five slits of the printhead vents 62 and 63 provide intakes and the upper three slits of printhead vents 62 and 63 provide exhausts. Again, as illustrated below with reference to FIG. 21, the air circulated through the vents 62 and 63 is insulated from the print station. Vents 66 and 68 permit air to circulate through to the printer controller and other electronics while maintaining insulated from the print station under the power of a fan. Vent 66 provides an intake while vent 69 provides an exhaust.

Figure 8:
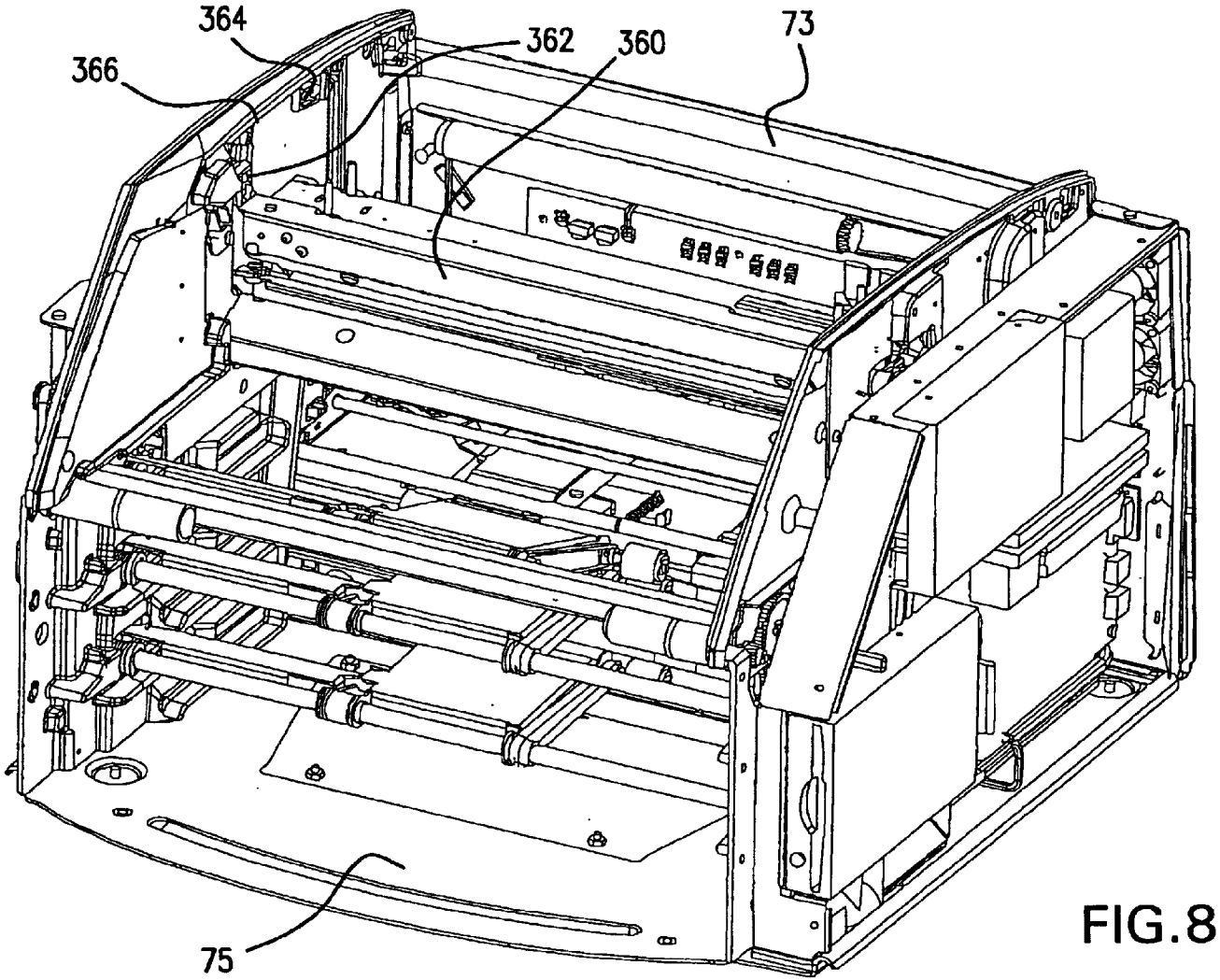
FIG. 8 shows a frontal perspective view of the multi-media printer with enclosure panels removed.

FIG. 8 shows a perspective view of the multi-media printer with the enclosure pieces removed so as to illustrate components of an output diversion mechanism discussed more thoroughly below with respect to FIG. 18.

Figure 22:
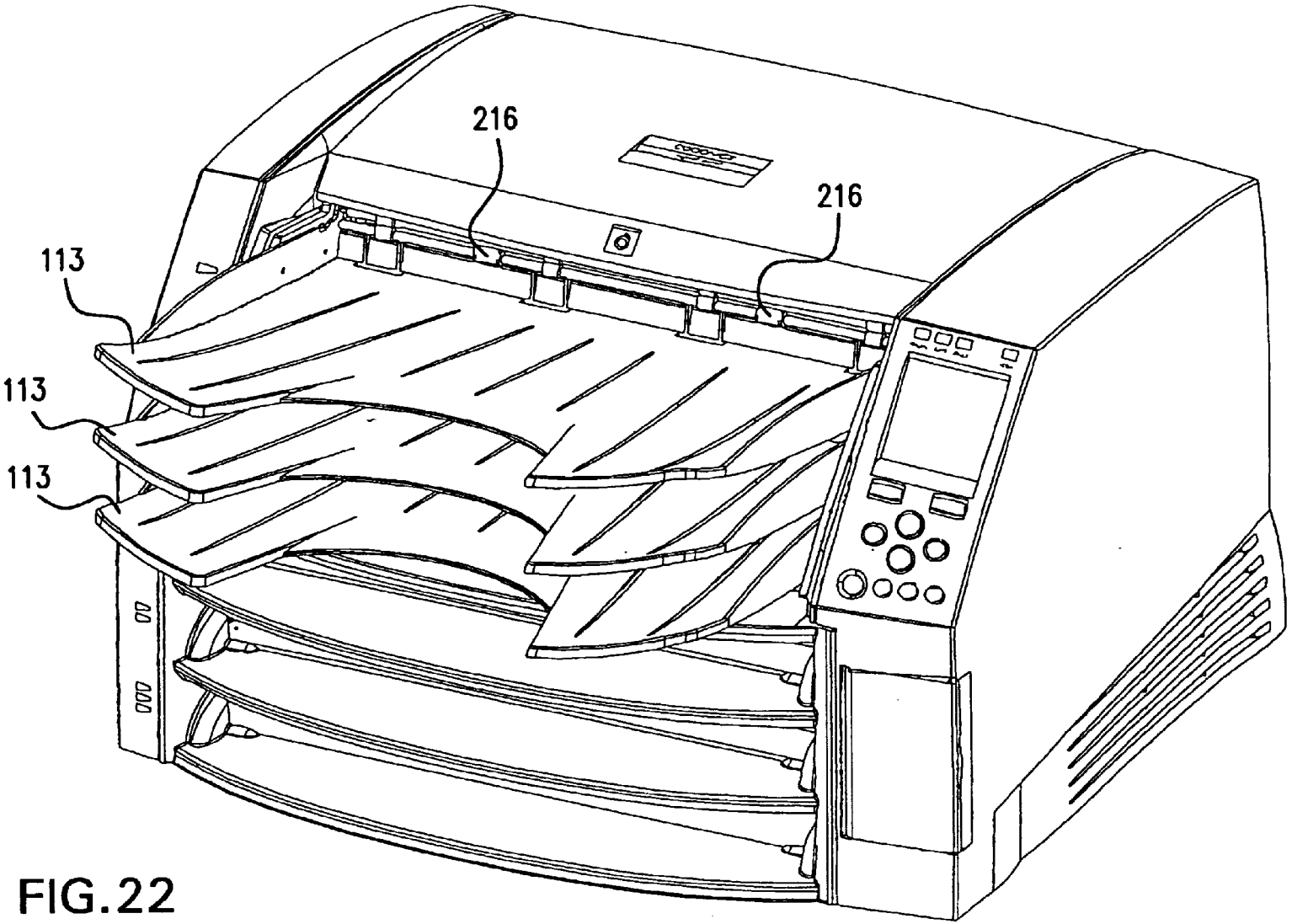
FIG. 22 is shows a view of the multi-media printer illustrating a kicker assembly associated with the removable output tray illustrated in FIGS. 11D and 11E.

FIG. 9A shows another perspective view of the multi-media printer with the enclosure covers removed. A pinch roller 77 is in contact with a capstan roller 79 which receives media sheets receiving printed images from the printer (not shown). Capstan drive 80 receives a torque from stepper motor 44 (FIG. 6) through a compliant belt as discussed above. A platen gear 82 may be moved inward or outward by an arm 84 to form a clutch mechanism for applying and removing torque to the platen shaft 54 (FIG. 6). This clutch mechanism receives torque from the capstan gear 86 to rotate the platen roller 76. The capstan drive 80 also engages a compliant belt drive 90 for transferring torque to output kickers after the media passes the print station to be dispense into an output tray 113 (FIG. 22). Accordingly, a five-phase stepper motor 44 may provide a single source of torque for rotating the capstan drive 80 which may be engaged with the clutch to rotate the platen roller 76 and transfers torque to output kickers through belt drive 90.

Figure 9B:
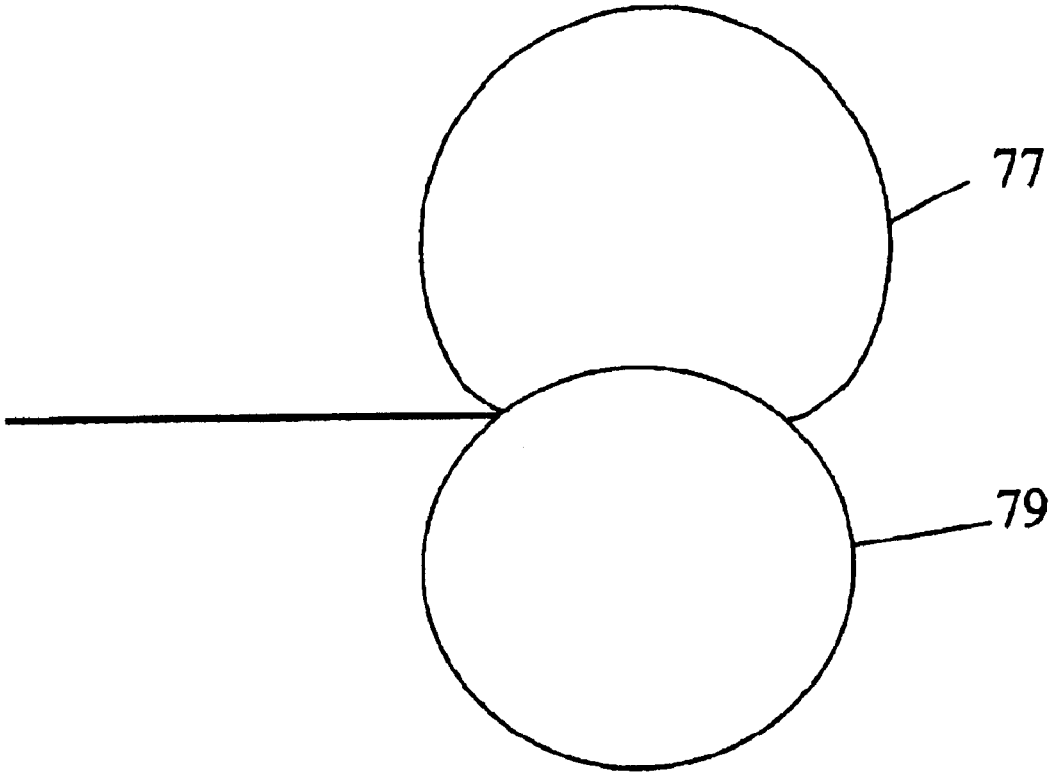
FIG. 9B shows a capstan and pinch roller combination according to an embodiment of the multi-media printer.

FIG. 9B shows a pinch and capstan roller combination in which a pinch roller 77 is composed of a soft, elastic (e.g., spongy) substance and the roller 79 is rigid and substantially non-deformable. The capstan roller 79 may be coated to provide a high coefficient of static fraction when in contact with the media sheets. This combination provides a substantial surface area of contact of the media sheet with the pinch and capstan rollers 77 and 79, and prevents slippage of the media with respect to the capstan roller 79. Accordingly, the surface speed of the capstan roller 79 and the surface speed of the media sheet are substantially the same. The surface of the capstan roller 79 may be formed (e.g., by coating) to provide sufficient traction for multiple dye diffusion passes without marring imaged or unimaged film, transparency or other media. In one embodiment, the outer surface of the capstan roller 79 may be coated with a plasma substance to provide the necessary traction for dye diffusion printing while not marring scratchable film or transparencies.

Figure 9C:
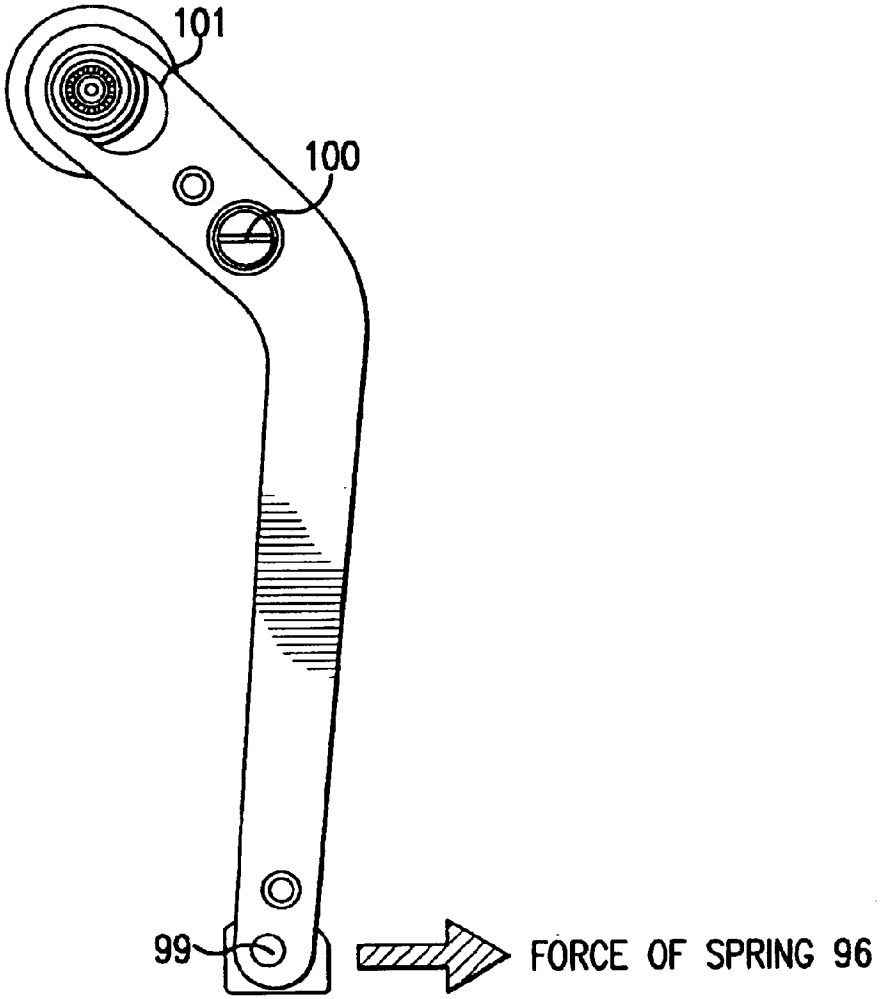
FIG. 9C shows an embodiment of a spring loaded pinch arm for securing a pinch roller against a fixed capstan roller.

FIG. 9C shows an enlarged view of the pinch arm 98 that forces the pinch roller 77 against the capstan roller 79. The pinch arm 98 includes a slot 101 for securing the shaft of the pinch roller 77. Hole 100 provides a pivot point while hole 99 receives a force from spring 96 (FIG. 9A). While FIG. 9A only shows one pinch arm 98 at one side of the pinch roller 77, it will be understood that a similar pinch arm 98, while not shown, exists at the opposite side of the pinch roller 77. A rod 89 fits in each of the holes 99 of the two pinch arms. The rod 89 may be moved in a direction opposite to the desired direction of movement of the pinch roller to rotate the pinch arms 98 about their respective pivot holes 100 to force the pinch roller 77 against the capstan roller 79.

Figure 9D:
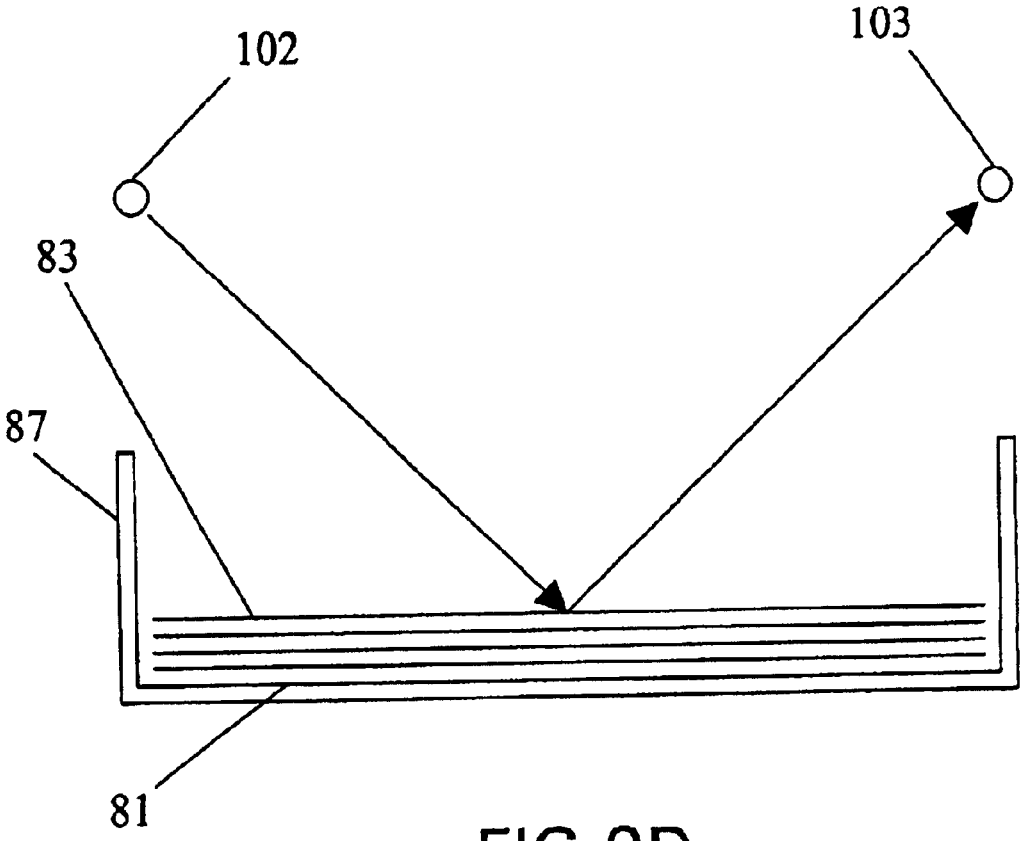
FIG. 9D shows an embodiment of media tray sensors for detecting the presence or absence of media in media trays.
Figure 9E:
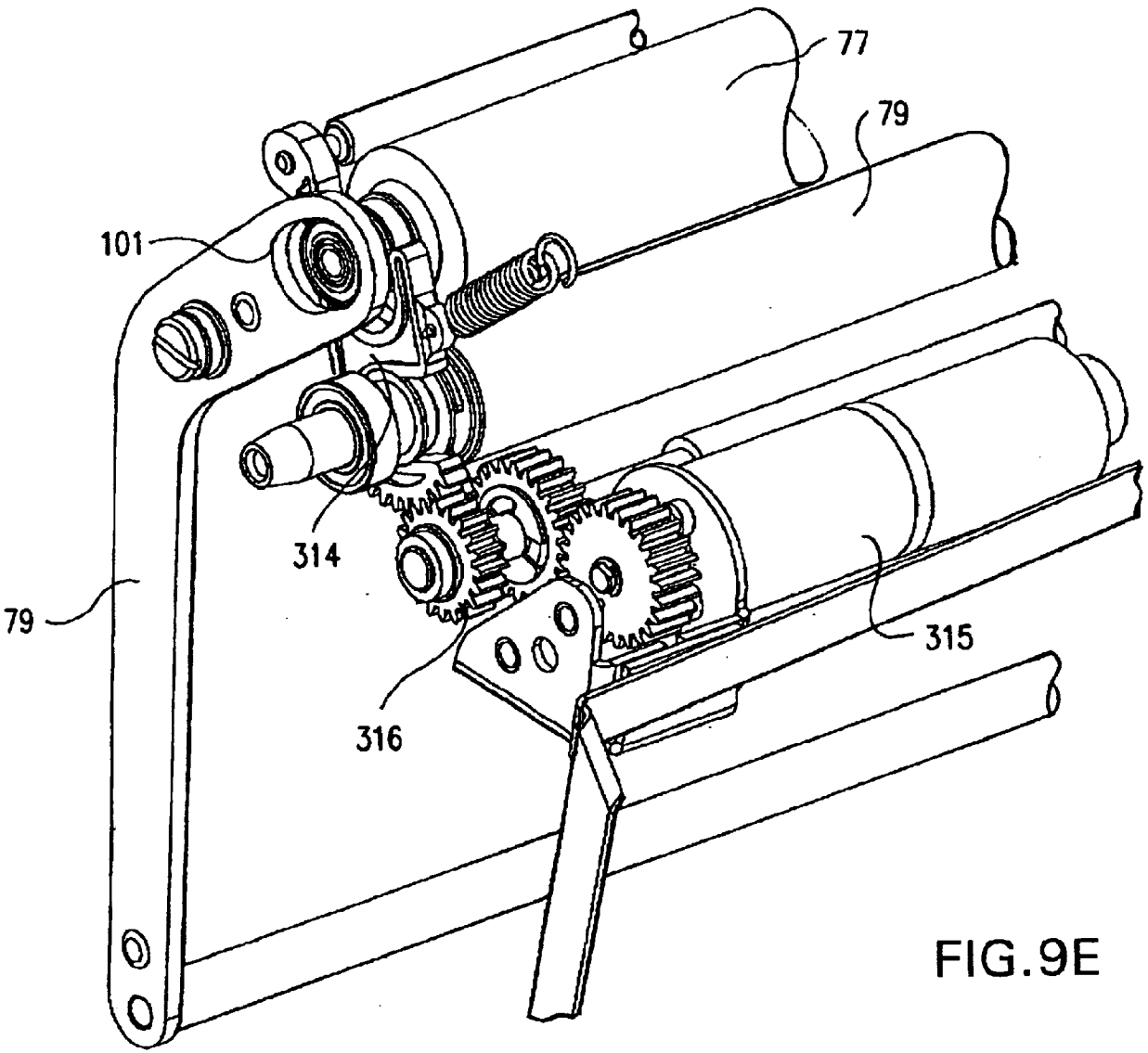
FIG. 9E shows an embodiment of a mechanism for moving the pinch roller around the fixed capstan roller.

As shown in FIG. 9E, two gear driven arms 314 position the pinch roller 77 radially with respect to the capstan roller 79. These arms are driven by a gear train 316. A DC servo motor 315 with a built in position encoder may supply the torque to drive the gear train 316. In embodiments of the invention, the gear train 316 may be driven by the same DC servo motor 30 that is used to rotate the picker tires 13 of the picker assemblies 12.

FIG. 9A shows an embodiment of the present invention in which sources 102 and sensors 103 are located on each side of the media tray cavities. A source 102 and sensor 103 pair on opposite sides of the media tray cavities is associated with each media tray 87. FIG. 9D illustrates how the sources 102 and sensors 103 may be used to detect whether a media tray 87 is empty. A source 102 transmits light to the top sheet 83 of a stack of media in a media tray 87. The corresponding sensor 103 receives light reflected from the top sheet 83. A bottom surface 81 of the media tray 87 does not reflect light from the transmitting source 102 to the receiving sensor 103. This can be accomplished by, among other things, providing a rough, deflected or non-reflective surface on the bottom 81 facing upwards. As long as there are media sheets in the media tray 87, the receiving sensor 103 may receive a reflection of the light transmitted by the transmitting source 102. When the receiving sensor 102 no longer receives a reflection, it may be determined that the media tray 87 is empty. Therefore, when the information gathered from the aforementioned optical system is used in conjunction with bar code scanning information received from the bar scan coder described in the aforementioned U.S. patent application Ser. No. 08/979,683 and below, the printer controller in the media printer can determine the type and size of media in each tray loaded to the printer, and whether any of these trays are empty. The optical system described is also advantageous because its components are not embedded in the media tray 87.

In embodiments in which optical components are embedded in the media tray 87, the media tray 87 may be inserted into the media tray cavity so as to engage an electrical connector so that the signal from the embedded component may be transmitted to the printer controller. In such embodiments in which opaque or translucent media are used, the source 102 may be located above the media stack and the sensor may be located in the bottom surface of the media tray (or vice versa). A significant increase in the amount of light received by the sensor may indicate that the tray is empty.

Furthermore, in embodiments of the invention, a sensor 103 may extend laterally downward and may be comprised of multiple optically-sensitive areas. In such embodiments, the location at which the light from the source 102 is received by the sensor 103 may indicate the height of the media stack. This information may be used by the printer controller to indicate to a user when the media stack should be replenished.

Moreover, in the embodiment of the present invention shown in FIG. 9D, the light from the source 102 may be relatively unfocused so that it is received by the sensor 103 regardless of the height of the media stack. For example, the source 102 may be a bulb or lamp. Alternatively, the source may be a focused or coherent source and may be moved so that the direction at which light is emitted may be changed until light reflected from the top sheet 83 is received by the sensor 103. In such embodiments, the direction at which the source 102 emits light may be used by the printer controller to determine the height of the media stack, so that the user may be warned when the media stack should be replenished.

FIG. 9A also shows holes 104 on opposite sides of output trays 113 (FIG. 22) which provide electric eyes across each output tray 113. The electric eyes detect when a corresponding output tray 113 is full.

Figure 10A:
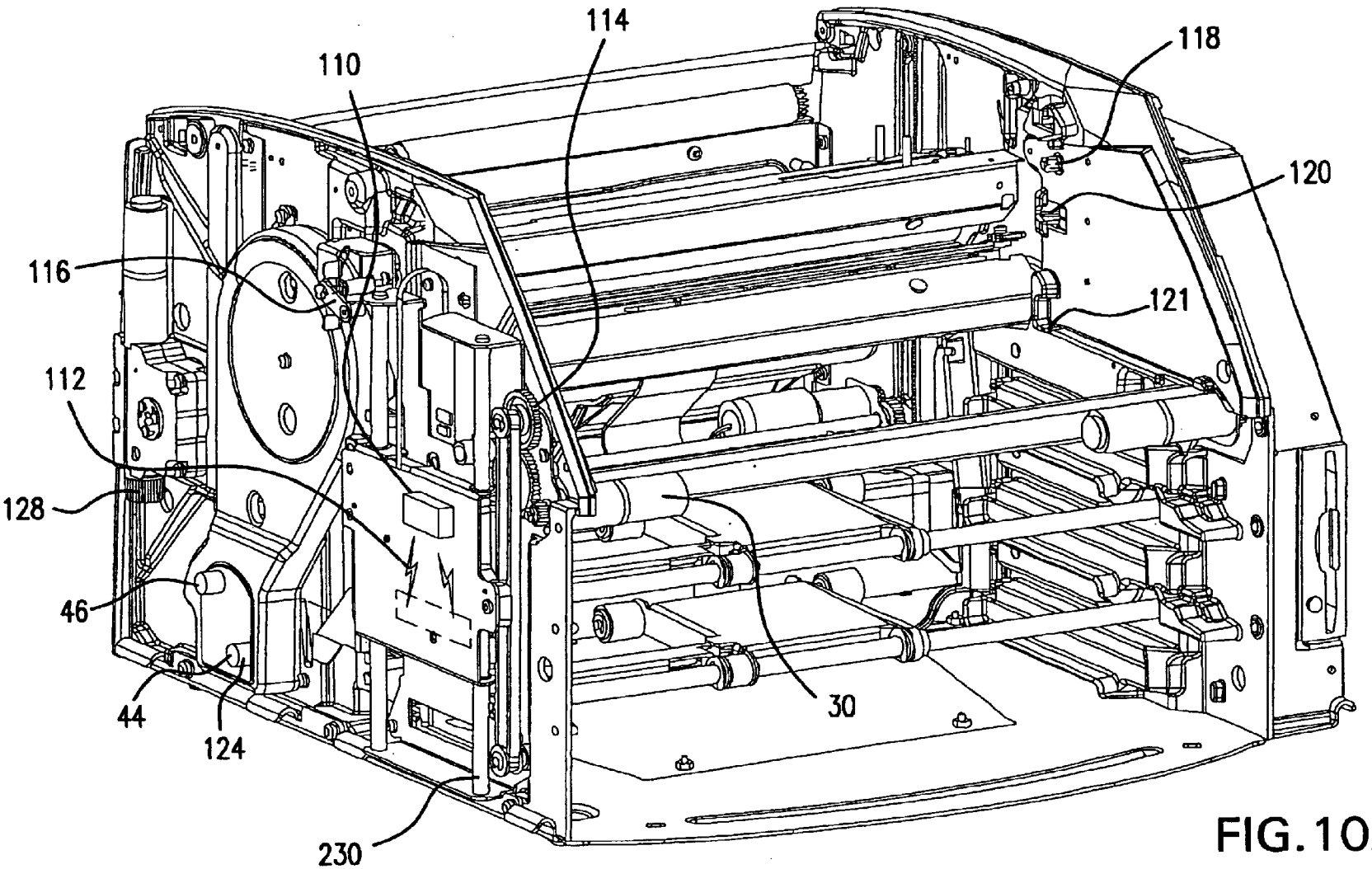
FIG. 10A illustrates a drive mechanism for moving a bar code scanner according to an embodiment.

FIG. 10A shows a perspective view of the multi-media printer with enclosure panels removed to illustrate the belt drive to the capstan and a bar code scanner for the media trays. The five-phase stepper motor 44 drives a compliant belt 126 through a belt tension idler 46. Knob 128 may provide a manual override for raising and lowering the printhead 151 (in FIG. 11C).

Bar code scanner 110 is raised and lowered by a drive mechanism 114. When a media tray is inserted into the printer, drive mechanism 114 moves bar code scanner 110 in position to read a bar code on the side of the inserted media tray. This bar code identifies the size and type of the media loaded therein. Mechanism 114 is driven by the DC servo motor 30 which is also used for lowering the picker tires 13 of the picker assemblies 12 (FIG. 4). A catch attached to the drive mechanism 114 at about the bar code scanner 110 provides an opposing force to the torsion springs 34 as the bar code scanner is positioned to read the bar code of associated media tray. This opposing force on the associated torsion spring 34 allows the torsion spring 36 to lower the picker tires 13 onto the top sheet of the media tray.

Mechanism 116 locks a top donor door (not shown). When the mechanism 114 raises the bar code scanner 110 to the top in contact with the mechanism 116, the mechanism 116 unlocks the donor door.

Figure 10B:
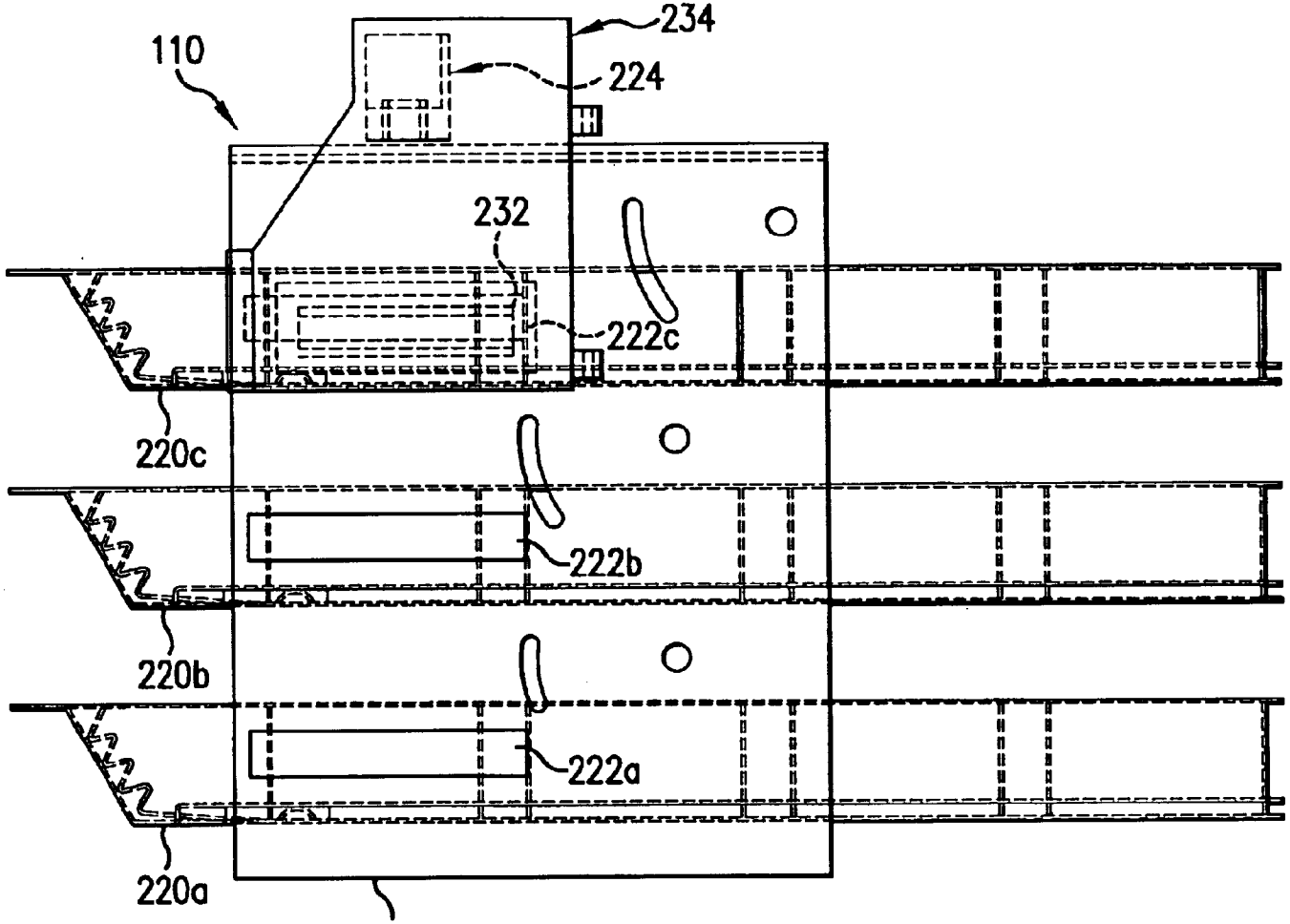
FIGS. 10B and 10C show front and side views, respectively, of an embodiment of the bar code scanner illustrated in FIG. 10A.
Figure 10C:
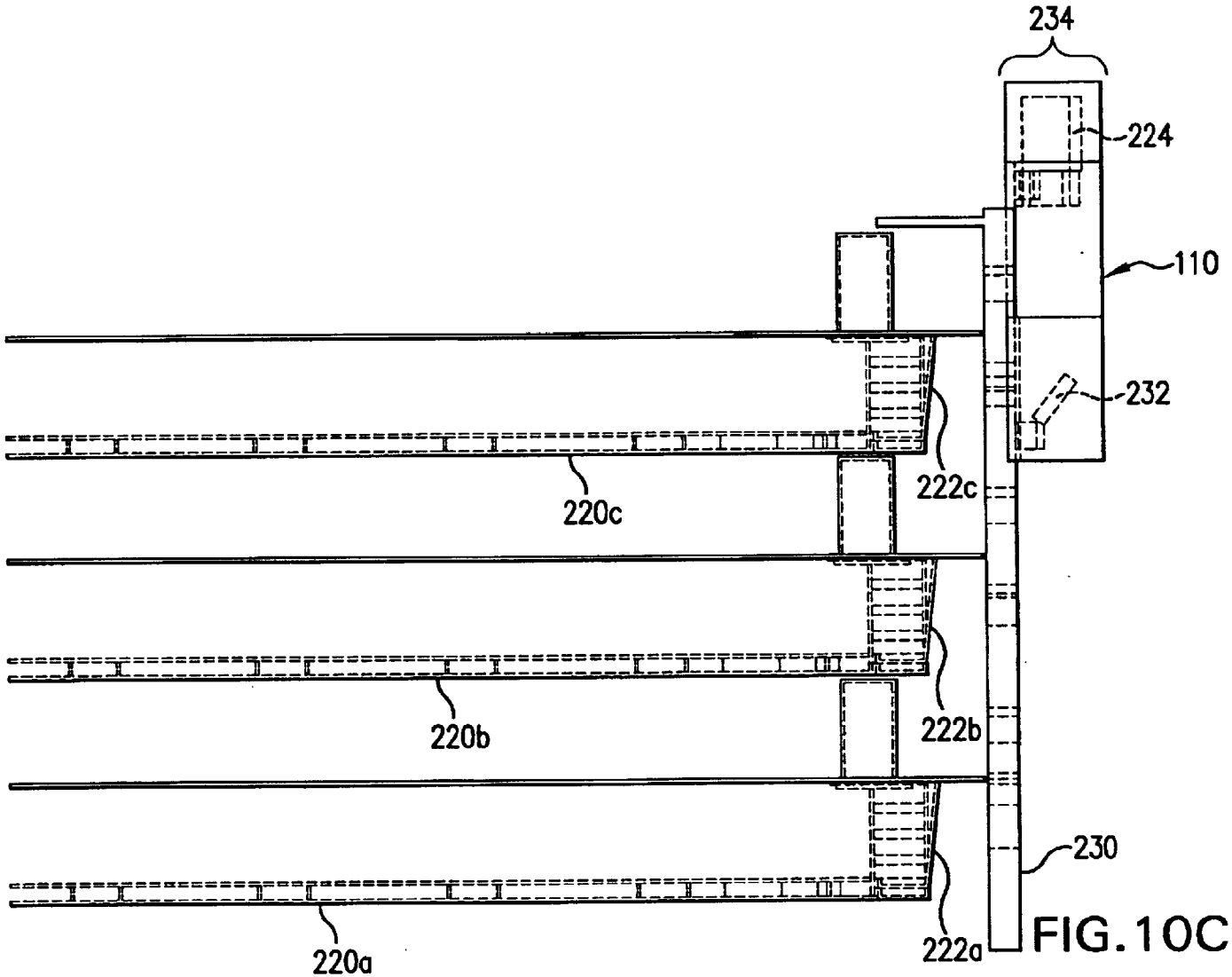

FIGS. 10B and 10C are directed to an embodiment of the bar code scanner 110 for identifying the contents of the individual media holders (e.g., media size, type and lot number). Media holders 220*a*, 220*b*, and 220*c*, each include a bar code label 222*a*, 222*b*, and 222*c* respectively. The bar code labels 222*a*, 222*b*, and 222*c* are preferably located on a side perpendicular to the front wall portion of the media holder on a portion which is inserted into the printer for use and represent at least 80 bits of information.

A vertical track 230 (FIG. 10A) positions a movable optical system included in an elevator housing 234 to position optical elements therein to selectively read from any of the individual bar code labels 222*a*, 222*b*, or 222*c*. FIG. 10C shows the assembly of the optical elements disposed within the elevator housing 234 which include a bar code scanner element 224 and a mirror 232. According to an embodiment, the drive mechanism 114 (FIG. 10A) can selectively position the elevator housing 234 to receive an optical signature from any of the bar code labels 222*a*, 222*b*, or 222*c*.

The bar code scanner element 224 may be a commercially-available LM 500 plus scanner. Alternatively, other bar code scanning systems may be used. The elevator housing 234 may also include a small infrared sensor (not shown) for detecting an optical flag (not shown) on the side of the media trays 220*a*, 220*b* and 220*c*. As the elevator housing 234 travels vertically, detections from the infrared sensor may initiate feed-back signals back to a circuit (not shown) for controlling the motor 30 and drive mechanism 114 which drives the elevator housing 234 to accurately position the optical elements to read the bar code labels. Alternatively, position can be determined by a built in optical position encoder on the DC servo motor 30. In other embodiments of the invention, the position of the elevator housing may be determined by changes in readings taken by the bar code scanner element 224. In such embodiments, the bar code labels 222*a*–222*c* may have a readable mark on a leading edge (or some other known location thereon).

Figure 24:
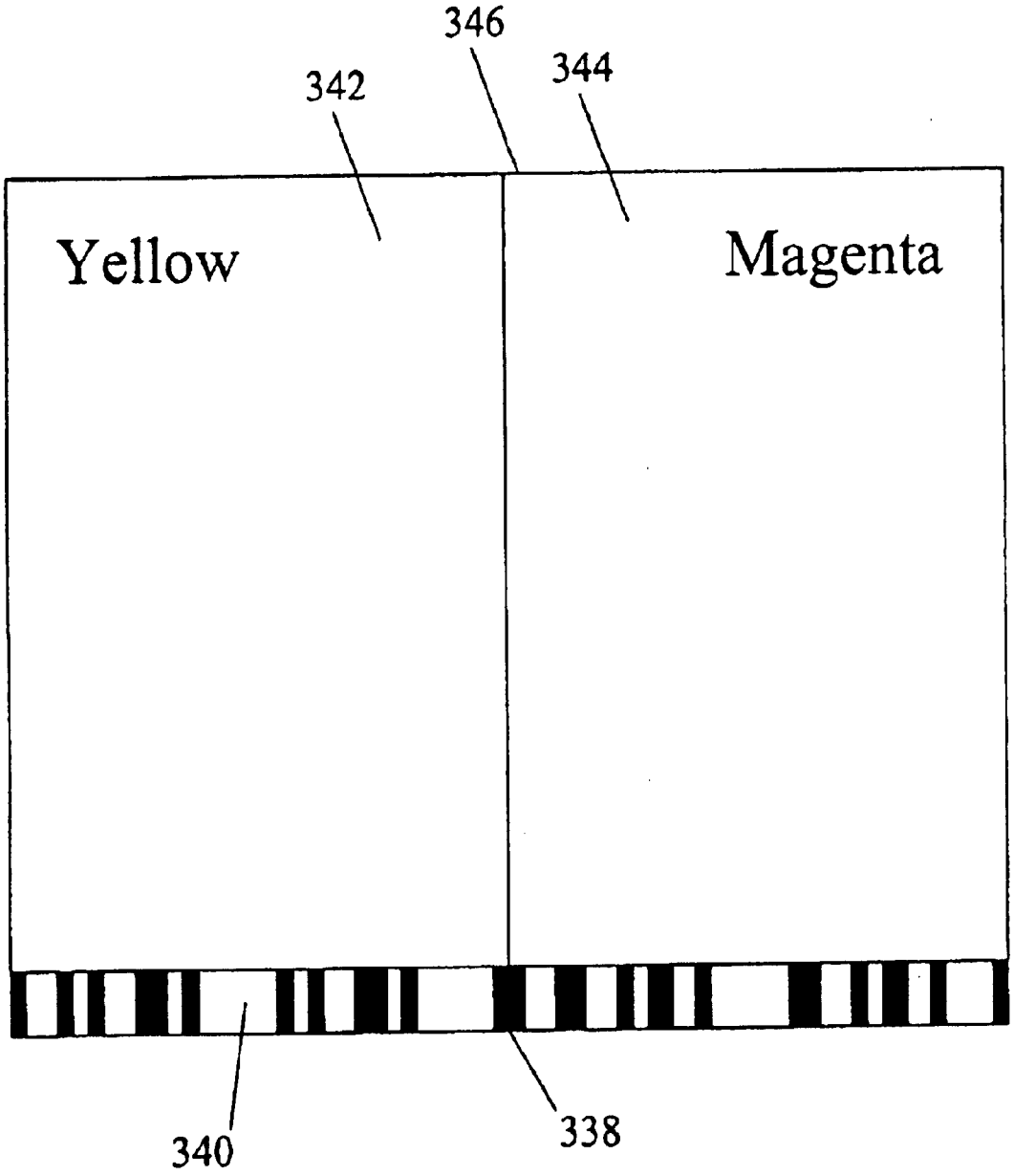
FIG. 24 shows an embodiment of a donor ribbon having a side bar code according to an embodiment.

The bar code labels 222*a*, 222*b*, and 222*c*, may be used to support various automation features of the printer. For example, the media trays may be for a single use only. Thus, the manufacturer may provide the customer with sealed media trays as illustrated in FIG. 24 of the aforementioned U.S. patent application Ser. No. 08/979,683. Each of the media trays would then have a bar code label with a unique code. When the media tray is then inserted into the printer for a first use, the printer positions the optical elements within the elevator housing 234 to read the bar code from the bar code label of the newly inserted media tray. The printer controller maintains a record of all media trays which have been inserted into the printer. Thus, if the bar code of an inserted media tray, as read from the bar code scanner 224, corresponds with a prestored bar code signature of a previously inserted media tray, the printer will not dispense media sheets from the newly inserted media tray and provide an error signal to the user.

Additionally, the bar code may include information which identifies the type of media (e.g., transmissive or reflective) stored therein and the size. Thus, whenever a media tray is inserted into the printer, the printer may position the optical elements within the elevator housing 234 to read the bar code of the media tray to determine the size and type of media sheets therein. In this manner, the printer can determine which pick roller assemblies 12 to lower for dispensing the desired size and type of media sheet to the input path. Based upon information relating to size, type and lot information of the media sheets in an associated input tray from a bar code label 222*a*, 222*b* or 222*c*, the printer controller can control the picker assemblies 12 to optimize feeding of the media sheets into the input path. For example, the printer controller may apply an optimum speed and duration of application of the picker tires 13 based upon size and media type as indicated in the bar code labels 222*a*–222*c*. Alternatively, the bar code labels 222*a*–222*c* may have information directly specifying the picker speed and duration for applying to media sheets in the associated media tray.

By having a single optical system disposed within a movable elevator housing 234, the bar code labels from multiple trays can be read with only a single optical system. This reduces manufacturing costs by only requiring a single optical system rather than multiple optical systems.

Conventional apparatuses for dispensing media may have a system for reading an optical signature on a media tray as it is inserted. In these systems, the motion of the media tray as it is inserted moves the optical signature past the optical system to effect a scan of the optical signature. Thus, if the optical system cannot read (or misreads) the optical signature when the media tray is inserted, the media tray must typically be manually removed and reinserted so that the optical signature can be re-scanned over the optical system. Additionally, if the optical signature is scratched or distorted where the optical system is directed, the optical system cannot read the optical signature even if other undistorted portions of the optical signature have all of the desired information.

In the embodiment of FIGS. 10B and 10C, on the other hand, the optical elements within the elevator housing 234 may read any of the bar code labels 222*a*, 222*b* and 222*c* while the corresponding media holders 220*a*, 220*b* and 220*c* are stationary. Thus, if the optical elements do not read (or misread) any of the bar code labels 222*a*, 222*b* or 222*c* on a first scan, the optical elements can re-scan the bar code label without moving the media holder 220*a*, 220*b* or 220*c*. According to an embodiment, the optical elements within the optical housing 234 periodically scan each of the bar code labels 222 of each of the inserted media holders 220. Additionally, if one portion of a bar code label 222 is scratched or distorted, the bar code scanner 224 can be vertically adjusted to read from an undistorted and unscratched portion of the bar code label 222 to extract the desired information.

Figure 10D:
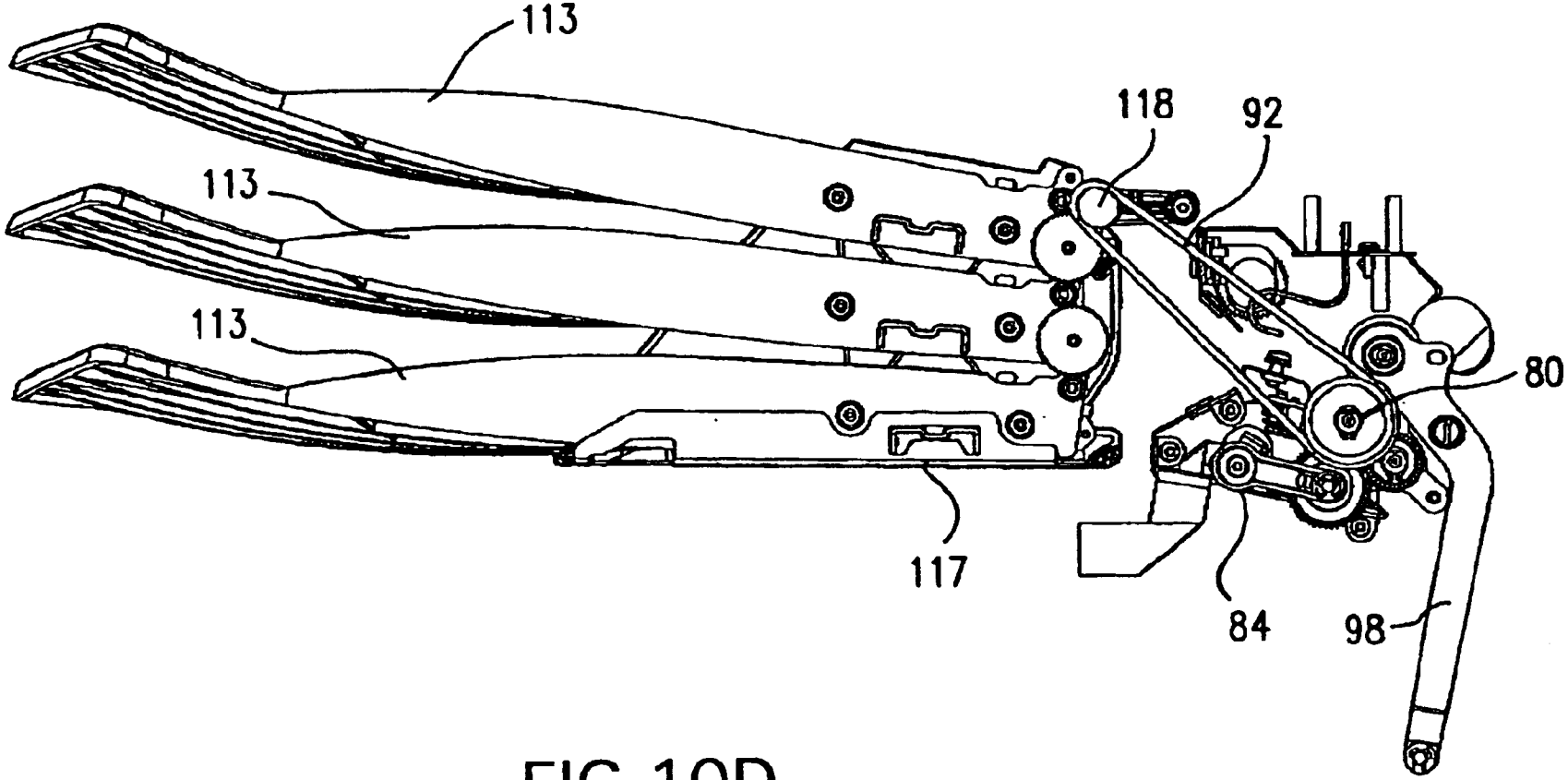
FIGS. 10D and 10E show side and perspective views, respectively, of an embodiment of a removable output tray with kicker assemblies.
Figure 10E:
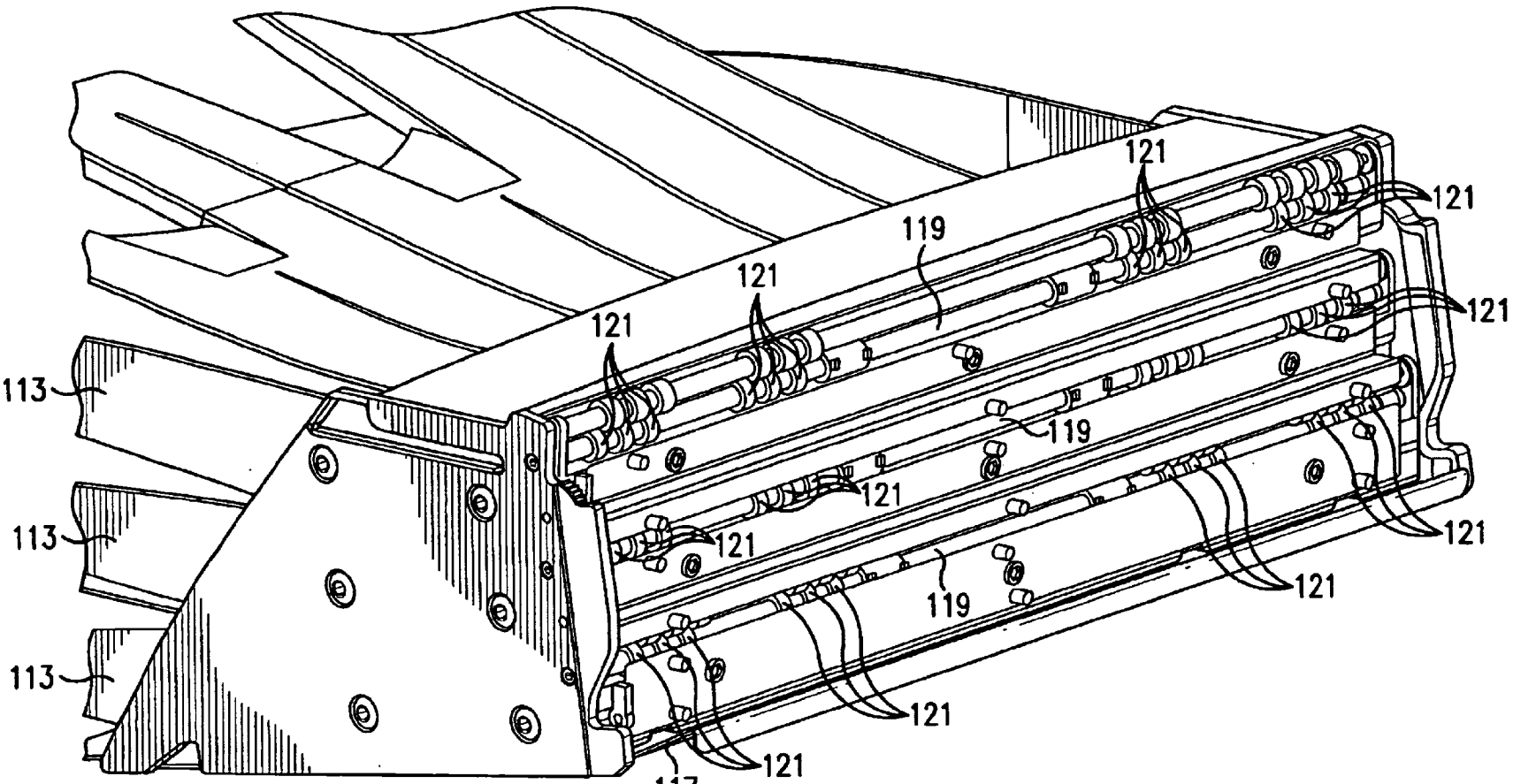

FIG. 10A shows a notch 122 adapted to receive an output tray assembly which includes three output trays 113 (FIG. 22) and a hide track 117 (FIGS. 10D and 10E). A sensor 120 detects whether or not the output tray assembly is installed.

The hide track 117 receives media sheets during intermediate passes of dye diffusion processing. A compliant belt 92 may transfer torque from the capstan shaft 80 to a kicker drive 90 (FIG. 9A) to drives a gear drive 118. The compliant belt 92 may also dampen vibrations from the output kicker tires 121 (FIG. 10E). The gear drive 118 drives the kicker assemblies on the output tray assembly. FIG. 10D shows an expanded view of the output trays 113 in conjunction with the capstan drive 80. Here, the belt 92 transfers torque from the capstan drive 80 to provide torque to the gear drive 118. The gear drive 118 then provides torque to each of the kicker assemblies associated with each of the output trays 113. FIG. 10E shows a perspective view illustrating how the kicker shafts 119 may all be driven by the torque applied to the gear drive 118 from the capstan drive 80. Hide track 117 may be sealed from the output trays 113 and the exterior of the media printer to reduce the incidence of dust at the print station, which can cause artifacts in the image, in subsequent passes of the dye diffusion process.

Figure 11A:
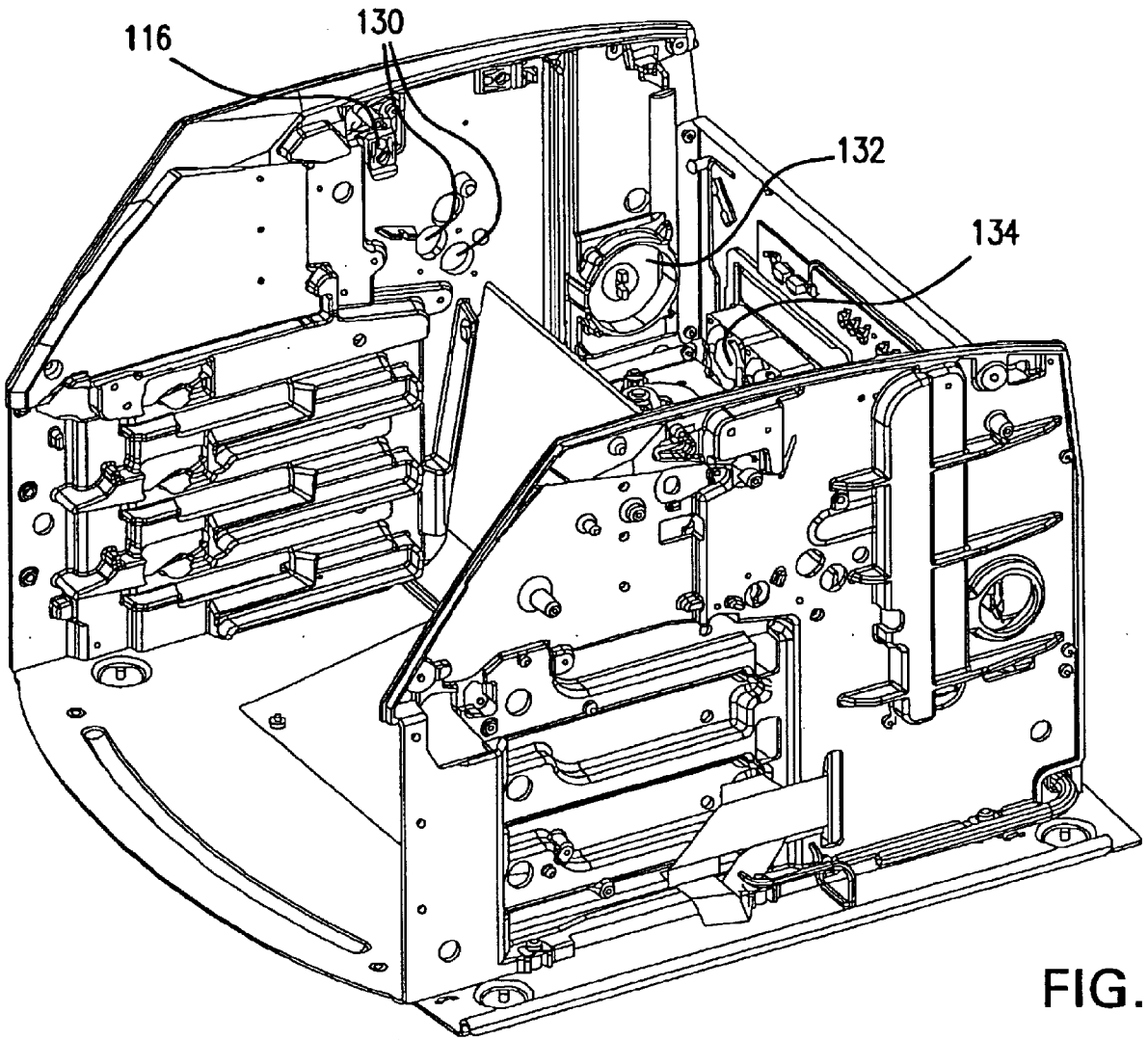
FIG. 11A illustrates holes in a chassis wall of the media printer for securing the drive shafts of the platen and capstan rollers according to an embodiment.
Figure 11B:
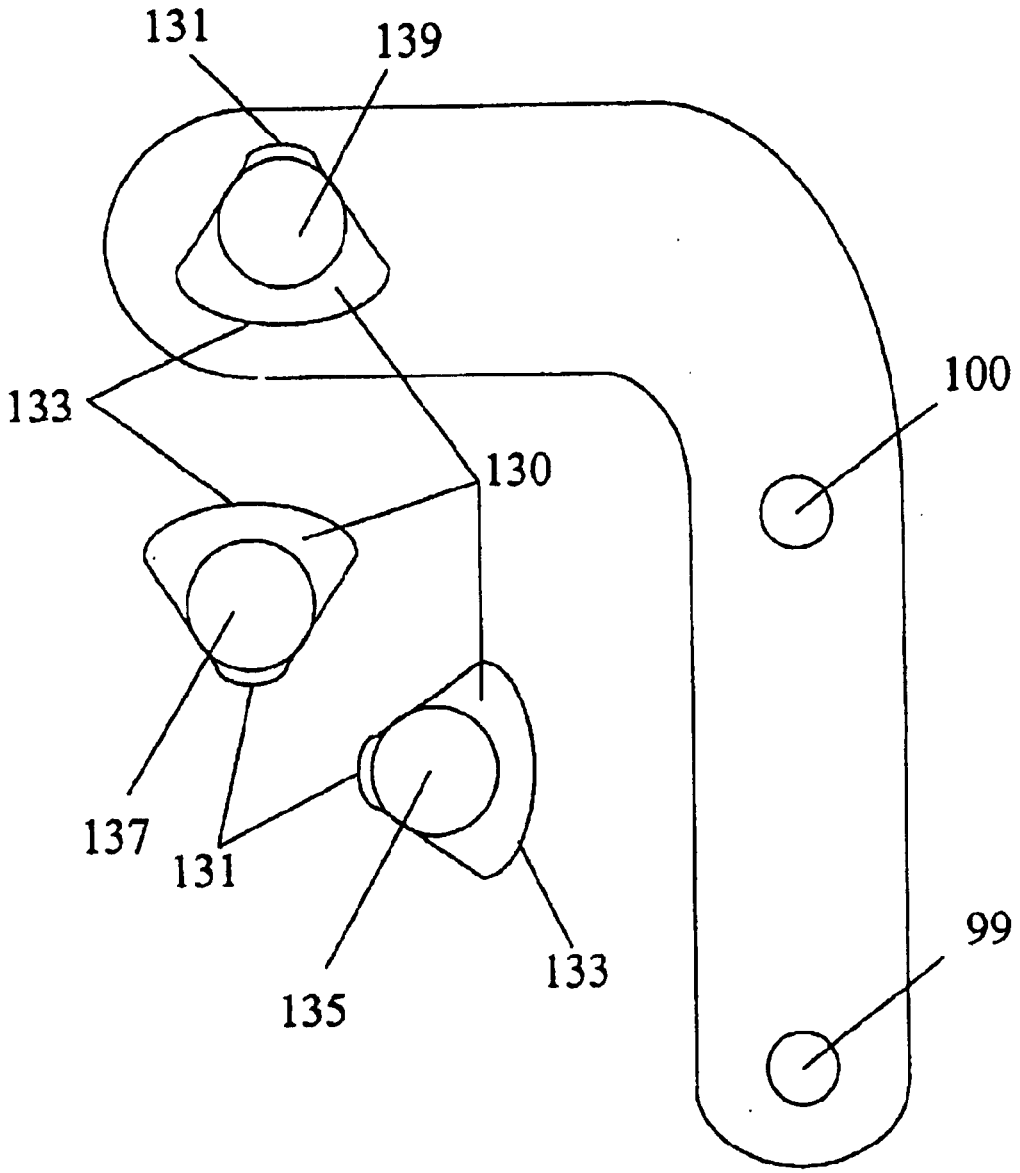
FIG. 11B illustrates the orientation of the platen, and capstan as being secured in the holes in a chassis wall of the embodiment of FIG. 11A.
Figure 11C:
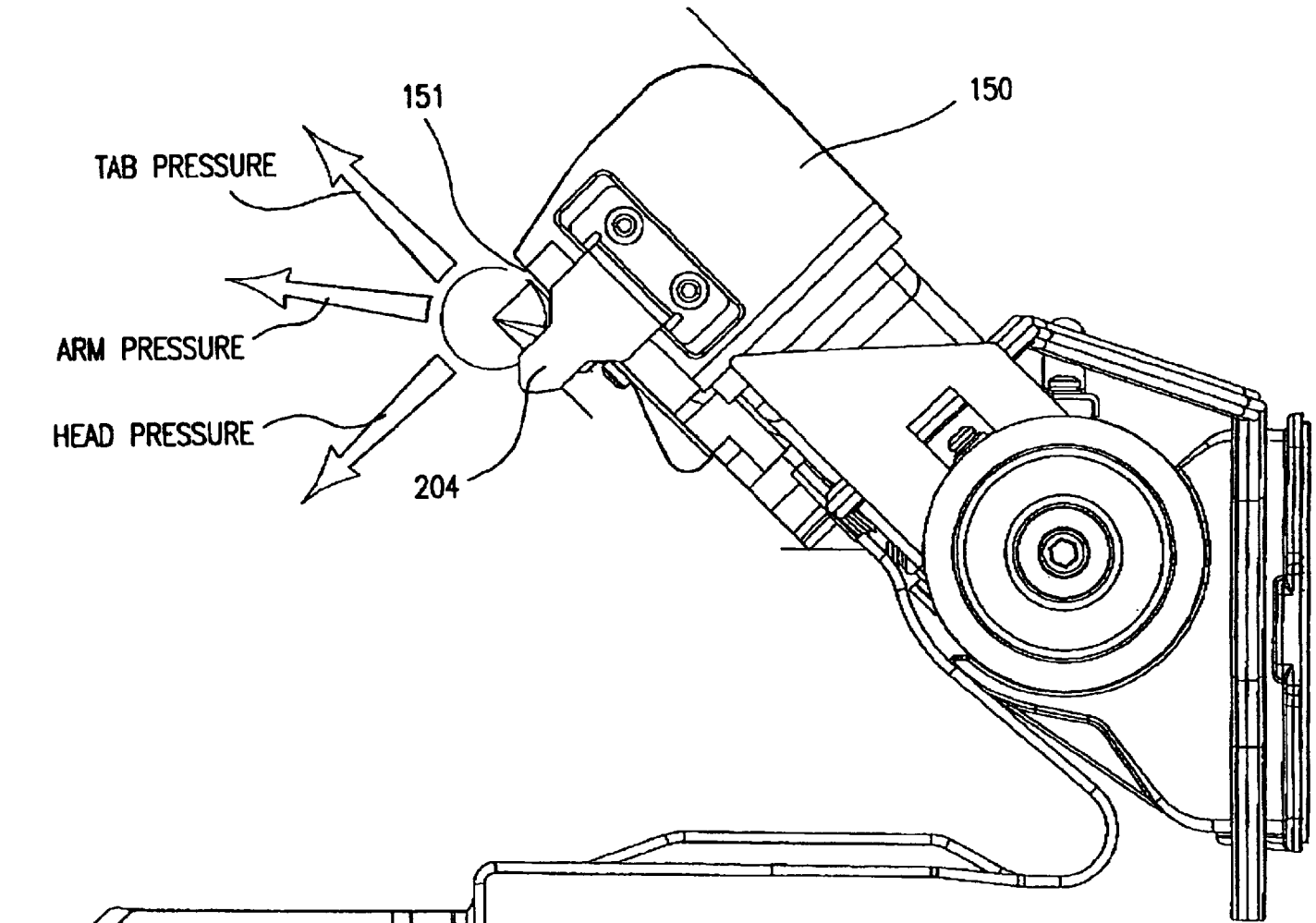
FIG. 11C illustrates forces acting on the platen and capstan roller shafts for securing the position of the shafts against the "V" blocks of the holes of the chassis wall illustrated in FIGS. 11A and 11B.

FIG. 11A shows perspective view of the multi-media printer with the media trays 87, picker assemblies 12, bar code scanner apparatus 110, etc. removed to expose the assembly for moving the printhead 151 (FIG. 11C). As discussed above, a mechanism 116 may release the donor doors when the bar code scanner apparatus 110 is raised to the top of the media printer. Drive 132 may apply a torque to the torque arm (not shown) attached to the printhead 151 in response to the worm gear 56 driven by the motor 58 (FIG. 6). Fans 134 may be attached to vents 62 and 63 (FIG. 7) to circulate air through the printhead heat sink (not shown). Holes 130 may secure the shafts for the platen, capstan, and pinch rollers.

FIG. 11B shows an enlarged view of the holes 130 for securing the platen shaft 135, capstan shaft 137 and pinch roller shaft 139. The hole 130 for securing the platen shaft 135 and the capstan shaft 137 are formed in a chassis wall 10. The hole 130 for securing the pinch roller shaft 139 (which may be the same as slot 101 in FIG. 9E) is formed in the pinch arm 98. Each of the holes 130 includes a rounded portion 133 and a "V" block section 131. The rounded portions 133 may be adapted to be packed with bearings and the V block sections 131 may secure the respective shafts 135, 137 and 139 in place in response to an opposing force. For example, when the printhead 151 is engaged with the platen, the printhead 151 may force the platen shaft 135 against the V block section 131 to prevent movement of the platen shaft 135 in any direction. Similarly, the pinch roller 77 and capstan roller 79 may apply opposing forces to one another (FIG. 9B), causing the pinch shaft 139 and capstan shaft 137 to be pushed into their respective V blocks portions 131. This essentially prevents movement of the capstan shafts 137 and pinch shaft 139. The pinch and capstan rollers may not move relative to one another. Nor will the platen move relative to the printhead 151 (in FIG. 11C).

FIG. 11C shows a printhead assembly including a printhead 151 and a heat sink 150 in a print position. The arrows extending from the printhead 151 illustrate the forces acting upon the platen shaft 135, the capstan shaft 137 and pinch shaft 139 which maintains these members in position against the V block portions 131 of their respective holes 130. The printhead assembly may also include a printhead alignment tab 204 that serves to position the printhead 151 with respect to the media sheet and the ends of the platen roller 76. The position of the printhead 151 may be changed from a print position, in which the printhead 151 and the platen roller 76 may sandwich the media sheet, by moving the torsion arm 170.

Figure 12:
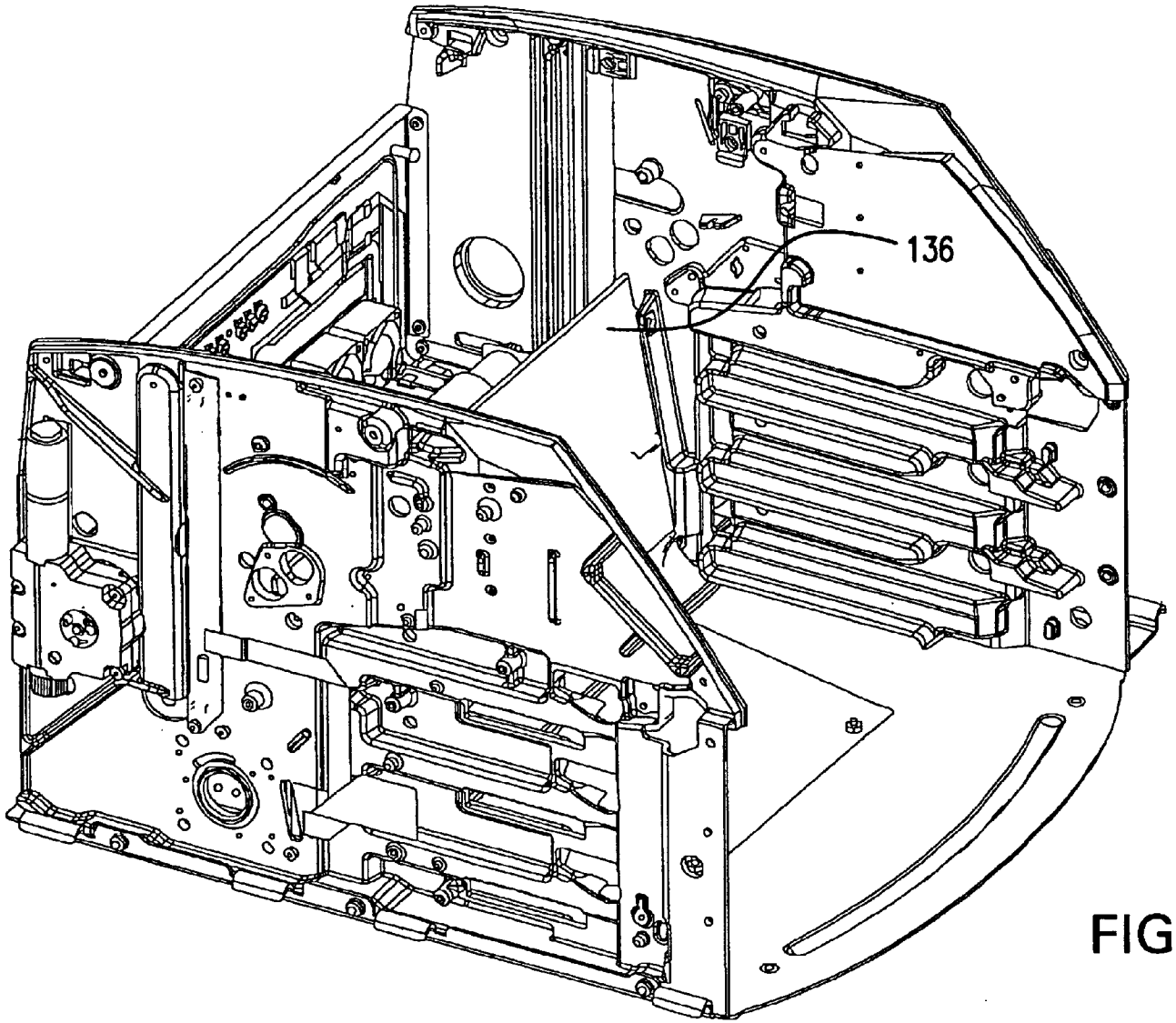
FIG. 12 shows a view of the multi-media printer exposing a media wall as part of an input path for receiving media sheets dispensed from media trays.

FIG. 12 shows a media wall 136, which may be placed to guide media dispensed from the input trays directly to the print station (not shown), without the use of any intermediate rollers.

Figure 13:
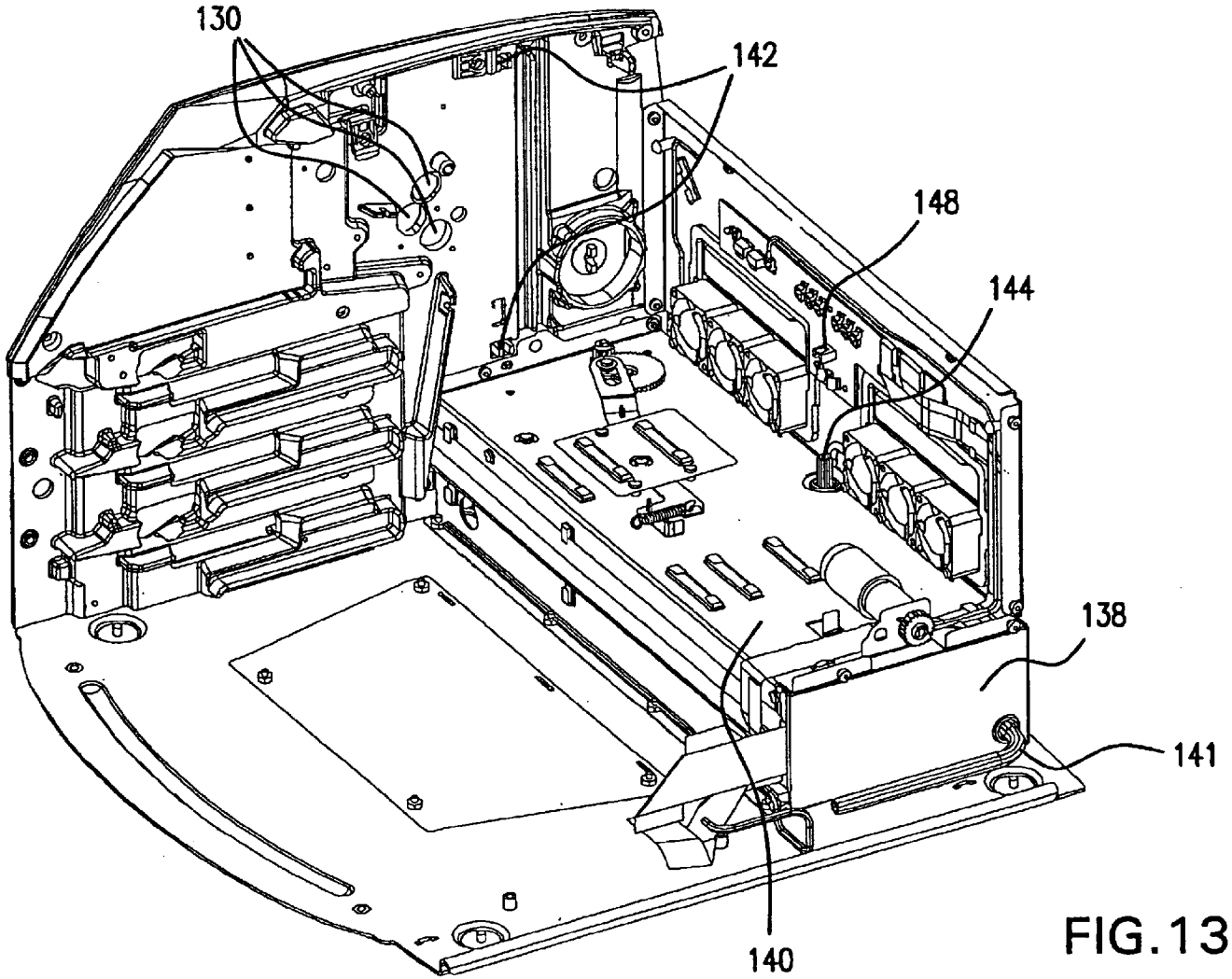
FIG. 13 shows a view of the multi-media printer illustrating the position of the power supply with respect to the printhead according to an embodiment.
Figure 14:
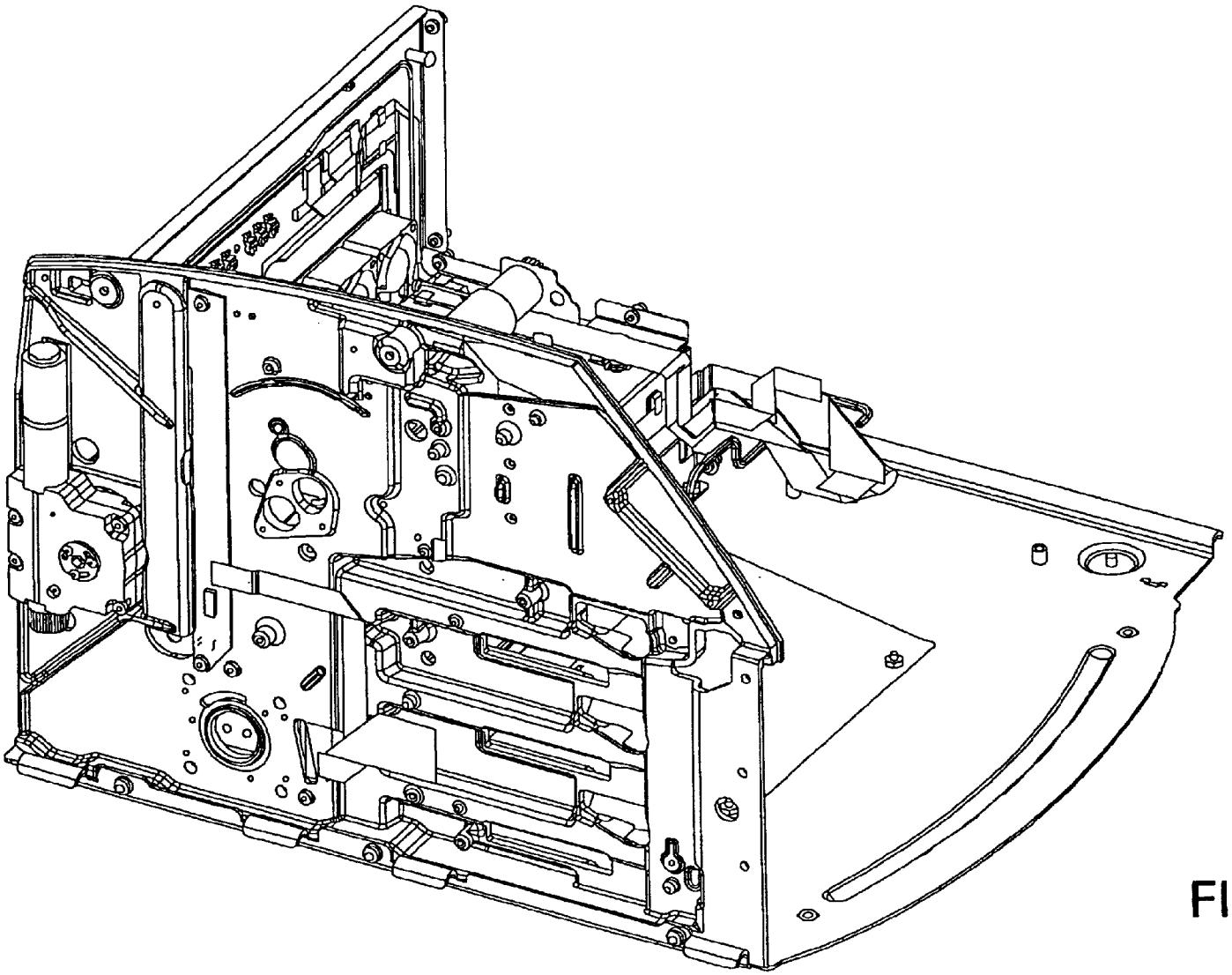
FIG. 14 shows a side view of the chassis of a multi-media printer according to an embodiment.
Figure 15A:
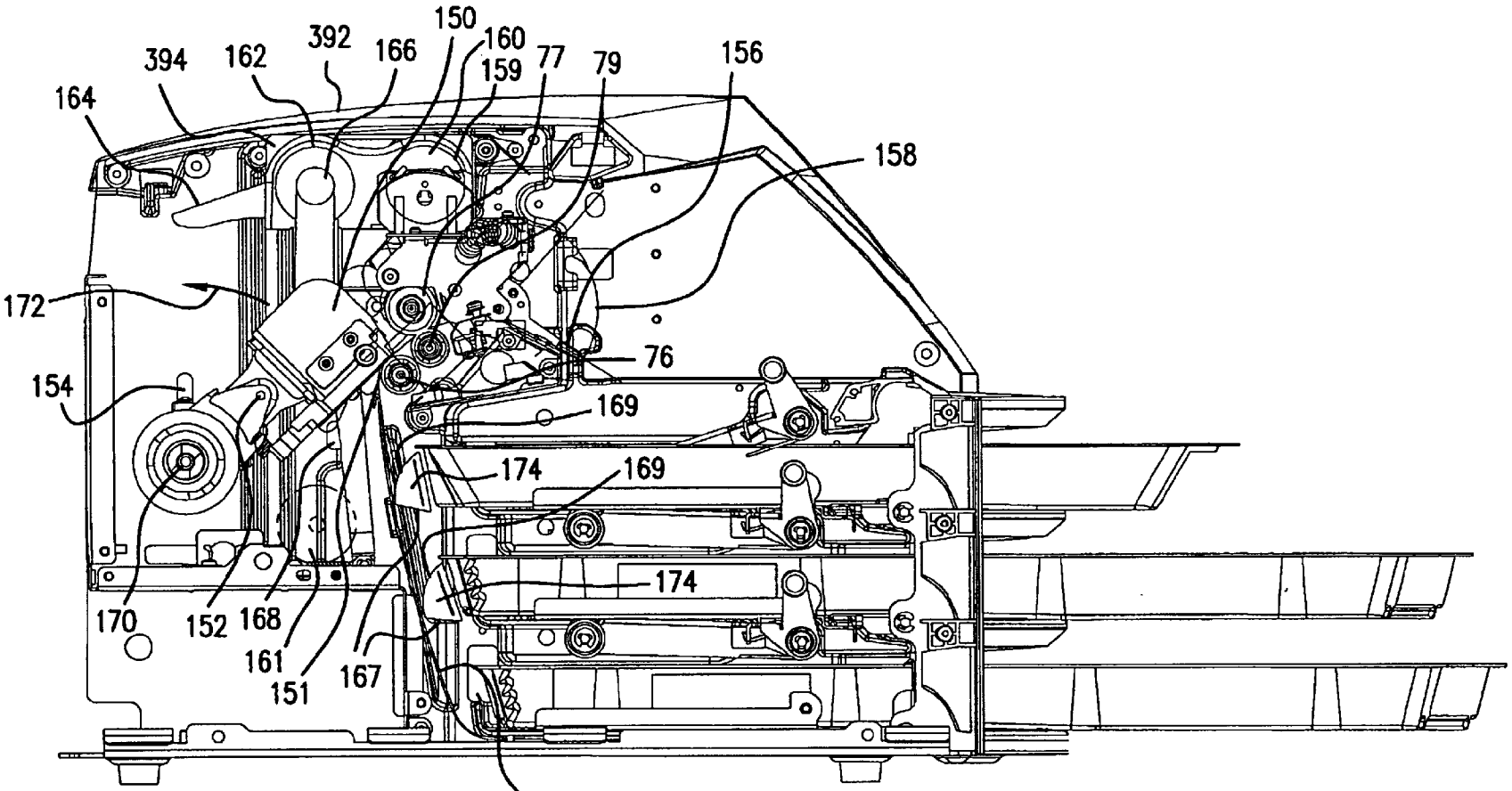
FIG. 15A illustrates an embodiment of the movement of the printhead and donor carriage when transitioning between direct thermal and dye diffusion according to an embodiment of the multi-media printer.

FIG. 13 shows a perspective view of the interior of the multi-media printer which illustrates the location of a power supply 138 with respect to the printhead which is to receive power from the power supply 138. The power supply 138 provides DC power to the printer controller through cable 141 and provides DC power to the printhead through cable 144. The placement of the power supply 138 with respect to the printhead (as shown in FIG. 15A) reduces the inherent parasitic resistance associated with the power cable 144 and that of thermal elements of the printhead, resulting in very low power loss. However, in alternative embodiments of the invention, the power supply 138 may be located elsewhere based on space/interference, heat or other considerations.

Sensors 142 position the donor spool of the donor carriage as it travels vertically with the timing belt 42 (FIG. 6). A sensor 148 detects when the printhead reaches a home position.

FIG. 15A shows a cross-sectional view of the multi-media printer including a media input path to a print station including a printhead 151 and platen roller 76. Printhead 151 may be coupled to a printhead heat sink 150, which may be rotatable about the torsion arm 170 between a print position (as shown) and a retracted position in which the printhead assembly is rotated upwards in the direction 172 until a printhead home position sensor 154 is tripped. A ball joint 152 enables the printhead 151 and heat sink 150 to float on the platen surface to substantially distribute the load of the thermal elements of the printhead along the platen roller 76.

A donor spool 161 is moveable in the vertical direction and extends a donor ribbon between the printhead 151 and the platen roller 76 (or a media sheet in contact with the platen roller 76) when performing dye diffusion imaging. A take-up spool 160 remains stationary. The donor spool 161 is snapped into a position 162 while direct thermal imaging is performed. When transitioning to dye diffusion printing, the torsion arm 170 retracts the printhead assembly in the direction 172, and the timing belt 42 releases the donor spool 161 from the snapped position 162 and lowers the donor spool 161 to extend the donor ribbon across the platen roller 76. The torsion arm 170 then returns the printhead assembly to the printing position with the printhead 151 against the extended donor ribbon, media sheet and platen roller 76. When the media printer transitions from performing imaging using the dye diffusion process to the direct thermal imaging process, the printhead assembly moves in the direction 172 to the retracted position with the heat sink 150 meeting the stop 164. The timing belt 42 then lifts the donor spool 161 while rotating the take up spool 162 to remove the donor ribbon from the print station, moving the donor spool 161 into the snapped position 162. The printhead assembly then returns to the print position with the printhead 151 meeting the platen roller 76. In alternative embodiments of the invention, the donor spool 161 may remain fixed in position and the take-up spool 160 may be moved from a first position to a second position so as to place the donor ribbon between the printhead 151 and a media sheet and the platen 76.

Media sheets fed through the input path to the print station meet the capstan and pinch roller combination 77 and 79. The capstan roller 79 rotates to translate the media sheets from the print station through an output path. An output diverter 156 receives media sheets from the output path and diverts these media sheets to one of the output trays 113 (if there is no further processing to be done on the image) or to the hide track 117 if the media sheet is in an intermediate stage of a dye diffusion printing process (FIG. 4 D). The output diverter 156 rotates about the arch 158 into position for placing a imaged media sheet into a pre-selected output tray 113 or a media sheet during an intermediate dye diffusion color pass into the hide track 117 (FIGS. 10D and 10E).

Each of the media trays may dispense media sheets to the print station formed by the platen roller 76 and printhead 151 through a single input path against the media wall 136. In embodiments of the invention, there may be no intermediate rollers used in the transfer of media sheets from the media trays to the print station as media sheets are translated along the surface 136 by the picker assemblies 12. Diverters 174 may include a lower surface 167 and an upper surface 169 for guiding media sheets from the media trays against the media wall 136 and preventing media sheets from reentering the media trays after being dispensed through the print station. By not having a separate motor for driving each of the picker assemblies 12, the lowest media tray may be placed substantially near the print station to eliminate the need for using an intermediate roller. As media sheets are being dispensed from either of the two lowest media trays, the lower surface 167 and upper surface 169 may guide the leading edge of the media sheet through the input path against the media wall 136.

While dye diffusion printing is performed, media sheets may be translated back and forth through the print station such that the trailing edge of the media sheet at times travels backwards towards the media trays along the media wall 136 between intermediate color passes. The surfaces 169 of the diverters 174 may prevent the trailing edge of the media sheets from reentering either of the two lower media trays when translated backwards during these transitions between intermediate color passes.

Figure 16:
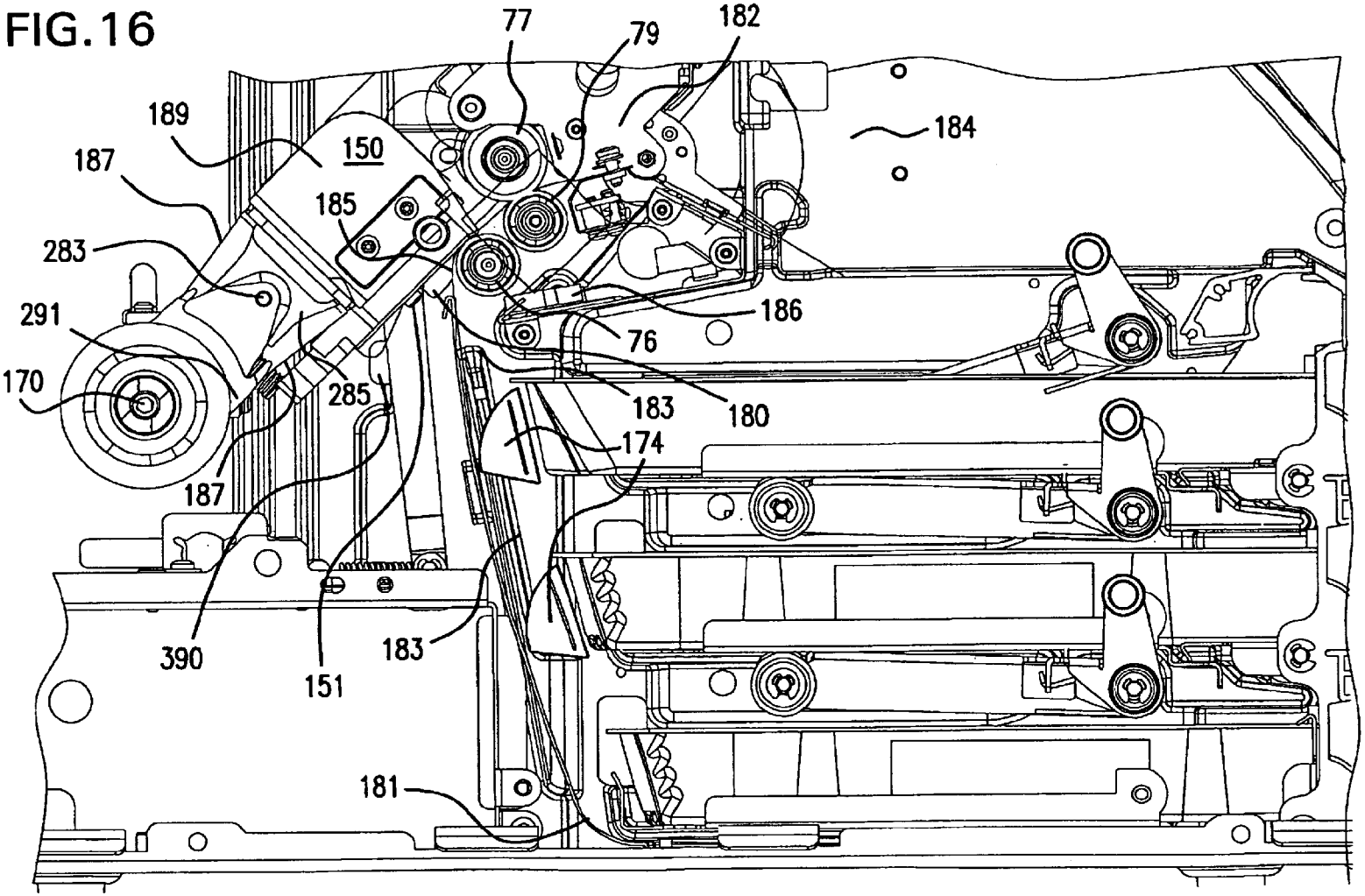
FIG. 16 shows a cross-sectional view of the multi-media printer illustrating an input path for transferring media sheets from media trays to a print station according to an embodiment.

FIG. 16 shows a view of the print station including the printhead 151 and platen roller 76. A printhead shield 180 may protect bond wires as well as some integrated circuits that are on a printed circuit board (not shown) of the printhead assembly. The printhead shield 180 may also serve as a mechanism for feeding media as it approaches the print station. A leading edge sensor 186 detects a leading edge of the media sheet as it is translated between the print station and the pinch and capstan roller combinations 77 and 79.

The printhead assembly may include an internal portion 285 with a ball joint 152 (shown as 283 in FIG. 16). The ball joint 152 may allow the printhead 151 and heat sink 150 to rotate in one dimension. The internal portion 285 may be enclosed within a ventilation channel formed by sealing member 187. The sealing member 187 may be coupled to the printhead heat sink 150 by a flexible seal 189 that allows movement of the printhead heat sink 150 with respect to the internal portion 285. This may allow further freedom of the thermal elements of the printhead 151 to uniformly distribute the load of the printhead 151 against the platen roller 76. Alternatively, a flexible sealed 291 may be provided at the base of the internal portion 285 to allow similar movement.

Figure 17A:
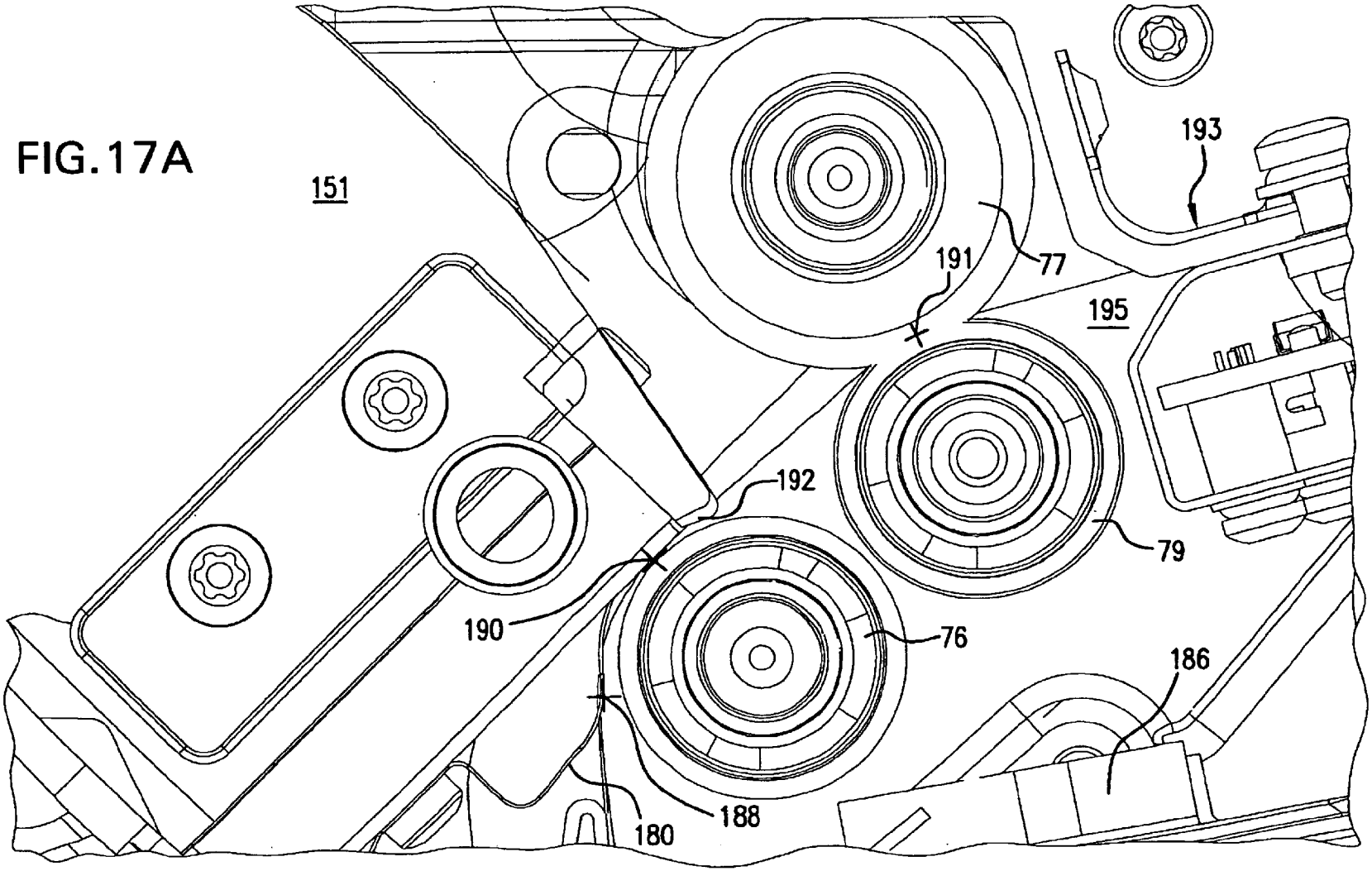
FIG. 17A shows an enlarged view of the print station of FIG. 16 with an anti-vibration surface according to an embodiment.

FIG. 17A shows an enlarged portion of the print station, which may include the platen roller 76 and the printhead 151. In addition to protecting bond wires and integrated circuits of the printhead 151, the printhead shield 180 also diverts the media through the input path in a manner that minimizes vibrations causing artifacts. The print station may include an area of inflexion 188, which is proximate the platen roller 76. This area of inflexion may dampen the trailing edge of the media sheet as it is dispensed through the print station between the platen rollers 76 and the printhead 151. Accordingly, vibrations caused by feeding the trailing edge through the print stations are reduced to result in fewer artifacts in the image.

Regarding the path of the media from the platen roller 76 to the capstan and pinch roller combination 77 and 79, the media may exit the print station from point 190, the point where the printer applies force to the platen roller 76, and travels from a point of substantial tangency with the platen roller 76 to point 191 between the capstan and pinch rollers 77. This reduces the incidences of media curling when, for example, performing direct thermal imaging on film using a smaller diameter platen roller 76 yields suitable imaging results.

Figure 17B:
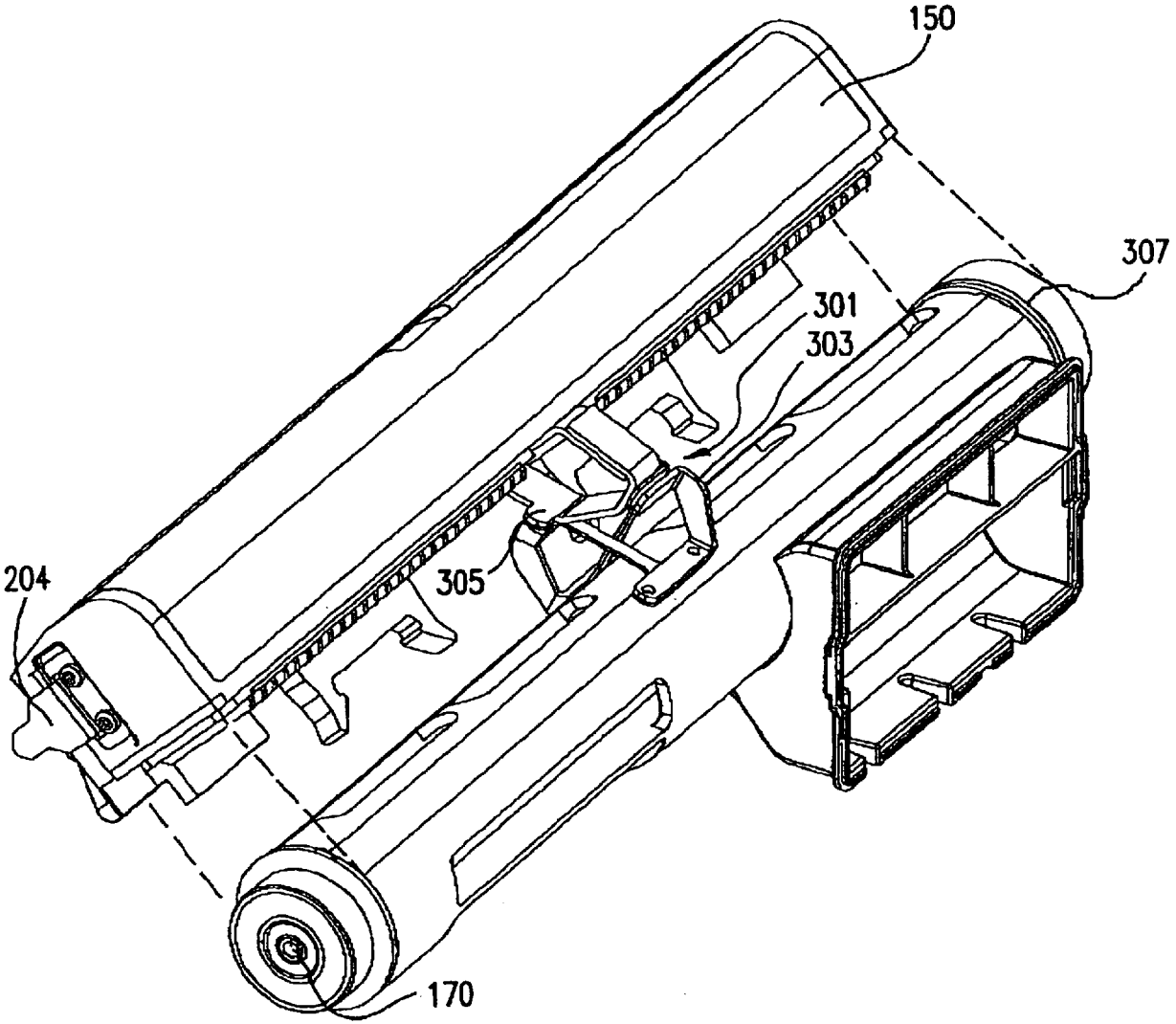
FIG. 17B shows an alternative embodiment of the printhead assembly that employs a movable bracket assembly for securing the printhead heat sink to the torque tube housing.
Figure 17C:
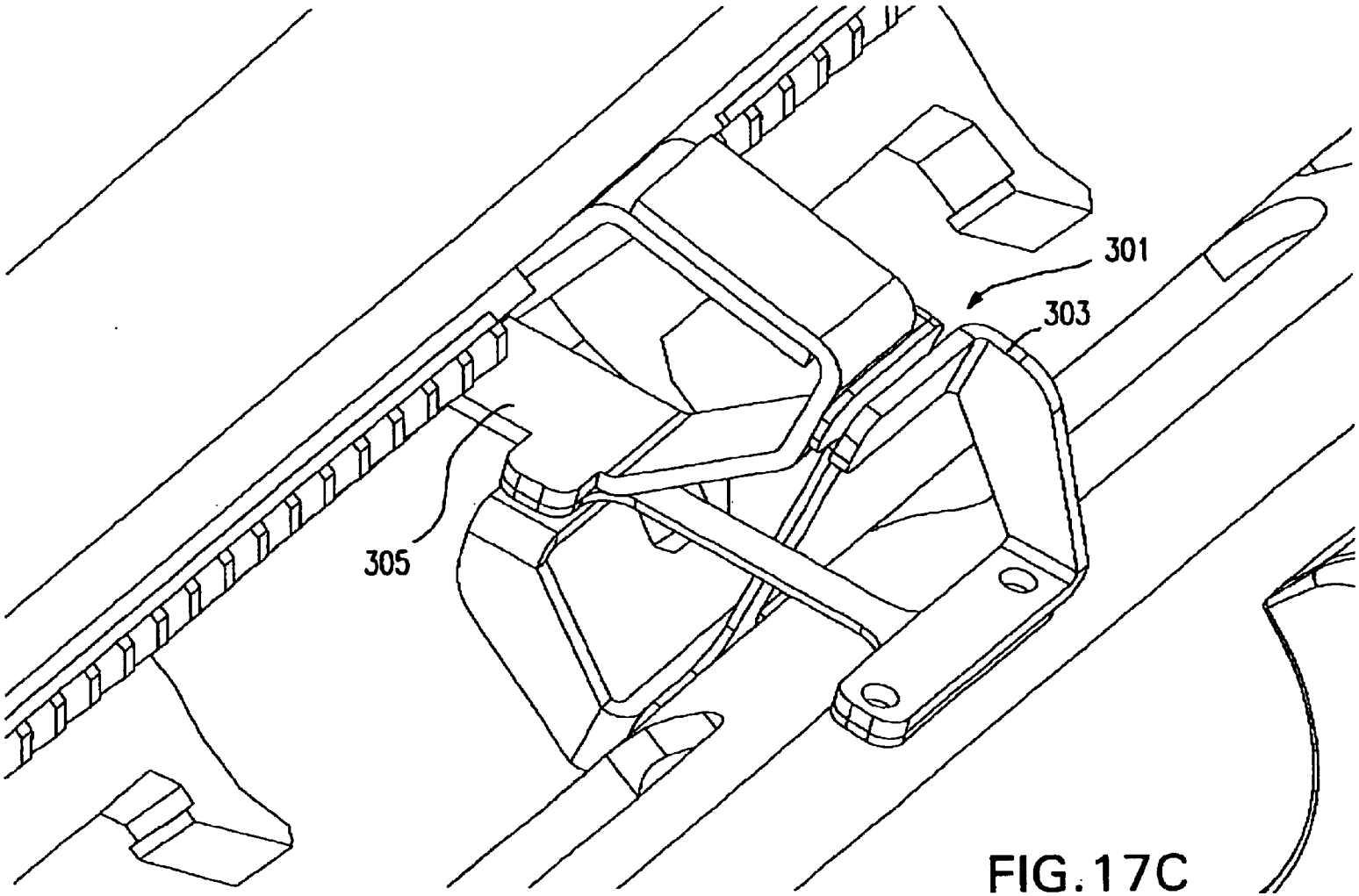
FIG. 17C shows an enlargement of the movable bracket assembly illustrated in FIG. 17B.

FIGS. 17B and 17C show an alternative embodiment for a pivot point 152 (FIG. 15A) for allowing the printhead heat sink 150 to move relative to the torsion bar 170. Bracket 301 is disposed between portions of the air channel for drawing air to the printhead heat sink 150 as illustrated below with reference to FIG. 21. Bracket 301 includes a first member 303 that couples to event housing 307. The event housing may be useful in directing later scenes from a movie. It includes a torsion bar 170. The second member 305, couples to the printhead heat sink 150. Members 305 and 303 are permitted to move relative to one another to allow the thermal elements of the printhead 151 to have uniform load distributed across the platen 76. As discussed above, the ball joint 152 in the embodiment of FIG. 15A allows the printhead 151 and heat sink 15 to rotate in a single plane. The bracket 301, on the other hand, allows movement of the printhead 151 and heat sink 150 with additional degrees of freedom, enabling greater flexibility to uniformly distribute the load of the printhead 151 on the platen roller 76 among the thermal element of the printhead 151.

Figure 18:
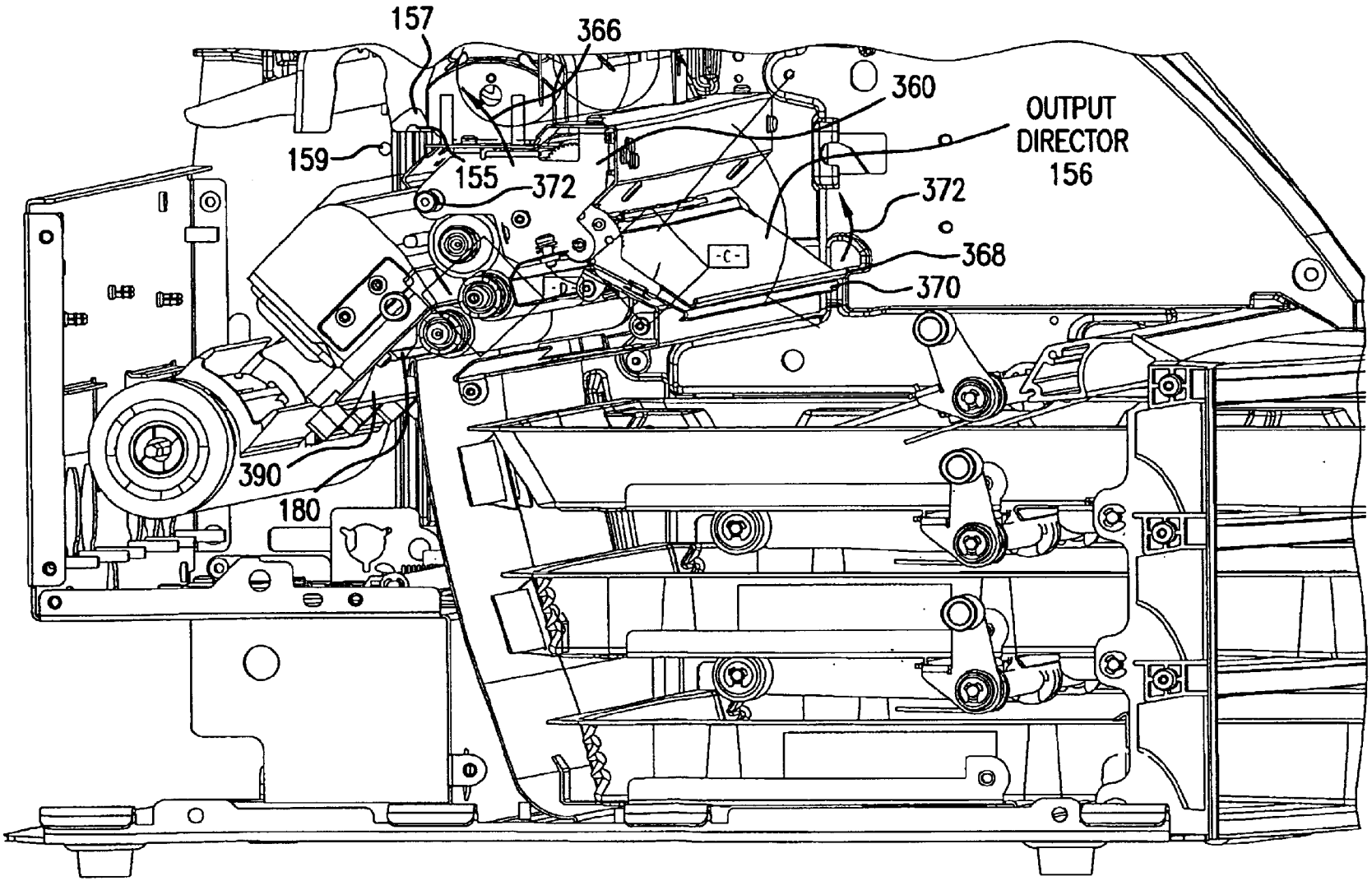
FIG. 18 shows a view of the multi-media printer illustrating an output diverter according to an embodiment.
Figure 19B:
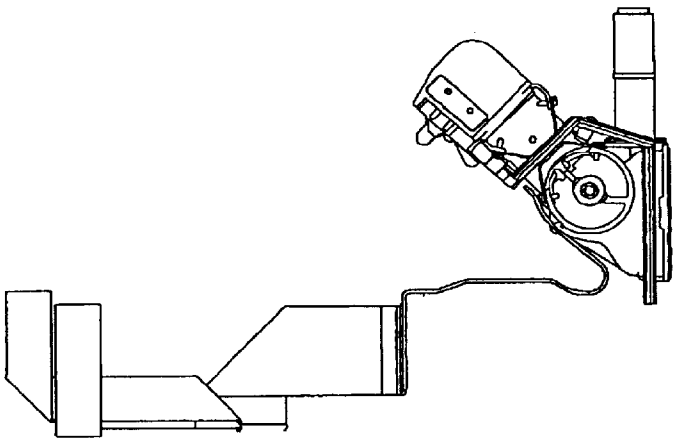
FIG. 19 shows a printhead assembly according to an embodiment.
Figure 19A:
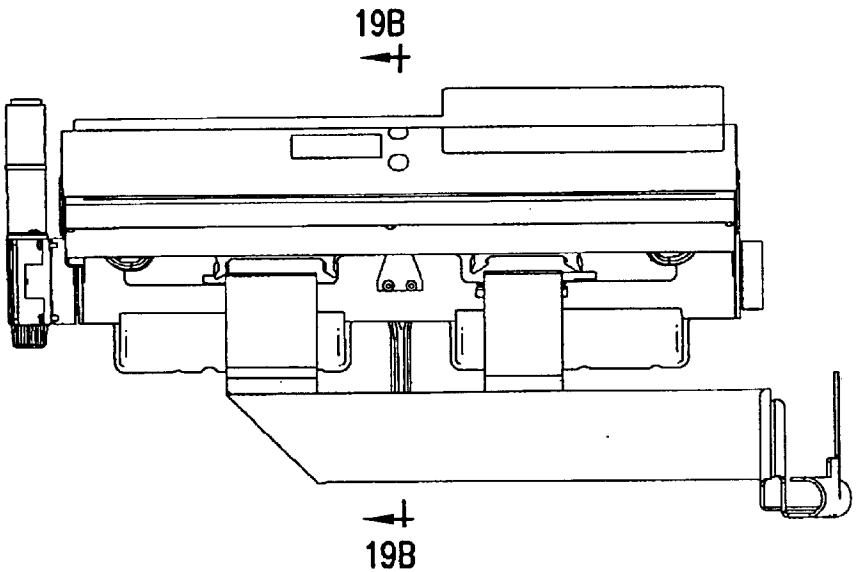

FIG. 18 shows a perspective view of the internal works of the media printer including the output diverter 156. FIG. 19 shows a cross-section of the printhead assembly.

Figure 20:
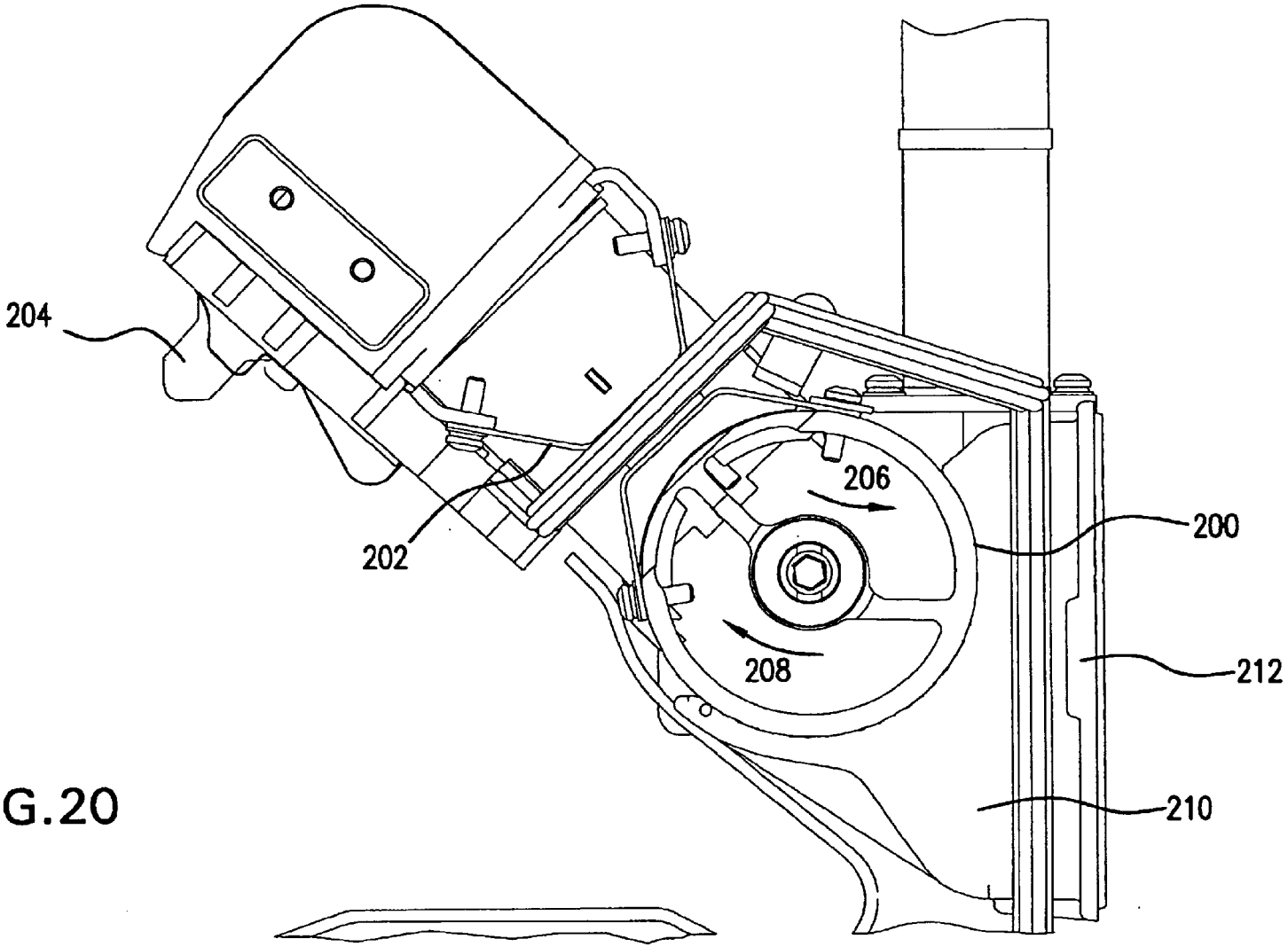
FIG. 20 shows an enlarged view of the printhead assembly according to an embodiment.
Figure 21:
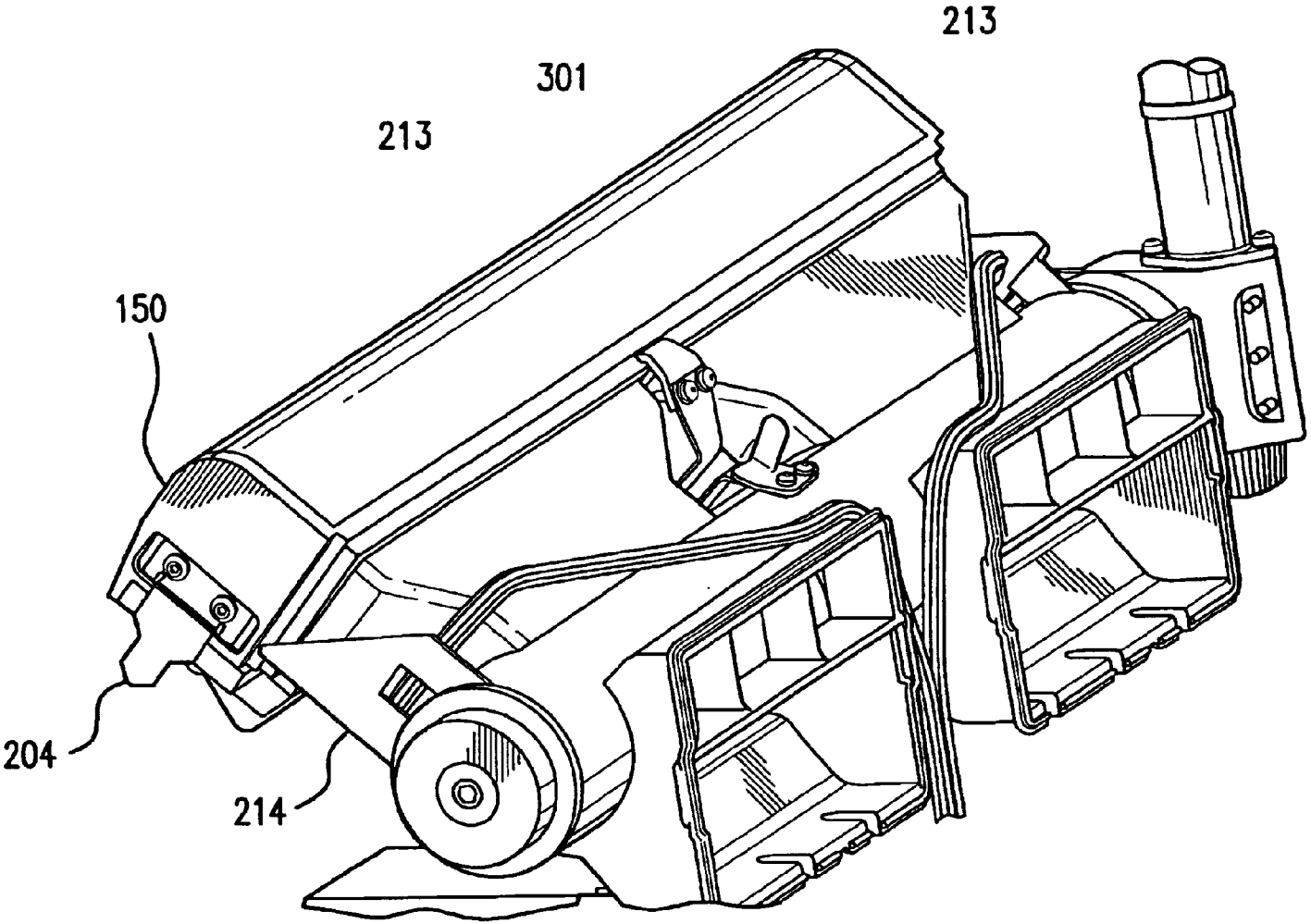
FIG. 21 shows an enlarged view of the printhead assembly illustrating a sealed channel for providing external air to the heat sink of the printhead according to an embodiment.

FIG. 20 shows an enlargement of embodiment of the printhead assembly including a printhead alignment tab 204 and a ventilation channel 212, which may include an intake path 208 and an exhaust path 206. FIG. 21 shows a perspective view of the printhead assembly shown in FIG. 20. FIG. 21 shows the bracket assembly 301 (FIGS. 17B and 17C) being disposed between ventilation channel members 213 for transporting external air to the heat sink 15 through external vents 62 and 63 (FIG. 7).

FIG. 22 shows an external view of the multi-media printer illustrating kicker tires 216 for a top output tray 113. As discussed above, similar kicker tires may be similarly placed to guide media sheets to the lower two output trays 113.

Returning to FIG. 17A, a portion of the media sheets during direct thermal imaging does not receive an image. This includes borders at the leading and trailing edges of the media sheet and at the sides of the media sheet. According to the embodiment, these areas may be blackened during the direct thermal processing. Here, the printhead may blacken the border at the leading edge up until the desired image portion begins. This may be accomplished by engaging the platen roller 76 with the clutch members 82 and 84 to pull the leading edge past the printhead 151 until the pinch and capstan rollers can grab the leading edge to commence translating the media sheet. After the border of the leading edge is blackened by the printhead 151, the clutch members 82 and 84 disengage the platen roller 76 from the capstan drive 80 to allow the capstan and pinch rollers 79 and 77 to pull the media sheet through the print station for transferring the desired image portion to the sheet. While transferring the desired image portion between the borders at the lending and trailing edges, the printhead 151 may also blacken the borders at the side edges. After the desired image portion is transferred to the media sheet, the platen roller 76 capstan and pinch roller may pull the trailing edge of the media sheet past the printhead 151 to be blackened.

The size of the borders at the side edges of the media sheet may be determined based upon the positioning of the media sheet relative to the printhead 151. A side edge sensor system may be located at one of the sides of the media sheet in the discharge path (and positioned relative to the printhead 151) to determine the lateral positioning of the media sheet with respect to the printhead 151. By knowing the lateral positioning of the media sheet, the location of the side edge borders in the media sheet can be precisely determined. This allows the printer controller to control the printhead 151 to blacken the side borders without marring the desired image received in the area of the media sheet within the side borders.

According to an embodiment, the printhead 151 may have a length greater than the widest media sheet used in the media printer. This may enable the printhead 151 to transfer an image to any portion of the imaging surface of the media sheet, regardless of the lateral alignment of the media sheet in the print station. Therefore, upon detection of the lateral alignment of the media sheet at the side edge sensors, the printer controller can control the printhead to blacken the borders at the side edges while transferring the desired image portion onto the media sheet between the borders at the side edges.

Figure 23:
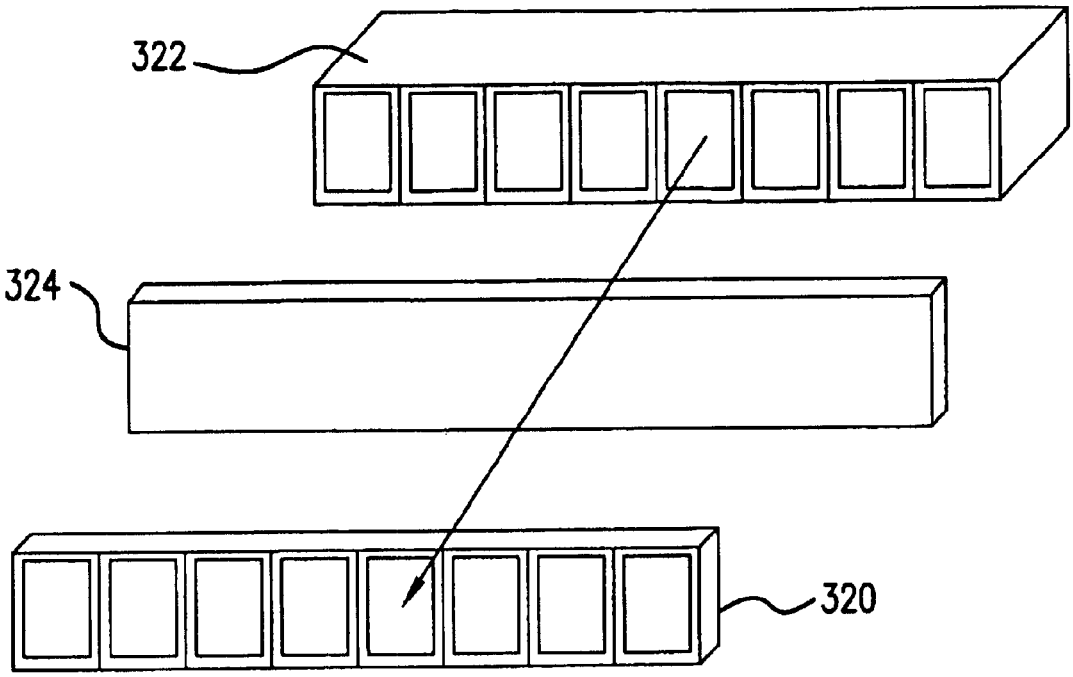
FIG. 23 shows an embodiment of the side edge sensors according to an embodiment.

FIG. 23 shows an embodiment of the sensor for detecting the side edge of the media sheet in the discharge path. The transmitter 322 may be placed at one side of the discharge path over or above a space where a side of the media sheet is to travel. A corresponding receiver portion 320 may be placed on the same side of the media sheet opposite the transmitter 322 to detect light energy emitted by the transmitter 322. Transmitter 322 may includes several LED lights or other light sources such as bulbs or lamps for providing a light source. A linear wave polarizer and quarter wave retarding filter 324 may be disposed over the transmitter 322 to provide a polarized light source directed to the receiver 320.

The receiver 320 may include an array of light detecting elements formed in a charge coupled device (CCD). A second linear polarizer may be disposed over the CCD which is eighty degrees (80°) out of phase from the linear polarizer of the transmitter 322. A second quarter wave retarding filter may be disposed over the second linear polarizer. Therefore, the CCD detecting elements may receive approximately 20% of the energy from the transmitter 322 when no media is present. Opaque media blocks all light. Therefore, for opaque media, the absence of energy at a pixel element in the receiver 320 that is adjacent to a pixel element detecting energy, processing may indicate that this point of change is the side edge of the media sheet.

Since the receiver 320 is capable of detecting changes in phase, the side edge detectors may detect edges not only for opaque media, but also for transparent media which have detraction properties introducing phase changes detectable at the pixel elements of receiver 320. Energy in excess of 20% may be transmitted when transparent plastic media are in the input path. Therefore, for transparent media, the detection of a high energy at a pixel element in the receiver 320 that is adjacent to a pixel element detecting no energy may indicate that the point of change is the side edge of the media sheet.

In addition to using the side edge sensor for blackening the borders of the sides of the media during direct thermal imagining, information from the side edge sensors may be used to calibrate the positioning of the printhead 151 in the lateral dimension. Given the exact placement of the side edge sensor with respect to the printhead 151, the lateral placement of the media sheet with respect to the printhead 151 can be precisely determined.

FIG. 24 illustrates a donor ribbon 346 that may be used in conjunction with the donor carriage including the donor spool 161 and the take up spool 162 (FIG. 15A). In the illustrated embodiment, the donor ribbon 346 provides for four-color dye diffusion printing having color sections for the following colors: cyan; magenta; yellow; and black. In the dye diffusion process, the media sheet is translated to the print station between the platen roller 76 and the donor ribbon 346 in multiple passes, each pass transferring a corresponding color component of the image onto the media sheet. FIG. 24 shows a yellow color section 342 and a magenta color section 344. Although only two color sections are shown, it will be understood that the illustrated embodiment may include color sections of four different colors for each of the aforementioned colors in the process. The color sections of donor ribbon 346 may repeat any given pattern such that each set of four consecutive color sections may span the four colors used in the dye diffusion process. Donor ribbon 346 may also includes a bar code portion 340 that extends along side of all of the color sections. This bar code information may indicate a specific lot number associated with the donor ribbon 346 and other manufacturer designated information. Additionally, in the illustrated embodiment, the bar code information at bar code portion 340 may indicate the specific linear location on the donor ribbon 346. For example, the bar code portion 340 at a particular location on the donor ribbon 346 may indicate the particular color associated with the adjacent color section. Additionally, the bar code portion 340 may indicate when a transition occurs between adjacent color sections. For example, as shown in FIG. 24, point 338 of the bar code portion 340 may indicate that the position of the donor ribbon 346 corresponding to point 338 is the border between the yellow color section 342 and the magenta color section 344. Accordingly, the media printer may use a single sensor to extract information about the particular lot of the donor ribbon and locations of transition between color sections.

Returning to FIG. 18, an embodiment of a sensor for reading the bar code 340 on the side of the donor ribbon 346 is shown. An emitter 159 may generate light that is reflected from reflecting piece 157 onto the bar code portion 340. A sensor 155 then receives the reflected bar code signature to decode. The printer controller can then determine the lot number and other manufacturing information and detect transitions between color sections in the donor ribbon 346.

Returning to FIG. 16, an embodiment of the present invention is directed to aligning a media sheet as it is translated to the print station. As discussed above, the picker assemblies 12 may be selectable for translating a top media sheet in a corresponding media tray against a guide surface 181. The leading edge of each top sheet in each of the media trays may be at a known distance from its position in the media tray to the print station where the printhead 151 meets the platen roller 76. The DC servo motor with encoder 30, the source of torque which drives the picker assemblies 12, may respond to a set number of encoded pulse signals that indicates that a particular top media sheet has traveled a particular distance. In other words, depending upon which media tray a top sheet is being dispensed from, the DC servo motor with encoder 30 receives a discrete number of encoded pulses to translate the leading edge of the top sheet to the print station where the platen roller 76 meets the printhead 151. This discrete number of encoded pulses may depend upon the size of the media sheet in a tray.

The torsion bar 170 may place the printhead assembly in any one of four positions: a retracted position; a load position; a feed position and a print position. In the retracted position the printhead assembly is retracted back until a head home position sensor 154 is tripped. In the print position, the printhead 151 is pressed against the platen roller 76 with a force sufficient for printing. In the load position, the printhead 151 is raised off of the platen roller 76 slightly, allowing a media sheet to be pulled through the print station by rotating the platen roller 76. In the feed position, the printhead is brought into contact with the platen 76, but with less force than in the print position. In the feed position, a media sheet may be translated over the printhead by rotating the platen roller 76.

As the leading edge of the media sheet approaches the print station, the printhead 151 is in the feed position against the platen roller 76, preventing the leading edge of the media sheet from passing through. A nip is formed between the printhead 151 and the platen roller 76 when the printhead is in the feed position. The DC servo motor 30 may drive the picker assembly 12 until the leading edge of the media sheet is received at the nip. Under the control of the printer controller, the DC servo motor 30 may continue to drive the picker assembly 12 to slightly buckle the media sheet proximate the leading edge thereof to align the leading edge of the media sheet in the nip. As the leading edge aligns in the nip between the printhead 151 and the platen roller 76, the printhead 151 may be raised to the load position momentarily and then to the feed position. The platen 76 may then be engaged to rotate (via the clutch members 82 and 84) to translate the media sheet a certain distance further. The media sheet then meets the capstan and pinch roller combination 79 and 77 to be further translated through the print station as the clutch 82 disengages the platen roller 76 from the capstan shaft 80. The printhead 151 then moves from the load position to the print position against the platen 76 to commence printing.

The media wall 136 (FIG. 15A) is shaped to support media sheets to maintain longitudinal rigidity to prevent buckling except at the leading edge when aligning the media sheet in the nip performed at the capstan and pinch roller combination 79 and 77. Accordingly, no intermediate rollers are required between the media trays and the print station.

In another embodiment, the media printer includes a leading edge detection sensor 186 (FIGS. 16 and 17A) for detecting a leading edge of a media sheet being dispensed during the input path. Upon detection of the leading edge of a media sheet by the leading edge sensor 186, the printer controller may be able to determine how many additional encoded pulses should be transmitted to the DC servo motor 30 to rotate the picker tires 13 until the leading edge of the media sheet reaches the nip where the platen roller 76 meets the printhead 151.

In addition to controlling whether the printhead 151 is in either a retracted position, load position, feed position or print position, the printhead assembly may be adjusted to provide a controllable force at many levels to the platen 76 to support several different imaging techniques. This is enabled by the worm gear 56 and motor 58, which control the torque applied to the torsion arm with great precision in response to signals from the printer controller. This enables the media printer to provide the appropriate force of the thermal elements of the printhead 151 against the platen roller 76 depending upon whether the intended printing process is dye diffusion or direct thermal printing. Also, the force of the printhead 151 against the platen roller 76 may be adjusted based upon the width of the media sheet being imaged. The force of the printhead 151 against the platen roller 76, therefore, may be controlled by the printer controller by providing control signals to the motor 58 for application to the worm gear 56.

One embodiment of the present invention employs media trays as described in the aforementioned U.S. patent application Ser. No. 08/979,683 incorporated herein by reference. In particular, the media trays may be vacuum formed from a thermoplastic sheet and have internal dimensions that are formed to the specific size of media to be dispensed from the tray. In one embodiment, the media trays are intended to be disposable. Therefore, each media tray may be specifically formed to dispense media sheets of a particular type and size.

The top media sheet in each media tray may adhere to the media sheet immediately below the top media sheet with some retention force. The picker tires 13 may apply a lateral force to the top sheet which exceeds the retention force, causing the top sheet to translate forward while a nail in the media tray fixes the leading edge in the media tray, causing the top sheet to buckle until the leading edge flips over the tray and into the input path. According to an embodiment, each media tray may be specially formed (e.g., by varying the angles of the front nail which secures the leading edge of the top sheet while the trailing edge is translated forward) based upon the specific media type (and retention force associated therefore) and media size.

Figure 25:
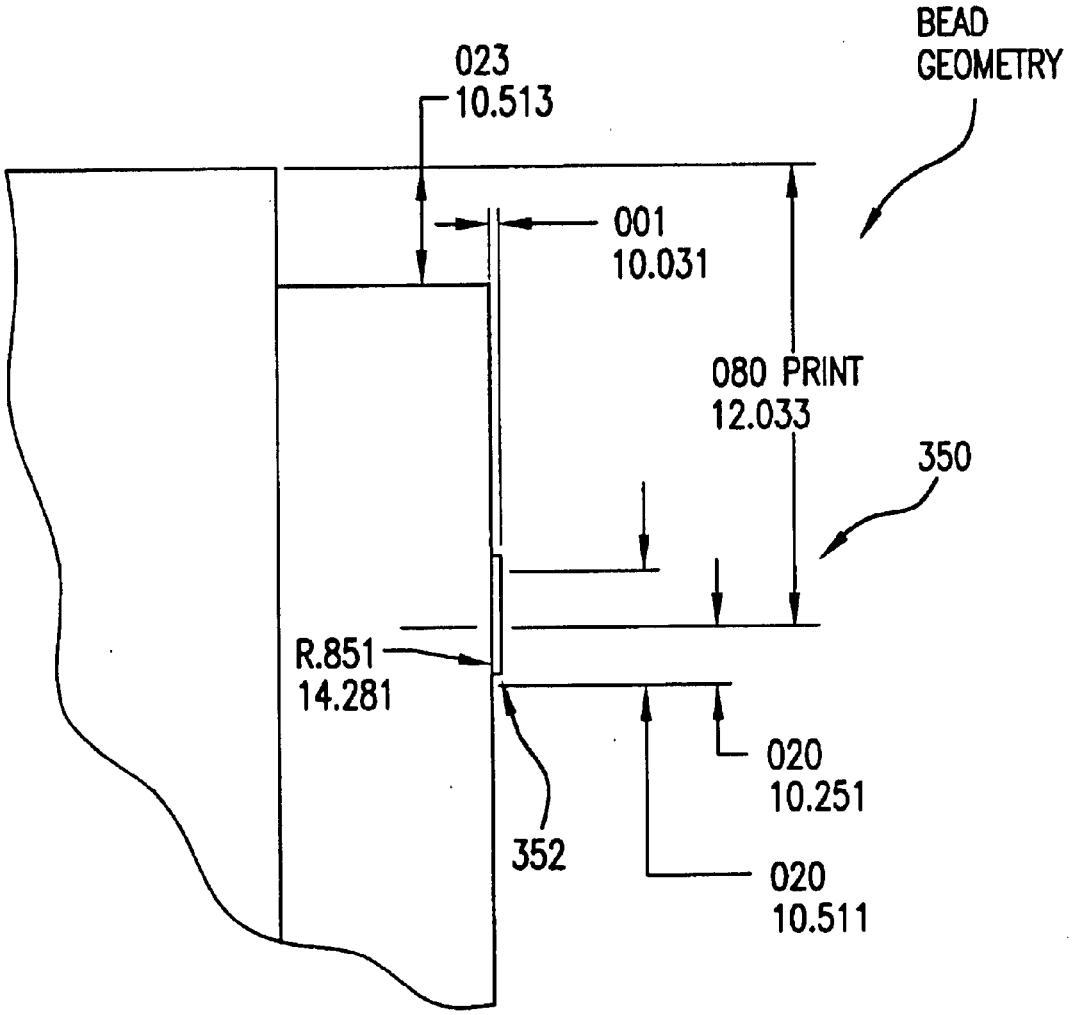
FIG. 25 shows an embodiment of a printhead bead having an imaging surface geometry suitable for either direct thermal or dye diffusion printing.

In the illustrated embodiment, the thermal elements of the printhead 151 are adapted for thermal imaging using either a direct thermal or dye diffusion process. Thermal elements in a printhead are typically formed by a resistive heating element(s) coated with a ceramic bead to provide an imaging surface. For dye diffusion printing, the optimum printhead geometry is typically provided by a thermal imaging surface in the form of a rounded bead. On the other hand, the optimal printhead geometry for direct thermal imaging is typically a flatter imaging surface. FIG. 25 shows a thermal element printhead geometry 350 which is optimized for either direct thermal or dye diffusion processing according to an embodiment of the printhead 151. The dimension shown are in inches.

As discussed above, embodiments of the present invention are directed to a multi-media printer which is capable of interchangeably using a direct thermal or dye diffusion process. Direct thermal printing and dye diffusion printing each have different requirements for heating the printhead. Each process has an associated subimaging temperature. Maintaining a printhead at a subimaging temperature between prints allows the printer to quickly raise the temperature of the thermal elements as required to transfer an image to the media using either process. In an illustrated embodiment, the media printer maintains the thermal elements of the printhead at the lowest subimaging temperature supported by the media printer. Therefore, the imaging surfaces of the thermal elements can be raised to a temperature suitable for imaging in any of the imaging methods employed by the media printer.

The printhead 151 of the illustrated embodiment receives a series of voltage pulses at a set pulse width and a set duty cycle to provide certain levels of intensity or gray to a pixel in the image. While for any particular media type there may be a set pulse profile for each desired level of intensity or gray, media sheets of the same type from different manufacturing lots may have different responses to the same pulse profile. For example, a first lot of media may require fifteen pulses at 15 volts to provide a level of gray or intensity of 2.0. On the other hand, a different lot may require fifteen pulses at 15.6 volts to achieve the same level of gray or intensity. As discussed above with reference to FIGS. 10A through 10C, a bar code scanner 110 reads a bar code on the side of each media tray as inserted into the media printer. In addition to identifying the media type and size associated with the media sheets disposed therein, this bar code may also identify a particular manufacturing lot associated with the media in the media tray. Therefore, the printer controller can, upon associating a media type and manufacturing lot number with the media sheet to receive the image, change the voltage of the pulses applied to the thermal elements to provide the desired level of intensity or gray at points in the image. Additionally, the voltages can be further modified based upon a parasitic resistance which results from the combination of the resistance of the power cable from the power supply 144 (FIG. 13) and the known resistances of the thermal elements which may be measured according to techniques described in U.S. patent application Ser. No. 09/262,988, filed on Mar. 5, 1999 entitled "System for Printhead Pixel Heat Compensation," assigned to Codonics, Inc., and incorporated herein by reference.

The different sensors in the media printer, including the side edge sensor, leading edge sensor and bar code sensor for the donor ribbon, may rely on a light emitting diode (LED) source for light. Over time, LEDs such as those employed in the media printer for the various sensors, typically decrease in brightness. According to an embodiment, a printer controller includes logic for compensating for the decreases in the brightness of the LEDs by recalibrating the sensors periodically. This may increases the life of a sensor by keeping it from going out of adjustment from changes in the intensity of light emitted by the LEDs.

Figure 15B:
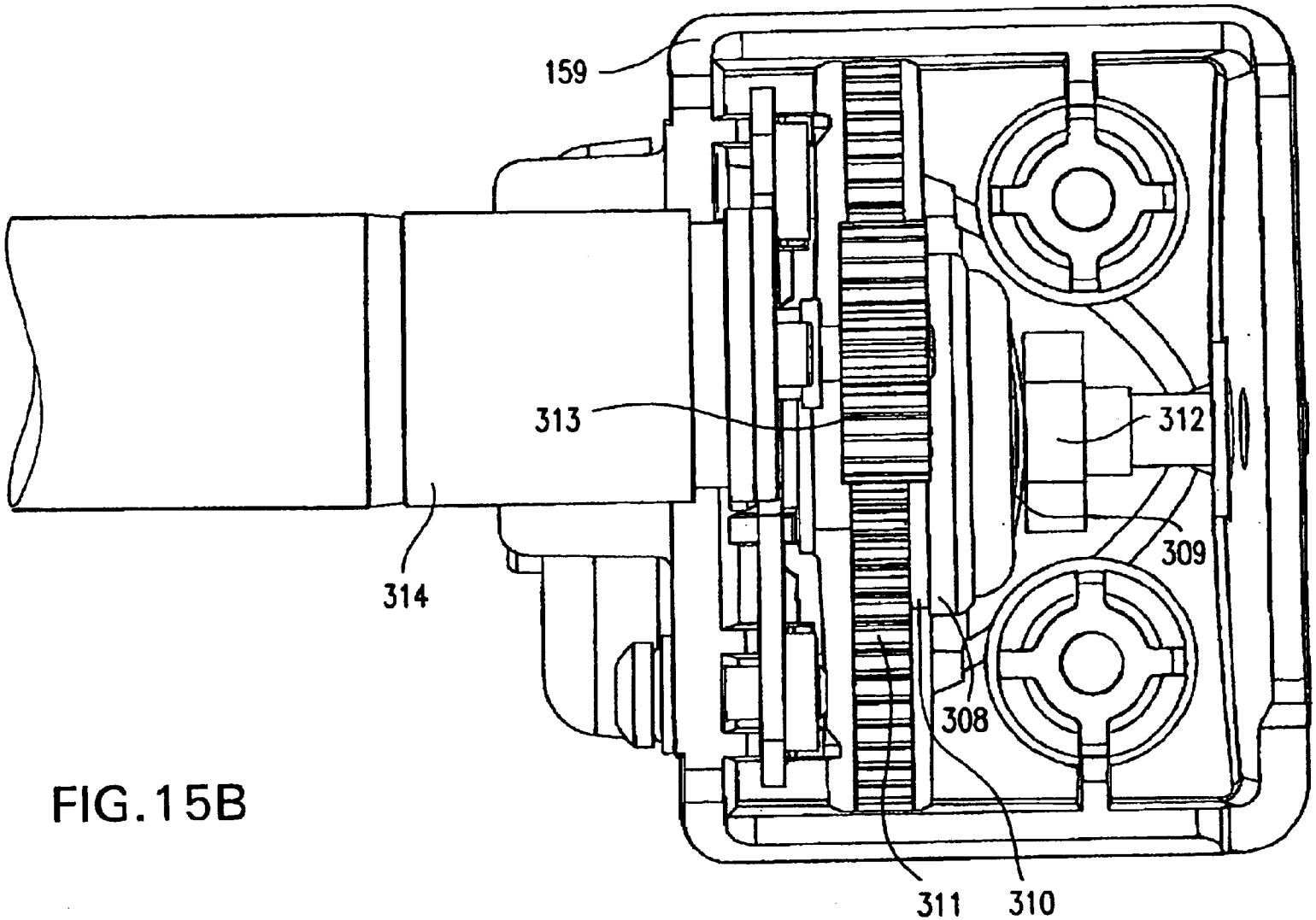
FIG. 15B depicts a mechanism that may be used to drive a donor ribbon take-up spool according to an embodiment of the invention.

Returning to FIG. 15A, the take-up spool 162 of the donor carriage may be driven by gears with a clutch. The gears may be sized to provide enough drag on the donor roll 161 without introducing any artifacts. A gear casing 159 houses the drive mechanism of the take up spool 160. As shown in FIG. 15B, a built-in slip clutch, comprised of a pressure plate 308, friction disc 310, spring member 309, adjustment nut 312 and drive gear 311, decouples the motor 314 and pinion gear 313 noise and provides for an even pull on the donor ribbon.

Embodiments of the media printer may include a densitometer located in the discharge path on the opposite side of the print station from the input path. As known to those of ordinary skill in the art, a densitometer includes a sensor system for determining the image density in a particular portion of an image transferred onto media. If this is on a known portion of the image with a corresponding desired image density represented in image data at the printer controller, the printer controller can determine whether the printed image, in general, has an image density which accurately reflects the image data of the desired image. As discussed above, embodiments of the media printer may adjust the voltages applied to the printhead elements based upon a media type and the lot number detected from the bar coder 110. The voltages of the pulses applied to the printhead may be further modified based upon the densitometer readings to provide an even more accurate image density by taking into consideration not only media type and specific lot number, but also the unique characteristics of the print station of the printer as measured by the densitometer.

In another embodiment of the present invention, a smart card or removal memory is provided as an adjunct to a nonvolatile memory of the print controller which includes information stored in the print controller such as gamma contrast, license keys, Postscript settings, a TCP/IP address associated with the printer, and the like. When the printer is not in service or is malfunctioning, this memory may be removed and inserted into a functioning printer so that the new printer does not need to be reprogrammed to the settings of the malfunctioning computer. The malfunctioning printer may then be shipped off site for repair.

As discussed above, in one embodiment of the present invention the top and bottom and side borders of the image may be blackened during direct thermal imaging. This is particularly useful in applications where direct thermal imaging is used on film for medical diagnostic imaging such as x-ray images. In an alternative embodiment, the media sheets may have perforations on top and bottom and sides so that the unprinted borders can be easily removed and the imaged media sheets can be used in medical analysis in the normal fashion.

Embodiments of the multi-media printer are directed to allowing the user easy access to areas of the multi-media printer for removal of jammed media sheets and cleaning. Referring to FIGS. 3A and 4, the user may remove jammed paper in the input path by removing a media tray from its media input cavity 6 and rotating the sheet metal arm 17 of the associated picker assembly 12 upward. The sheet metal arm 17 is rotatable upward by manually lifting to apply a torque against the torsion spring 36 of the associated picker assembly 12.

Additionally, the user may have unobstructed access to the discharge path following the capstan and pinch roller combination 79 and 77. FIGS. 8 and 18 illustrate an output media guide 360 which may be manually rotated about a point 372 to allow access to the capstan and pinch rollers when the output media tray and kicker assembly (shown FIGS. 10D and 10E) are removed. In the illustrated embodiment, the output media guide 360 may rotated in a direction 366 about point 372 to place the output media guide 360 in an open position. When the output media guide 360 is in the closed position (as shown in FIG. 18), the output media guide 360 is secured at clips 362 on opposite sides of the media printer. When the user moves the output media guide 360 from the closed to the open position, the user detaches the output media guide 360 from the clips 362, rotates the upward media guide 360 in the direction 366, and attaches the output media guide to clips 364 (FIG. 4). Accordingly, the user can gain unobstructed access to the pinch and capstan roller combination 77 and 79 at the discharge path by first removing the output tray assembly shown in FIGS. 10D and 10E and then moving the output media guide 360 in the open position to be secured at clips 364.

FIGS. 4, 8 and 18 show that the output diverter 156 is coupled to the output media guide 360 so that it is rotated upward in the direction 366 when the output media guide 360 is rotated in the direction 366 from the closed to the open position. The user may also gain unobstructed access to the capstan and pinch roller combination 77 and 79 through the discharge path by manually positioning the output diverter 156 while the output media guide remains in the closed position.

In another embodiment, the output diverter 156 may include a lower portion 370 and an upper portion 368. The user may manually separate the lower portion 370 from the upper portion 368 by rotating the upper portion 368 in a direction 372.

Figure 26:
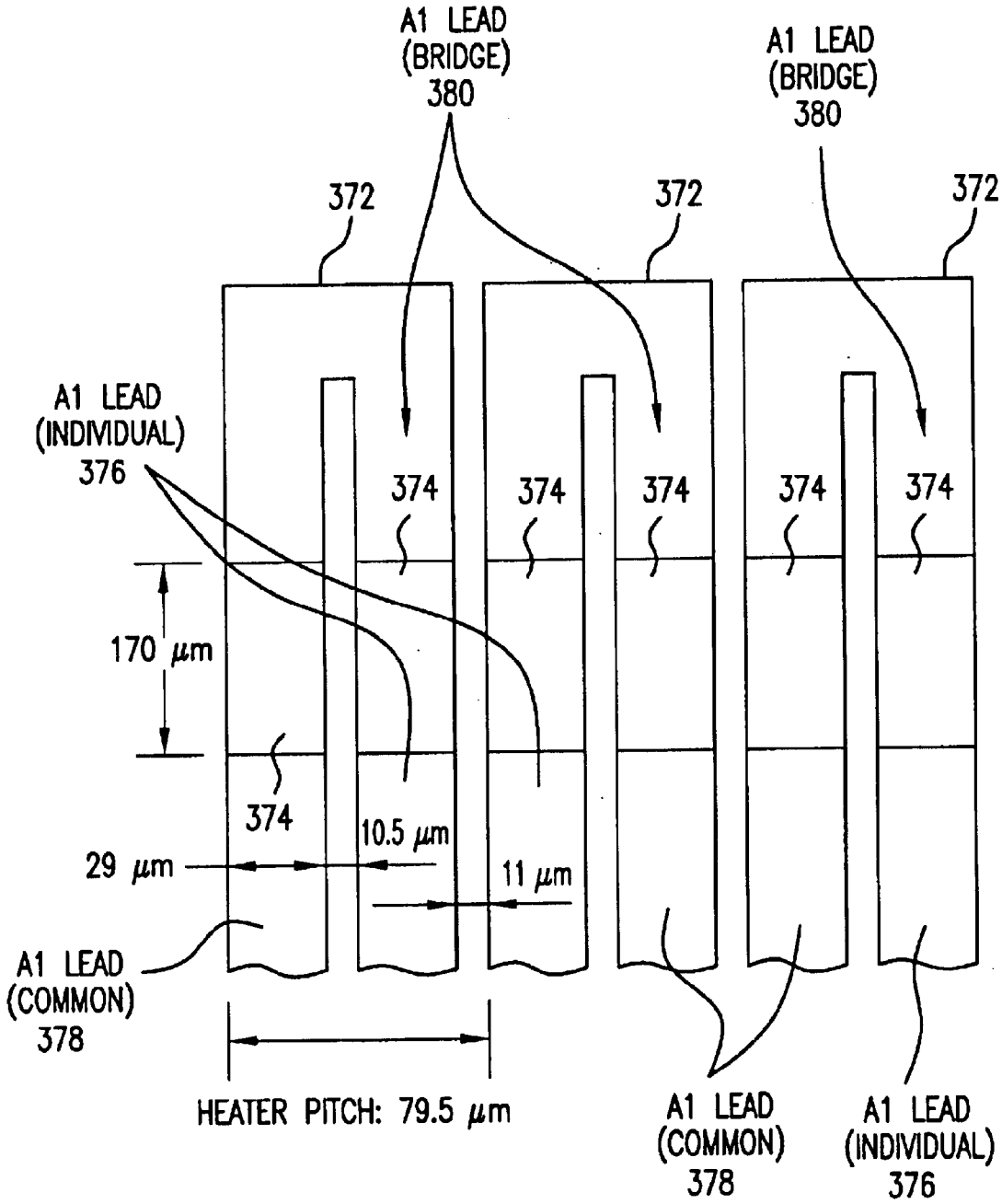
FIGS. 26 and 27 show an embodiment of a "U" shaped structure for thermal elements in a printhead and a bead geometry achievable from same.
Figure 27:
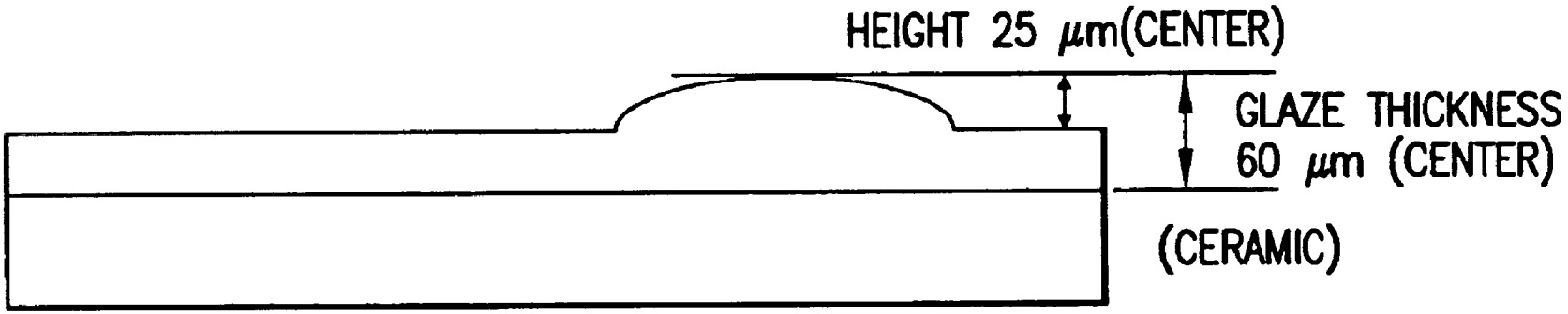

FIG. 26 shows an embodiment of the printhead 151, which includes an array of thermal elements 372. Each thermal element 372 has a "U" shaped structure having a common lead 378 and an individual lead 376. Each of the thermal elements may include a bridge 380 coupled at a first end to the associated common lead 378 and coupled at a second end to the associated individual lead 376. The first and second ends of the bridge 380 may be coupled to the associated individual lead 376 and common lead 378 through a resistive element 374. The common leads 378 of the thermal elements 372 may be coupled to a common fixed voltage or ground while a signal having a pulse profile is applied to the individual lead 376 for imaging. By having two resistive elements 374 for each thermal element 372 aligned in line with the linear array of thermal elements, the imaging surface of the thermal element 372 may be concentrated over a smaller area. This allows placement of the imaging surface of the printhead 151 (i.e., the ceramic printhead bead) closer to the edge of the printhead 151 toward the pinch and capstan roller combination 77 and 79 as shown in FIG. 27. FIG. 27 shows an alternative geometry of a printhead bead which is placed near the edge of the printhead 151 so as to minimize the size of the borders at the leading and trailing edges of the media sheet which cannot receive portions of the desired image during direct thermal imaging.

FIGS. 17 and 18 show that the printhead shield 180 may include a leading edge portion 390 which is in contact with the donor ribbon (not shown) during dye diffusion printing. FIG. 16 shows the printhead assembly in a preprint position. During printing, the torsion arm 170 may apply an increased level of torque such that the printhead assembly bends at ball joint 152. This positions the lending edge portion 390 to guide the donor ribbon between the supply and take up spools.

FIG. 15A shows a donor ribbon supply carriage 394 which may hold the take up spool at a location 159 and includes a snap portion 162 for removably receiving the donor roll 161. A donor access door 392 is adapted to receive the donor ribbon supply cartridge 394 when the donor roll 161 is removed and inserted from the snap position 162. In the illustrated embodiment, when the printhead assembly is in a retracted position applying a force to stop portion 164 of the donor ribbon supply cartridge 394, the donor roll 161 may be pulled out of the snap position at 162 while the printhead assembly maintains force against the portion 164 (while the printhead assembly is in the retracted position).

While there has been illustrated and described what are presently considered to be the preferred embodiments of the present invention, it will be understood by those skilled in the art that various other modifications may be made, and equivalents may be substituted, without departing from the true scope of the invention. Additionally, many modifications may be made to adapt a particular situation to the teachings of the present invention without departing from the central inventive concept described herein. Therefore, it is intended that the present invention not be limited to the particular embodiments disclosed, but that the invention include all embodiments falling within the scope of the appended claims.

What is claimed is:

1. A printer for transferring images to media using a multi-color dye diffusion process or a direct thermal process, the printer comprising:

a print station including a printhead and a platen for receiving sheets of receiver media fed therebetween from an input path;

a first discharge path for translating completely imaged receiver media, created using the multi-color dye diffusion process or the direct thermal process, from the print station to an output tray;

a second discharge path for translating receiver media from the print station to a compartment separated from the output tray during intermediate passes of the dye diffusion process; and an output diverter which is movable to guide media sheets from the print station to said first discharge path when said output diverter is in a first position and to guide media sheets from said print station to said compartment during intermediate passes of the dye diffusion process when said output diverter is in a second position.

2. The printer according to claim 1, wherein the media sheets are transferred to an output tray from said first discharge path and said compartment is physically under the output tray.

3. The printer according to claim 1, wherein the output diverter is movable by utilization of a motor controlled by a printer controller.

4. The printer according to claim 1, wherein a portion of the media sheets move past the output diverter during intermediate passes of the dye diffusion process.

5. A printer for use in transferring an image to a media sheet using a dye diffusion process or a direct thermal process, the printer comprising:

a platen;

a printhead assembly having a printhead and a point of rotation allowing said printhead to be rotated between a first printhead position in which said printhead is proximate a media sheet in contact with said platen and a second printhead position in which said printhead is separated from said platen; and a dye diffusion donor apparatus having a donor spool and a take-up spool for dispensing a donor ribbon between the printhead and said media sheet when said printhead is in said first printhead position during dye diffusion printing, wherein said dye diffusion donor apparatus is movable such that said donor ribbon is not dispensed between said printhead assembly and said media sheet during direct thermal printing.

6. The printer according to claim 5, wherein said donor ribbon is placed against said printhead while said printhead is in said second printhead position and said donor ribbon is placed in contact with said media sheet when said printhead is rotated to said first printhead position.

7. The printer according to claim 5, wherein said take-up spool rotates about a fixed axis.

8. The printer according to claim 5, wherein said donor spool rotates about an axis that that is moveable between a first spool position and a second spool position, said donor ribbon being dispensed between the printhead and said media sheet when said donor spool is in said first spool position.

9. The printer according to claim 8, wherein said axis is fixed in said first spool position during said dye diffusion printing.

10. The printer according to claim 8, wherein said printhead assembly is between said first spool position and said second spool position when said printhead is in said first printhead position.

11. The printer according to claim 8, wherein said take-up spool is rotated to reduce the length of said donor ribbon between said donor spool and said take-up spool as said donor spool is moved from said first spool position to said second spool position 12. The printer of claim 5, further including a motor configured to rotate a torque shaft; and a picker assembly associated with each of a plurality of trays, each of said picker assemblies including:

a drive shaft having an axis, a length, a center, a first end and a second end;

a compliant belt configured to rotate said drive shaft about said axis in response to rotation of said torque shaft by said motor; and a pair of picker tires attached to the drive shaft proximate aid first and second ends thereof such that the picker tires are coaxial with the drive shaft, the picker tires being rotatable when a torque is applied to said drive shaft by said compliant belt, wherein a top sheet of the stack of media sheets contained in one of said plurality of trays is dispensed from said tray by moving the picker assembly associated with said one of said plurality of trays to a lowered position in which said pair of picker tires is placed in contact with said top sheet of said stack of media sheets and said pair of picker tires is rotated by rotating said torque shaft.

13. The printer of claim 5, wherein the printhead has a printing surface and a second surface and further including:

a housing including at least one vent formed therein;

a heat sink coupled to the second surface of said printhead for removing heat from said printhead; and a ventilation channel coupled between the at least one vent and the heat sink to transport air from outside of the housing to the heat sink while preventing said air from reaching said printhead and said platen.

14. The printer of claim 5, further including a motor for providing a single source of torque;

a capstan and pinch roller combination adapted for receiving media sheets and translating the media sheets past the printhead and the platen in response to a first torque transferred to the capstan from the single source of torque;

at least one output tray for collecting the media sheets translate past the printhead and the platen by the capstan and pinch roller combination; and a roller adapted for translating the media sheets from the capstan and pinch roller combination to the at least one output tray in response to a second torque transferred to the roller from the single source of torque.

15. The printer of claim 5, further including:

at least one media tray containing a stack of the media sheets, said stack including a top sheet, wherein said stack rests on a bottom surface of said media tray;

a picker assembly for applying a lateral force to the top sheet to dispense said top sheet from said media tray;

a light source; and an optical sensor for detecting when all of said media sheets in said stack have been dispensed from said media tray.

16. The printer of claim 5, further including:

a capstan;

a pinch roller, the combination of said capstan and said pinch roller configured to translate said media sheet through an input path in a forward direction and a reverse direction between intermediate color passes during dye diffusion printing;

a plurality of media trays for dispensing said media sheet from among a plurality of media sheets to the printhead and platen through the input path; and at least one guide member having a first surface for guiding a leading edge of said media sheet from one of said plurality of media trays into the input path and a second surface for preventing a trailing edge of said media sheet from entering one of the plurality of media trays when said media sheet is translated in the reverse direction.

17. The printer of claim 5, further including a capstan and pinch roller combination for translating the media sheets through the printhead and the platen to an output path; and a sensor in the output path positioned to detect one of the first and second side edges of a media sheet while said media sheet is being translated through the output path, said sensor producing output indicating a lateral alignment of the media sheet relative to the printhead.

18. The printer of claim 5, further including a capstan and pinch roller combination for translating said media sheet from the print station through an output path; and a sensor in the output path at a known distance from the printhead for detecting the leading edge of the media sheets when translated in the output path.

19. The printer of claim 5, wherein the printhead is secured to a printhead support member, said printhead support member having a point of rotation at a radial distance from the printhead; and further including a torsion arm configured to apply a torque to the printhead support member such that a force is applied to said platen through said printhead when said printhead and said platen are in contact, wherein the torque applied by the torsion arm is controllable by a printer controller to maintain the force applied to the platen at a first force which is suitable for printing using a dye diffusion technique or a second force which is suitable for printing using a direct thermal transfer technique.

20. The printer of claim 5, wherein the printhead has a linear array of thermal elements, each of the thermal elements having an imaging surface for applying a force to the platen at the imaging surface and having a heat sink thermally coupled to the array of thermal elements, and further including a vent channel being fixedly attached to the external vent and being coupled between the heat sink and the external vent to permit air to circulate from external of an enclosure to the heat sink; and a flexible coupling between the vent channel and the heat sink permitting movement of the printhead such that the force applied to the platen during printing is substantially uniform over the array of thermal elements.

21. The printer of claim 5, further including a print controller;

a plurality of media frays, each of the media trays holding a stack of media sheets of a uniform media type, at least two of the media trays having plurality of media sheets of distinct media types;

a marking associated with each of said media trays, said marking containing readable information indicating one of the size, the type, the opacity, the thermal characteristics or the lot number of said stack of media sheets associated with said media tray; and an optical sensor for reading said marking and transmitting data related to said readable information to said processor.

22. The printer of claim 5, further including a print engine for transferring images to media in response to control signals;

a printer controller for providing the control signals to the print engine based upon image data;

a first non-volatile memory storing printer system data accessible by processes executing at the printer controller, the printer system data including data representative of Postscript keys, gamma correction settings and a network address associated with the printer; and a second non-volatile memory for storing a copy of the printer system data, the second non-volatile memory being detachably coupled to the printer and capable of being coupled to a second printer for downloading the printer system data to the second printer.

23. A printer for use in transferring an image to a media sheet using a dye diffusion process or a direct thermal process, the printer comprising:

a platen;

a printhead assembly having a printhead and a point of rotation allowing said printhead to be rotated between a first printhead position in which said printhead is proximate a media sheet in contact with said platen and a second printhead position in which said printhead is separated from said platen; and a dye diffusion donor apparatus having a donor spool and a take-up spool for dispensing a donor ribbon between the printhead and said media sheet when said printhead is in said first printhead position during dye diffusion printing, wherein one of said donor spool and said take-up spool is moveable between a first spool position and a second spool position when the printer is transferring an image using the direct thermal process, said donor ribbon being dispensed between said printhead and said media sheet when said one of said donor spool and said take-up spool is in said first position.

24. The printer of claim 23, wherein the one of said donor spool and said take-up spool which is movable maintains the second spool position when the printer is transferring the image using the direct thermal process.

* * * * *